US011235942B2

(12) United States Patent
Nakano

(10) Patent No.: US 11,235,942 B2
(45) Date of Patent: Feb. 1, 2022

(54) APPARATUS FOR PROCESSING SHEETS

(71) Applicant: Takahiro Nakano, Misato (JP)

(72) Inventor: Takahiro Nakano, Misato (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/796,339

(22) Filed: Feb. 20, 2020

(65) Prior Publication Data

US 2020/0189872 A1 Jun. 18, 2020

Related U.S. Application Data

(62) Division of application No. 15/830,753, filed on Dec. 4, 2017, now Pat. No. 10,604,369.

(30) Foreign Application Priority Data

Dec. 9, 2016 (JP) ..... JP2016-239195
Dec. 9, 2016 (JP) ..... JP2016-239196

(51) Int. Cl.
*B65H 29/58* (2006.01)
*G03G 15/00* (2006.01)
(Continued)

(52) U.S. Cl.
CPC ..... *B65H 29/58* (2013.01); *B26D 5/00* (2013.01); *B26D 5/32* (2013.01); *B26D 5/34* (2013.01);
(Continued)

(58) Field of Classification Search
CPC ..... B65H 5/06; B65H 31/24; B65H 37/04; B65H 2801/27; G03G 2215/00818; B26D 5/20; B26F 1/02; B26F 1/06; B26F 1/12
(Continued)

(56) References Cited

U.S. PATENT DOCUMENTS 6,671,492 B2 * 12/2003 Mimura ..... G03G 15/6541 399/407
6,702,279 B2 * 3/2004 Adachi ..... B42C 1/12 271/220
(Continued)

FOREIGN PATENT DOCUMENTS

JP 2002-179330 A 6/2002
JP 2009-230127 A 10/2009
(Continued)

OTHER PUBLICATIONS

Japan Patent Office, "Office Action for Japanese Patent Application No. 2016-239195," dated Sep. 28, 2020.
(Continued)

*Primary Examiner* — Leslie A Nicholson, III
(74) *Attorney, Agent, or Firm* — Manabu Kanesaka

(57) ABSTRACT

A sheet processing apparatus arranged in a space between an image reading section for reading an image and an image formation section for forming an image on a sheet includes a carry-in path guiding a sheet from a carry-in entrance; a relay roller provided in the carry-in path to relay and transport the sheet; a first transport path positioned on a downstream side of the relay roller and having a carry-in roller to transport the sheet from the carry-in path to the first collection tray; and a second transport path branched from the carry-in path and having a branch roller to transport the transported sheet to the second collection tray. The relay roller shifts the sheet in a direction crossing the transport direction while a front end of the sheet enters the first transport path or the second transport path, and arrives at the carry-in roller or the branch roller.

13 Claims, 34 Drawing Sheets

(51) Int. Cl.

| | |
|---|---|
| ***B65H 31/10*** | (2006.01) |
| ***B65H 5/06*** | (2006.01) |
| ***B65H 37/04*** | (2006.01) |
| ***B65H 31/24*** | (2006.01) |
| ***B65H 29/14*** | (2006.01) |
| ***B65H 31/02*** | (2006.01) |
| ***B65H 31/36*** | (2006.01) |
| ***B26D 7/01*** | (2006.01) |
| ***B65H 85/00*** | (2006.01) |
| ***B26F 1/04*** | (2006.01) |
| ***B26D 5/34*** | (2006.01) |
| ***B65H 29/12*** | (2006.01) |
| ***B65H 33/08*** | (2006.01) |
| ***B65H 31/38*** | (2006.01) |
| ***B65H 35/00*** | (2006.01) |
| ***B26D 5/32*** | (2006.01) |
| ***B26D 5/00*** | (2006.01) |
| ***B65H 43/00*** | (2006.01) |

(52) U.S. Cl.

CPC ..... *B26D 7/015* (2013.01); *B26F 1/04* (2013.01); *B65H 5/062* (2013.01); *B65H 29/125* (2013.01); *B65H 29/14* (2013.01); *B65H 31/02* (2013.01); *B65H 31/10* (2013.01); *B65H 31/24* (2013.01); *B65H 31/36* (2013.01); *B65H 31/38* (2013.01); *B65H 33/08* (2013.01); *B65H 35/00* (2013.01); *B65H 37/04* (2013.01); *B65H 43/00* (2013.01); *B65H 85/00* (2013.01); *G03G 15/6547* (2013.01); *B65H 2301/4212* (2013.01); *B65H 2301/4213* (2013.01); *B65H 2404/1422* (2013.01); *B65H 2404/1521* (2013.01); *B65H 2404/632* (2013.01); *B65H 2405/11151* (2013.01); *B65H 2511/224* (2013.01); *B65H 2801/27* (2013.01); *G03G 2215/0089* (2013.01)

(58) Field of Classification Search

USPC ..... 270/58.12, 58.17, 58.08, 58.27; 271/184, 271/252

See application file for complete search history.

(56) References Cited

U.S. PATENT DOCUMENTS

| | | | | |
|---|---|---|---|---|
| 7,388,980 | B2 * | 6/2008 | Vaidyanathan | B23P 6/002 382/152 |
| 7,401,776 | B2 * | 7/2008 | Obuchi | B65H 29/12 271/228 |
| 7,762,539 | B2 * | 7/2010 | Nagata | B42C 1/12 270/58.08 |
| 7,866,652 | B2 * | 1/2011 | Fujita | B42C 1/12 270/58.17 |
| 8,118,303 | B2 | 2/2012 | Obuchi et al. | |
| 8,308,154 | B2 | 11/2012 | Miyake et al. | |
| 8,794,616 | B2 | 8/2014 | Matsuki et al. | |
| 8,833,751 | B2 | 9/2014 | Ishikawa et al. | |
| 10,407,268 | B2 | 9/2019 | Nishi et al. | |
| 2013/0175752 | A1 | 7/2013 | Ishikawa et al. | |
| 2015/0165809 | A1 | 6/2015 | Komiyama et al. | |

FOREIGN PATENT DOCUMENTS

| | | | |
|---|---|---|---|
| JP | 2011-105467 | A | 6/2011 |
| JP | 4785474 | B2 | 10/2011 |
| JP | 2012-051685 | A | 3/2012 |
| JP | 2012-096897 | A | 5/2012 |
| JP | 2013-142029 | A | 7/2013 |
| JP | 5608479 | B2 | 10/2014 |
| JP | 2015-030602 | A | 2/2015 |
| JP | 2015-117076 | A | 6/2015 |

OTHER PUBLICATIONS

Japan Patent Office, "Office Action for Japanese Patent Application No. 2016-239196," dated Sep. 28, 2020.

* cited by examiner

FIG. 20

| WITH/WITHOUT PUNCH UNIT SETTING | WITH PUNCH UNIT SETTING | | | | | | | | WITHOUT PUNCH UNIT SETTING (ONLY TRANSPORT GUIDE/DUMMY PUNCH SETTING) | | | | | | | |
|---|---|---|---|---|---|---|---|---|---|---|---|---|---|---|---|---|
| SHEET LENGTH (SHEET SIZE/216-REFERENCE) | LARGE (B5 VERTICAL· LETTER VERTICAL· A4 VERTICAL· LEGAL· B4· A3) | | | | SMALL (B5 HORIZONTAL· LETTER HORIZONTAL· A4 HORIZONTAL) | | | | LARGE (B5 VERTICAL· LETTER VERTICAL· A4 VERTICAL· LEGAL· B4· A3) | | | | SMALL (B5 HORIZONTAL· LETTER HORIZONTAL· A4 HORIZONTAL) | | | |
| EXECUTION OF SHEET SHIFT | ABSENCE | | PRESENCE (ALIGNMENT PLATE SHIFT) | | ABSENCE | | PRESENCE (ROLLER SHIFT) | | ABSENCE | | PRESENCE (ALIGNMENT PLATE SHIFT) | | ABSENCE | | PRESENCE (ROLLER SHIFT) | |
| ROLLER SHIFT | – | | × | | – | | ○ | | – | | × | | – | | ○ | |
| ALIGNMENT PLATE VIA PROCESSING TRAY | – | | ○ | | – | | △ (EXECUTABLE) | | – | | ○ | | – | | △ (EXECUTABLE) | |
| DIE HOLE AVOIDANCE | ○ (PERFORM) | ○ | ○ | ○ | ○ (NOT NEED TO PERFORM) | ○ (NOT NEED TO PERFORM) | ○ (NOT NEED TO PERFORM) | ○ (NOT NEED TO PERFORM) | – | – | – | – | – | – | – | – |
| PUNCH (PUNCHING) PROCESSING | ABSENCE | PRESENCE | ABSENCE | PRESENCE | ABSENCE | PRESENCE | ABSENCE | PRESENCE | – | – | – | – | – | – | – | – |
| SHEET LENGTH AND PROCESSING PROCEDURE (PROCESSING RESULT) | LARGE ONLY DISCHARGE | LARGE PUNCH AND DISCHARGE | LARGE SHIFT IN PROCESSING TRAY AND DISCHARGE | LARGE PUNCH, THEN SHIFT IN PROCESSING TRAY AND DISCHARGE | SMALL ONLY DISCHARGE | SMALL PUNCH AND DISCHARGE | SMALL SHIFT BY ROLLER AND DISCHARGE (ALSO POSSIBLE TO RE-SHIFT VIA PROCESSING TRAY AND DISCHARGE) | SMALL SHIFT BY ROLLER, THEN PUNCH AND DISCHARGE (ALSO POSSIBLE TO RE-SHIFT VIA PROCESSING TRAY AND DISCHARGE) | LARGE ONLY DISCHARGE | | LARGE SHIFT IN PROCESSING TRAY AND DISCHARGE | | SMALL ONLY DISCHARGE | | SMALL SHIFT BY ROLLER AND DISCHARGE (ALSO POSSIBLE TO RE-SHIFT VIA PROCESSING TRAY AND DISCHARGE) | |
| PATTERN | WITHOUT PUNCH WITHOUT SHIFT | WITH PUNCH WITHOUT SHIFT | WITHOUT PUNCH WITH SHIFT | WITH PUNCH WITH SHIFT | WITHOUT PUNCH WITHOUT SHIFT | WITH PUNCH WITHOUT SHIFT | WITHOUT PUNCH WITH SHIFT | WITH PUNCH WITH SHIFT | WITHOUT PUNCH WITHOUT SHIFT (OMIT FLOW) | | WITHOUT PUNCH WITH SHIFT (OMIT FLOW) | | WITHOUT PUNCH WITH SHIFT | | WITHOUT PUNCH WITH SHIFT | |

APPARATUS FOR PROCESSING SHEETS

CROSS-REFERENCE TO RELATED APPLICATION

This is a divisional application of Ser. No. 15/830,753 filed on Dec. 4, 2017.

BACKGROUND OF THE INVENTION

1. Field of the Invention

The present invention relates to a sheet processing apparatus for performing processing to sort on sheets, and more specifically, to an apparatus which nips a sheet by a relay roller in transport process of the sheet, shifts after nipping, and sorts in a collection tray to collect.

2. Description of the Related Art

Conventionally, in image formation apparatuses such as a copier, laser beam printer, facsimile and complex machine thereof, there have been apparatuses provided with sheet processing apparatuses for performing sheet processing such as binding processing, punching processing and sorting processing on sheets with images formed.

In such an image formation apparatus, for example, in Japanese Patent Gazette No. 5608479 (substantially corresponding U.S. Pat. No. 8,794,616 B2) filed by the Present Applicant is indicated an apparatus where an apparatus for performing the above-mentioned binding or the like is disposed in space inside the body between above an image formation section and an image reading section so as to miniaturize the apparatus as a whole, and allocates sheets to discharge to collection trays positioned vertically to discharge.

Further, in a relatively large sheet processing apparatus, proposed is an apparatus for shifting a sheet discharged from an image formation apparatus, before carrying in a bind unit, to the front side (front side of the apparatus) and the rear side (rear side of the apparatus) in a direction crossing a transport direction every the designated number of sheets in the transport process, and sorting in collection trays, as in Japanese Patent Gazette No. 4785474 (substantially corresponding U.S. Pat. No. 8,118,303 B2). Further, this apparatus is also capable of allocating sheets to discharge to collection trays positioned vertically and discharging. Accordingly, particularly in the case of the high number of sheets to sort, sheets are essentially shifted during transport, sorted to any of the collection trays and discharged, the need of performing shift processing in a processing tray is eliminated, and there is the advantage that the processing time is reduced.

However, the apparatus of the above-mentioned Japanese Patent Gazette No. 5608479 is relatively small, and is capable of performing sheet sorting using an alignment plate for sorting a bunch of sheets on a processing tray where the sheets are temporarily placed to perform binding processing, but has limitations of support at high speed, and it has been desired to increase the speed of processing for sorting sheets with lengths relatively used frequently, for example, such as lengths of A4-size and letter size or less.

On the other hand, in the sorting apparatus shown in the above-mentioned Japanese Patent Gazette No. 4785474, it is possible to relatively increase the length of a transport path (carry-in path) of sheets extending to two collection trays, and a gate to allocate to two collection trays is also disposed in a position relatively far from a sheet carry-in entrance to the apparatus. Therefore, it is possible to allocate sheets to the front side (front side of the apparatus) and the rear side (rear side of the apparatus) crossing the sheet transport direction during transport at ease, but it is difficult to adopt into the apparatus like in Japanese Patent Gazette No. 5608479.

SUMMARY OF THE INVENTION

A sheet processing apparatus is arranged in a space between an image reading section for reading an image and an image formation section for forming an image on a sheet, wherein the image formation section is arranged under the image reading section and the space. The sheet processing apparatus allocates a sheet transported in a predetermined transport direction to collect in a first collection tray or a second collection tray.

The sheet processing apparatus comprises a carry-in path adapted to guide a sheet from a carry-in entrance; a relay roller provided in the carry-in path to relay and transport the sheet; a first transport path, positioned on a downstream side of the relay roller, including a carry-in roller to transport the sheet from the carry-in path to the first collection tray; and a second transport path, branched off from the carry-in path, including a branch roller to transport the transported sheet to the second collection tray, wherein the relay roller shifts the sheet in a direction crossing the transport direction, and a shift by the relay roller is performed for a period during which a front end of the sheet enters the first transport path or the second transport path, and arrives at the carry-in roller or the branch roller.

In the invention, in a position branched off from the carry-in path, an allocating member for allocating the sheet to one of the first transport path and the second transport path is disposed immediately after the relay roller, and the shift of the sheet by the relay roller is started, after the front end of the sheet passes through the allocating member.

In the invention, the relay roller includes a receiving position for receiving a sheet transported from the carry-in entrance, shifts the sheet to a shift position on a front side or a rear side in a crossing direction from the receiving position after receiving the sheet, and returns to the receiving position after the sheet subjected to the shift passes through the relay roller.

In the invention, the relay roller performs the shift of the sheet, in transporting the sheet shorter than a length from the carry-in entrance to the carry-in roller or the branch roller.

A sheet processing apparatus may comprises a carry-in path adapted to guide a sheet from a carry-in entrance; a relay roller provided in the carry-in path to relay and capable of shifting the sheet in a direction crossing the transport direction; a transport path positioned on a downstream side of the relay roller and transporting the sheet from the carry-in path in a direction downstream of the transport direction; a collection tray collecting a sheet transported in the transport direction; and an alignment section positioned on the collection tray and aligning the sheet in a sheet width direction orthogonal to the sheet transport direction. The sheet is shifted by the relay roller or the alignment section.

BRIEF DESCRIPTION OF THE DRAWINGS

FIG. 13A is an explanatory view of a state in which the shift is completed before a carry-in roller of a first transport path, and FIG. 13B is an explanatory view of a state in which the shift is completed before a branch roller of the second transport path;

FIG. 15A is a state view where carry-in of the sheet is started from the image formation section to the shift roller unit, and FIG. 15B is a state view where a shift of the sheet to the front side (front side of the apparatus) or the rear side (rear side of the apparatus) is completed by the shift roller unit;

FIG. 16A is a view to explain a state in which the shifted sheet is discharged from a shift roller unit roller, and FIG. 16B is an explanatory view of a state in which the carry-in roller is halted and punching processing is performed by the punch unit;

FIG. 20 is a table illustrating transport processing patterns as a view in the case where the sheet processing apparatus is provided with the punch unit and in the case where the apparatus is not provided with the punch unit with a transport guide (dummy punch unit) installed;

FIG. 28A is a collection state view of sheets sorted by the shift roller unit from discharge rollers, and FIG. 28B is a collection state view of sheets sorted by the alignment plate of the processing tray;

FIG. 29A is an explanatory view where the die hole is shifted and avoided to the front side of the apparatus, and FIG. 29B is an explanatory view where the die hole is shifted largely to the front side of the apparatus to sort;

FIG. 30A is an explanatory view where the die hole is shifted and avoided to the rear side of the apparatus, and FIG. 29B is an explanatory view where the die hole is shifted largely to the rear side of the apparatus to sort;

FIG. 31A is a view that the punch blade and die hole perform punching on the sheet in a center position, FIG. 31B is a view that the punch blade and die hole are shifted to the front side (front side of the apparatus) to perform punching on the sheet, and FIG. 31C is a view that the punch blade and die hole are shifted to the rear side (rear side of the apparatus) to perform punching on the sheet;

DESCRIPTION OF THE EMBODIMENTS

Referring to drawings, described below are a sheet processing apparatus B including each unit for shifting a sheet in a direction crossing a transport direction in a transport path, punching a punch hole in the sheet or the like, and an image formation apparatus A to attach the apparatus B according to the present invention.

Figure 1:
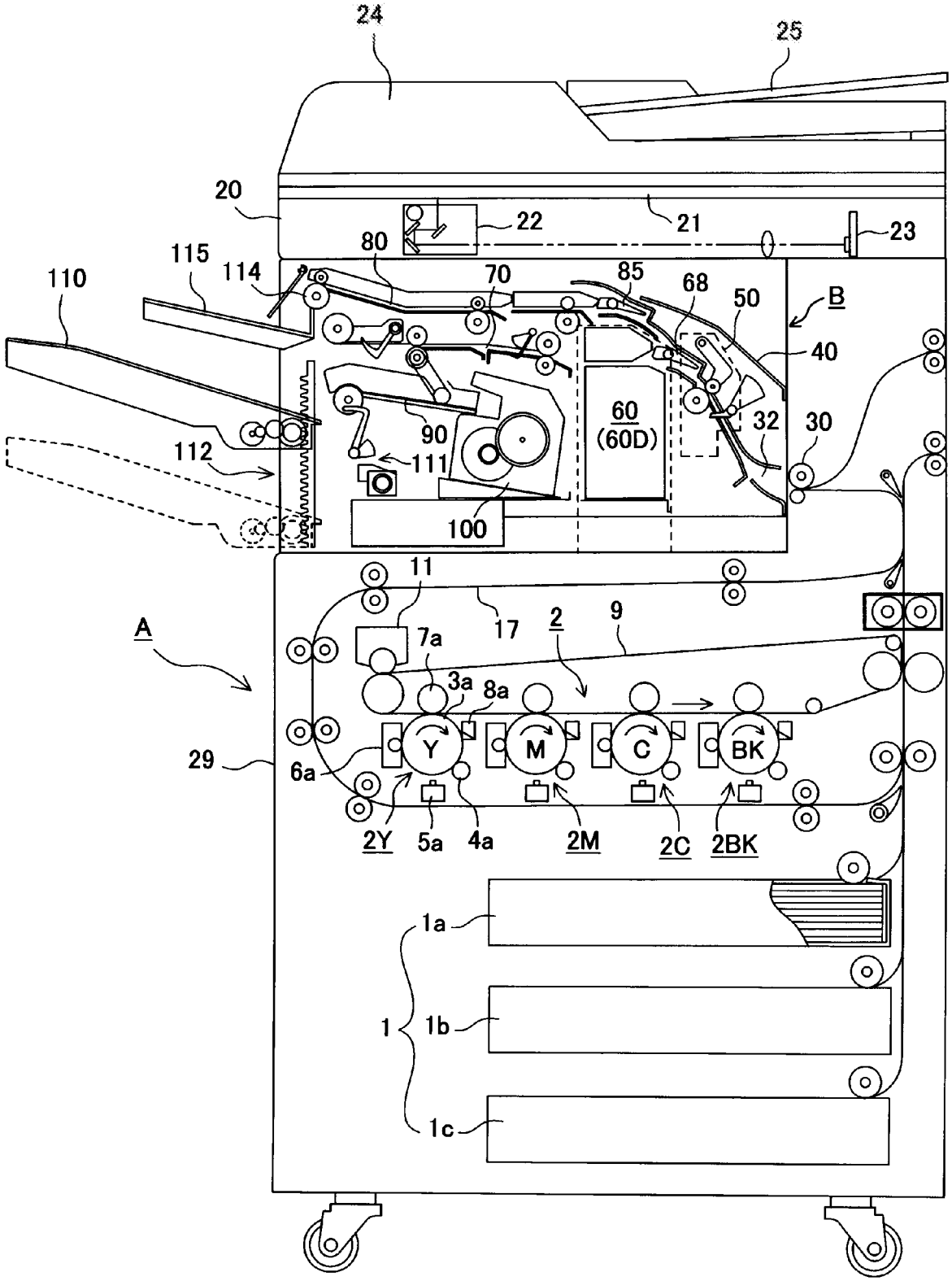
FIG. 1 is an explanatory view illustrating an entire configuration obtained by combining an image formation apparatus and sheet processing apparatus according to the present invention.
Figure 2:
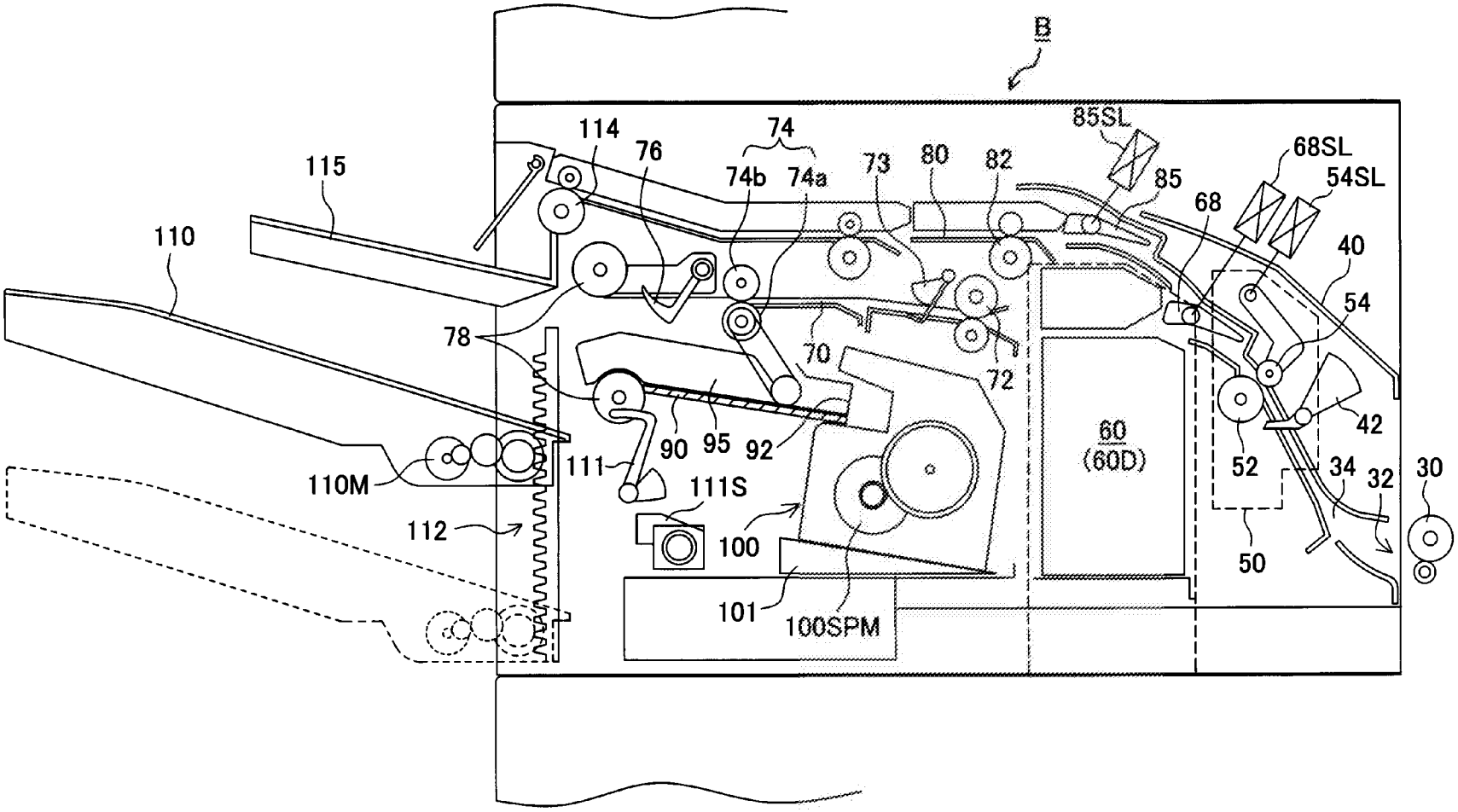
FIG. 2 is an entire explanatory view of the sheet processing apparatus according to the invention.

FIG. 1 is an explanatory view illustrating an entire configuration of the sheet processing apparatus B and image formation apparatus A according to the present invention. FIG. 2 is an explanatory view of the sheet processing apparatus B including each unit, such as a transport unit 40 having a shift roller unit 50, punch unit 60, bind unit 100, first collection tray 110 and second collection tray 115, which processes a sheet according to the invention.

[Image Formation Apparatus A]

The image formation apparatus A shown in FIG. 1 uses an electrophotographic scheme, where a paper feed section comprised of three-stage paper feed cassettes 1*a*, 1*b*, 1*c* to store sheets is disposed below an image formation section 2, and when the sheet processing apparatus B is not inserted, with space above the image formation section 2 being sheet discharge space, an image reading apparatus 20 is disposed above the space. Accordingly, when the sheet processing apparatus B is disposed, as shown in the figure, the apparatus is disposed on an apparatus frame 29 as the so-called in-body type using the sheet discharge space.

The image formation section 2 adopts a tandem scheme using an intermediate transfer belt. In other words, color components of four colors (yellow 2Y, magenta 2M, cyan 2C and black 2BK) are used, and for example, in yellow 2Y, the section 2 has a photoconductor drum 3*a* as an image support body, a charging apparatus 4*a* comprised of a charging roller that charges the photoconductor drum 3*a*, and an exposure apparatus 5*a* that makes an image signal read with the image reading apparatus 20 a latent image. Further, the section 2 is provided with a development apparatus 6*a* that forms the latent image formed on the photoconductor drum 3*a* as a toner image, and a first transfer roller 7*a* that first-transfers the image on the photoconductor drum 3*a* formed by the development apparatus 6*a* to an intermediate transfer belt 9. This configuration is first-transferred to the intermediate transfer belt for each color component. The color component left on the photoconductor drum 3*a* is collected by a photoconductor cleaner 8*a* to prepare for next image formation. These schemes are the same as in the other color components (magenta 2M, cyan 2C and black 2BK) as shown in FIG. 1.

In addition, the image of the intermediate transfer belt 9 is transferred to a sheet fed from the paper feed section 1 by a second-transfer roller 10, and the image is fused to the sheet by pressurized force and heat by a fusing apparatus 12. The remaining superimposed color components on the intermediate transfer belt 9 are removed by an intermediate belt cleaner 11 to prepare for next transfer.

Thus image-formed sheet is fed to a main-body discharge roller 30 by a relay roller of the main body. When image formation is performed on both sides of a sheet, the sheet once transported to the sheet processing apparatus B side with a switch gate is switched back, transported to a circulation path 17, and is fed to the image formation section 2 again to form an image on the backside of the sheet.

The sheet with the image thus formed on one side or both sides is transported to the transport unit 40 of the sheet processing apparatus B through the main-body discharge roller 30.

In addition, the image reading apparatus 20 is disposed above the sheet discharge space above the image formation section 2. Herein, an original document placed on an original document stacker 25 is fed to platen 21 with an original document feeding apparatus 24, the fed original document is sequentially read with a photoelectric converter 23 (for example, CCD) by irradiating using a scan unit 22, and the image is stored in a data storage section not shown. The stored image is formed on the sheet in the image formation section as described above.

[Sheet Processing Apparatus B]

Described next is the sheet processing apparatus B of FIGS. 1 and 2 disposed in the sheet discharge space below the image reading apparatus 20, above the image formation section 2. In the sheet processing apparatus B are disposed the transport unit 40 provided with the shift roller unit 50 that receives a sheet, which is discharged from the main-body discharge roller 30, from a carry-in entrance 32, the punch unit 60 that punches punch holes in the sheet, and on the downstream side thereof, the bind unit 100 that places sheets temporarily on a processing tray 90 to perform binding processing when necessary.

The sheet processing apparatus B is further provided with a first transport path 70 that guides to the processing tray 90 side from a carry-in path 34 for guiding a sheet from the carry-in entrance 32, downstream of the shift roller unit 50, and a second transport path branched off downstream of the shift roller unit 50. Downstream of the first transport path 70 is provided the first collection tray 110 that stores a sheet which is discharged from the processing tray 90 or directly discharged from the first transport path 70, and above the tray, the second collection tray 115 that stores a sheet fed from the second transport path is disposed to overlap, when necessary.

As shown in FIG. 2, the first collection tray 110 is provided with a paper surface sensor 111S for detecting a paper surface by a collection tray sensor arm 111 contacting the top surface of stored sheets. An up-and-down motor 110M is driven using a paper surface level of the paper surface sensor 111S so as to set a storage position always within a certain range.

In addition, the punch unit 60 constituting the sheet processing apparatus B is disposed to punch punch holes near an edge portion (front/rear end edge of the sheet) of the sheet. In the case where punching in a sheet is not required particularly, also when the punch unit 60 is replaced with a transport guide unit (60D) that simply guides the sheet, the sheet processing apparatus B functions. The outer shape of the transport guide unit (60D) is the same shape as the punch unit 60, and is the so-called dummy punch unit as a guide for guiding a sheet from the carry-in path 34 to the first transport path 70. Patterns of use of the punch unit 60 for performing punching processing and the transport guide unit (60D) will be described later.

Described below are the transport unit 40, punch unit 60, drive near the processing tray 90, alignment mechanism on the processing tray 90, and bind unit 100 for binding sheets constituting the sheet processing apparatus B. In addition, the transport unit 40 and punch unit 60 more related to the present invention will be described later in detail, including operation states thereof.

[Transport Unit 40]

Figure 3:
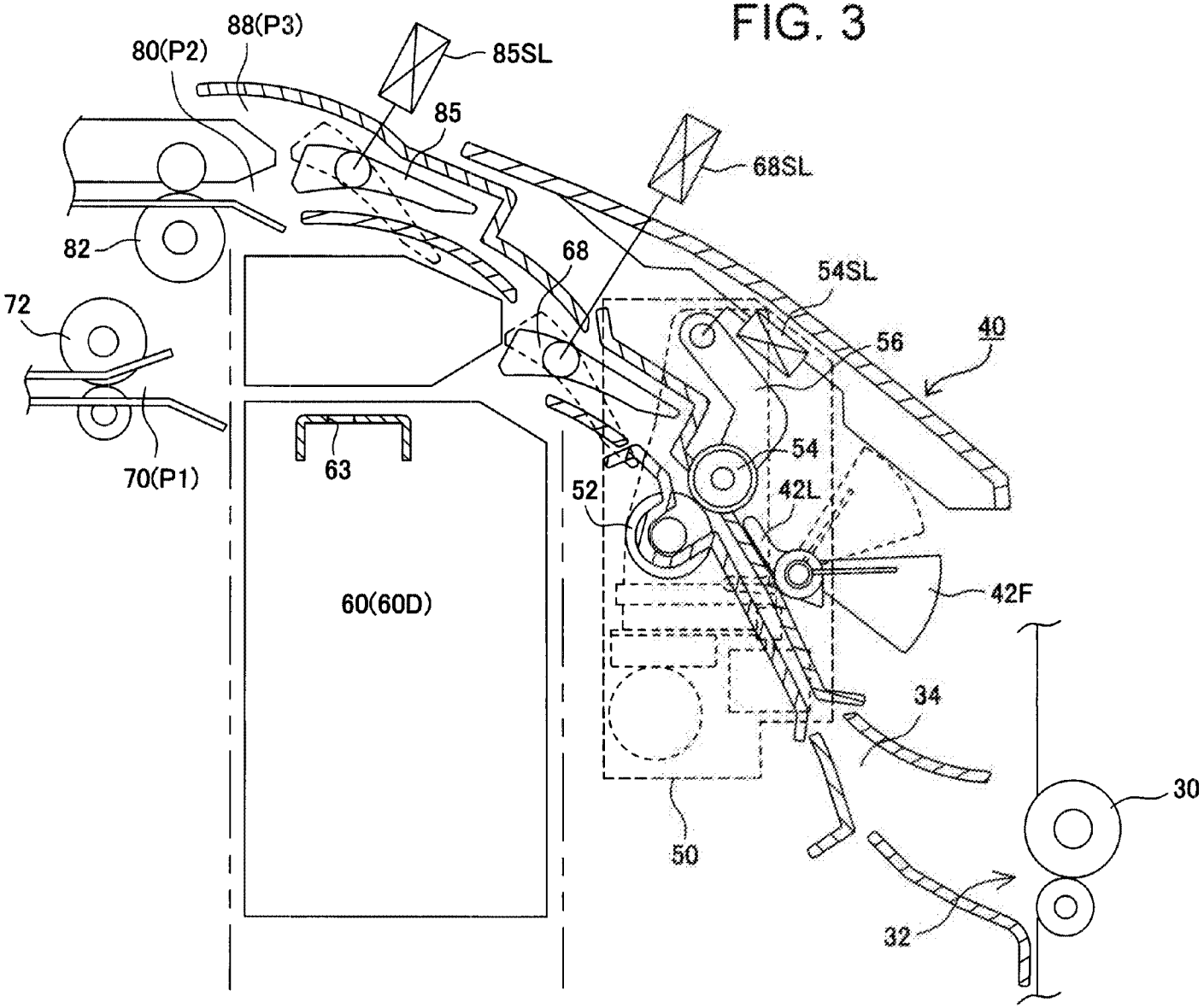
FIG. 3 is an explanatory view of a transport unit including a shift roller (relay roller) unit.

As shown in FIG. 3, the transport unit 40 of the sheet processing apparatus B is provided to support the main-body discharge roller 30 provided in a main-body discharge outlet. An entrance of the transport unit 40 supports the main-body discharge roller 30 as the carry-in entrance 32. The transport unit 40 is provided with the shift roller unit 50 provided with a shift roller (relay roller) 52 which relays and transports the sheet to the downstream side, while shifting the sheet to the front side and rear side in the direction crossing the transport direction in the process of transport.

The sheet carried in from the carry-in entrance 32 is detected by the carry-in sensor 42, and in this Embodiment, by detection with the carry-in sensor 42, transport rotation of the shift roller 52 of the shift roller unit 50 is started.

Immediately after downstream of the shift roller 52 is positioned a first flapper 68 for guiding the sheet to the first transport path 70 or switching to the second transport path 80. The first flapper 68 is coupled to a first flapper solenoid 68SL to be usually in the position (solid line position in FIG. 3) for guiding the sheet to the first transport path 70, and when necessary, shift to be positioned (dashed line position in FIG. 3) in the second transport path 80. The position of the first flapper 68 is a branch position of the first transport path 70 and the second transport path 80.

Further, in the second transport path 80, a third transport path 88 is a switchback open path to enable the sheet, which is switched back by the main-body discharge roller 30 to form images on both sides of the sheet, to be transported to above the second transport path 80. Also in the branch position of the second transport path 80 and the third transport path 88, a second flapper 85 for selectively guiding the sheet is coupled to a second flapper solenoid 85SL.

The punch unit 60 is provided on the downstream side of the first flapper 68 of the first transport path 70. The punch unit 60 will be described later, and is provided with die holes 63 to punch in the sheet in positions corresponding to punch holes. As described previously, when only the transport guide is required, there is the case where the punch unit 60 is replaced with the transport guide unit (60D) that is the dummy punch. In addition, in the explanation of this Embodiment, there is the case where the first transport path 70 is described as P1, the second transport path 80 is described as P2, and the third transport path is described as P3.

[Sheet Transport Drive Near the Processing Tray 90]

Figure 4:
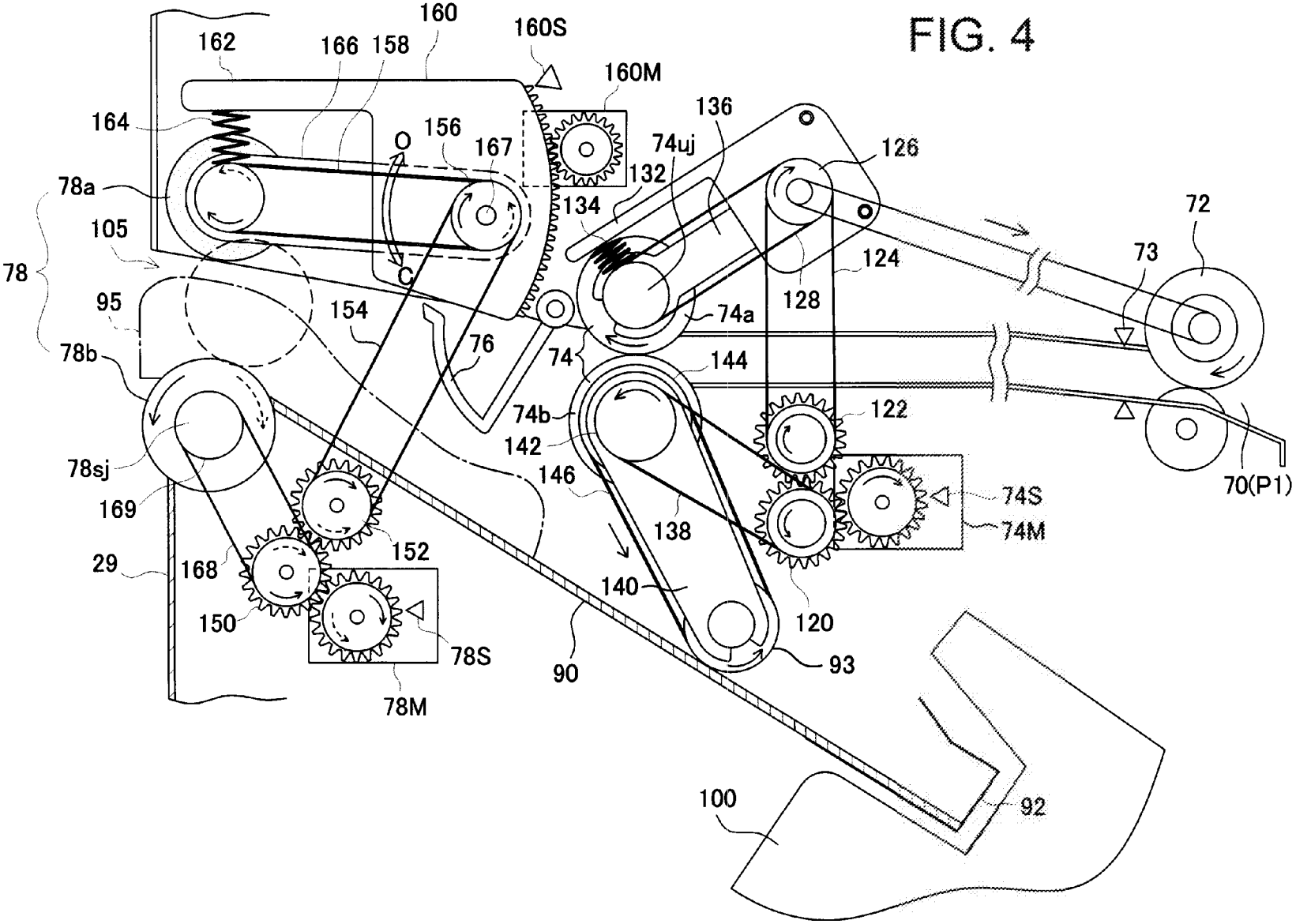
FIG. 4 is a drive explanatory view on the periphery of a processing tray (placement tray) of the sheet processing apparatus.

Herein, sheet transport drive near the processing tray 90 will be described with reference to FIG. 4. The first transport path 70 (P1) is provided with a carry-in roller 72 that carries a sheet in, a carrying-out roller 74 that carries the sheet out to the processing tray 90 or the first collection tray 110 from the first transport path 70, and discharge rollers 78 that discharge the sheet on the processing tray 90 or the sheet of the carrying-out roller 74 to the first collection tray 110 from a discharge outlet 105. The discharge roller 78 is comprised of a discharge upper roller 78*a* that swings with respect to a discharge lower roller 78*b*. Further, the discharge roller 78 is capable of rotating forward and backward, and is configured to feed the sheet to the first collection tray 110 side by forward rotation (solid line direction in FIG. 4) and feed the sheet to a reference surface 92 side of the processing tray 90 by backward rotation (dashed line direction in FIG. 4).

Above the processing tray 90, a carrying-out guide 76 for guiding the sheet to below is provided swingably, the sheet is fed to the reference surface 92 side by the discharge roller 78 rotating backward concurrently therewith, the fed sheet is fed to the reference surface 92 by rotation of a take-in roller 93, and the front end is aligned. By repeating this manner, sheets are placed on the processing tray 90 as a bunch.

[Rotation Drive of the Carrying-Out Roller]

First, drive of the carrying-out roller 74 comprised of a carrying-out upper roller 74*a* and carrying-out lower roller 74*b* is performed by a carrying-out roller motor 74M. The carrying-out roller motor 74M is comprised of a hybrid type stepping motor, and a velocity detection sensor 74S is disposed which detects rotation velocity of the motor shaft. The drive of the carrying-out roller motor 74M is transferred to an arm gear 126 via transfer gears 120, 122 and transfer belt 124. The drive from the arm gear 126 is transferred to an upper roller shaft 74*uj* of the carrying-out upper roller 74*a* supported by a transport roller support arm 136 with a transfer belt 128. In the carrying-out upper roller 74*a*, in order for the carrying-out upper roller 74*a* to always come into press-contact with the carrying-out lower roller 74*b* to drive, the roller 74*a* is provided with a spring 134 in the support arm 136.

Rotation drive of the carrying-out lower roller 74*b* is performed by transferring the drive of the carrying-out roller motor 74M to a receive gear 142 individually installed in a transport lower roller shaft 44*sj* via the transfer gear 120 and transfer belt 138.

Further, the drive from the receive gear 142 rotates the take-in roller 93 by a gear 144 with a one-way clutch, and a belt 146 with protrusions that also serves as a transfer belt. Since the drive is transferred to the take-in roller 93 via the gear 144 with the one-way clutch, as described previously, the roller 93 rotates only in the solid-line arrow direction of FIG. 4 even when the receive gear 142 rotates forward and backward, and rotates to shift the sheet only in the direction of the reference surface 92 of the processing tray 90.

In addition, the belt 146 with protrusions is to rotate the take-in roller 93 at the front end, and only a circular take-in belt may be rotated with the take-in roller 93 omitted. In addition, the drive of the carrying-out roller motor 74M also drives the carry-in roller 72 that carries the sheet in the first transport path 70, via the transfer gear 120 and transfer belt 148.

[Rotation Drive of the Discharge Roller]

Next, drive of the discharge roller 78 comprised of the discharge upper roller 78*a* and the discharge lower roller 78*b* is performed by a discharge roller motor 78M. The discharge roller motor 78M is also comprised of a hybrid type stepping motor, and a velocity detection sensor 78S is similarly disposed which detects rotation velocity of the motor shaft. The drive of the discharge roller motor 78M is transferred to an arm gear 156 via transfer gears 150, 152 and transfer belt 154. The drive from the arm gear 156 is transferred to a discharge upper roller shaft 48*uj* of the discharge upper roller 78*a* supported by a discharge roller support arm 166 with a transport belt 158.

The discharge upper roller 78*a* is attached to rotate about the shaft of the arm gear 156 so as to contact and separate from the fixed discharge lower roller 78*b*. The contact/separation is performed by a discharge roller shift arm 160 which is attached to the shaft of the arm gear 156 and has a rear sector gear, where a spring 164 that biases the discharge upper roller 78*a* is attached to a shift arm point on the front end side. By driving the discharge roller shift arm motor 160M engaged in the rear sector gear to rotate forward and backward, the arm shifts in an open direction of the arrow O by one-direction rotation, while shifting in a press-contact direction of the arrow C to come into press-contact with the discharge lower roller 78*b* of the arrow C by the other rotation.

In addition, the discharge roller shift arm motor 160M is also comprised of a stepping motor, and a discharge roller shift arm sensor 160S detects a position of the discharge roller shift arm 160. Further, rotation drive of the discharge lower roller 78*b* is performed by transferring the drive of the discharge roller motor 78M to a receive gear 169 individually installed in a discharge lower roller shaft 78*sj* via the transfer gear 150 and transfer belt 168.

[Alignment Plate for Alignment and Position Shift]

Figure 5:
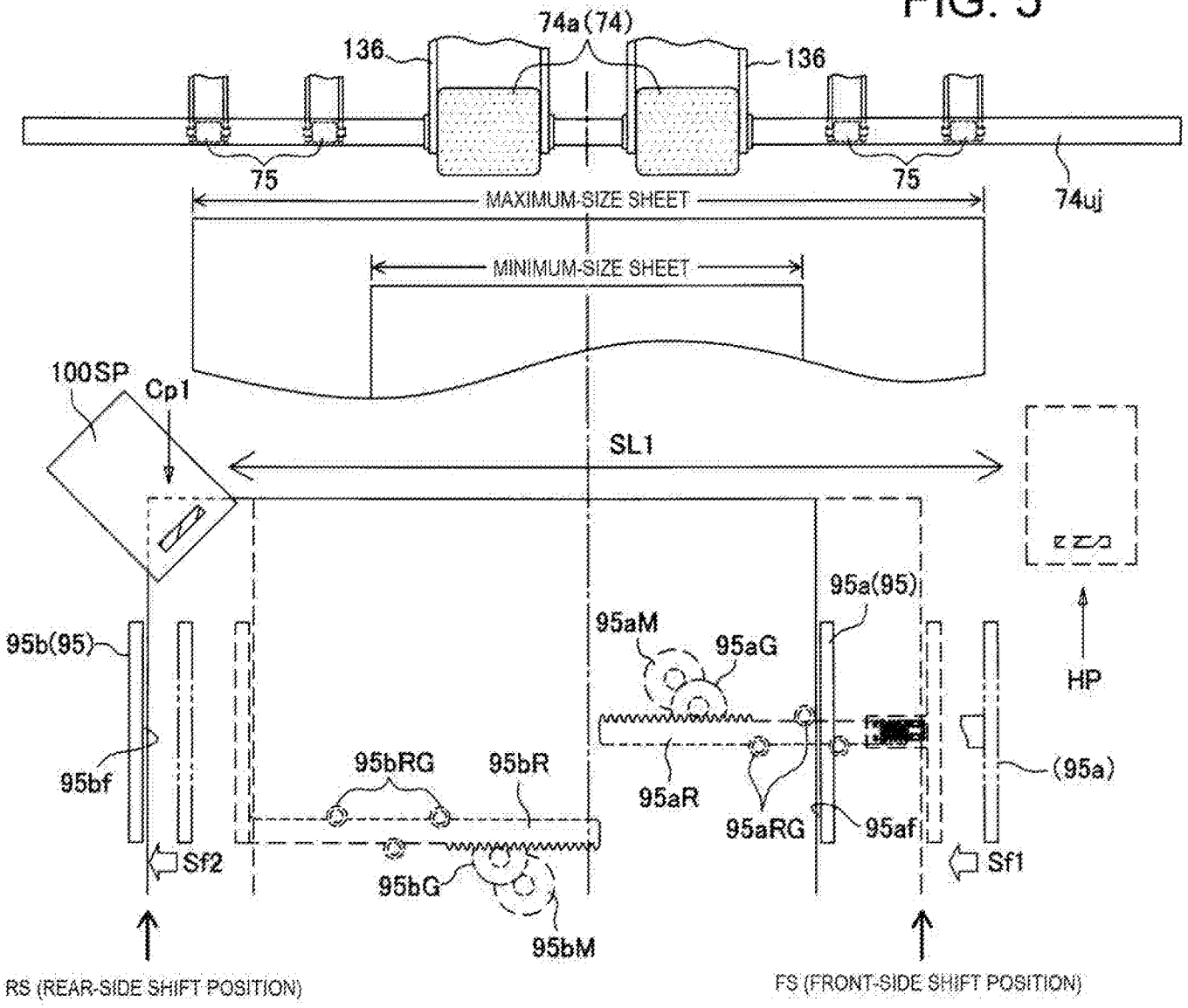
FIG. 5 is an explanatory view of a shift configuration of an alignment member (alignment plate) provided in the processing tray of FIG. 4 to shift in a sheet width direction.

Referring to FIG. 5, described next is an alignment configuration for coming into contact with sheet side edges whenever a sheet is carried in the processing tray 90, aligning the sheet and changing a placement position of the sheet. FIG. 5 is a view obtained by looking at the processing tray 90 from above, and the alignment plate 95 is comprised of a front alignment plate 95*a* on the front side, and a rear alignment plate 95*b* on the rear side. The plates respectively have a front alignment surface 95*af* and rear alignment surface 95*bf* to contact and separate from side edges of the sheet. The contact/separation with/from the sheet side edge is performed by shifting a front alignment plate rack 95*a*R, which is provided on the bottom of the front alignment plate 95*a* and is guided by a front rack guide 95*a*RG, by a front-side alignment motor 95*a*M via a gear 95*a*G. Similarly, a rear alignment plate rack 95*b*R that is provided on the bottom of the rear alignment plate 95*b* and that is guided by a rear rack guide 95*b*RG is shifted by a rear alignment motor 95*b*M via a gear 95*b*G.

The front alignment plate 95*a* and rear alignment plate 95*b* align in the sheet center as a reference in performing multi-binding, or align as a side reference shown in FIG. 5 in corner binding, and thus are capable of changing a reference of alignment according to a binding manner or the like. Further, as one of sheet processing sections, it is also possible to perform the so-called jog processing for pulling a bunch of sheets placed on the processing tray 90 to one side and discharging the bunch to the first collection tray to thereby sort the bunch of sheets. In addition, carrying-out rollers 75 for providing the sheet to carry out with toughness are biased by plate springs between the carrying-out roller 74 that carries the sheet in the processing tray 90 and space.

[Bind Unit and Shift Thereof]

Next, binding processing of the bind unit 100 of this Embodiment is already publicly known, and detailed descriptions are omitted. When a stapler 100SP of the bind unit 100 halts in a bind position, a stapler SP motor 100SPM is driven to rotate, shifts a driver not shown to drive a staple in a bunch of sheets, bends the driven staple by an anvil, and performs staple binding processing. The binding processing is performed in an end face of the corner of the sheet or a plurality of positions in the end face in the width direction. This respect will be described in FIG. 6.

Figure 6:
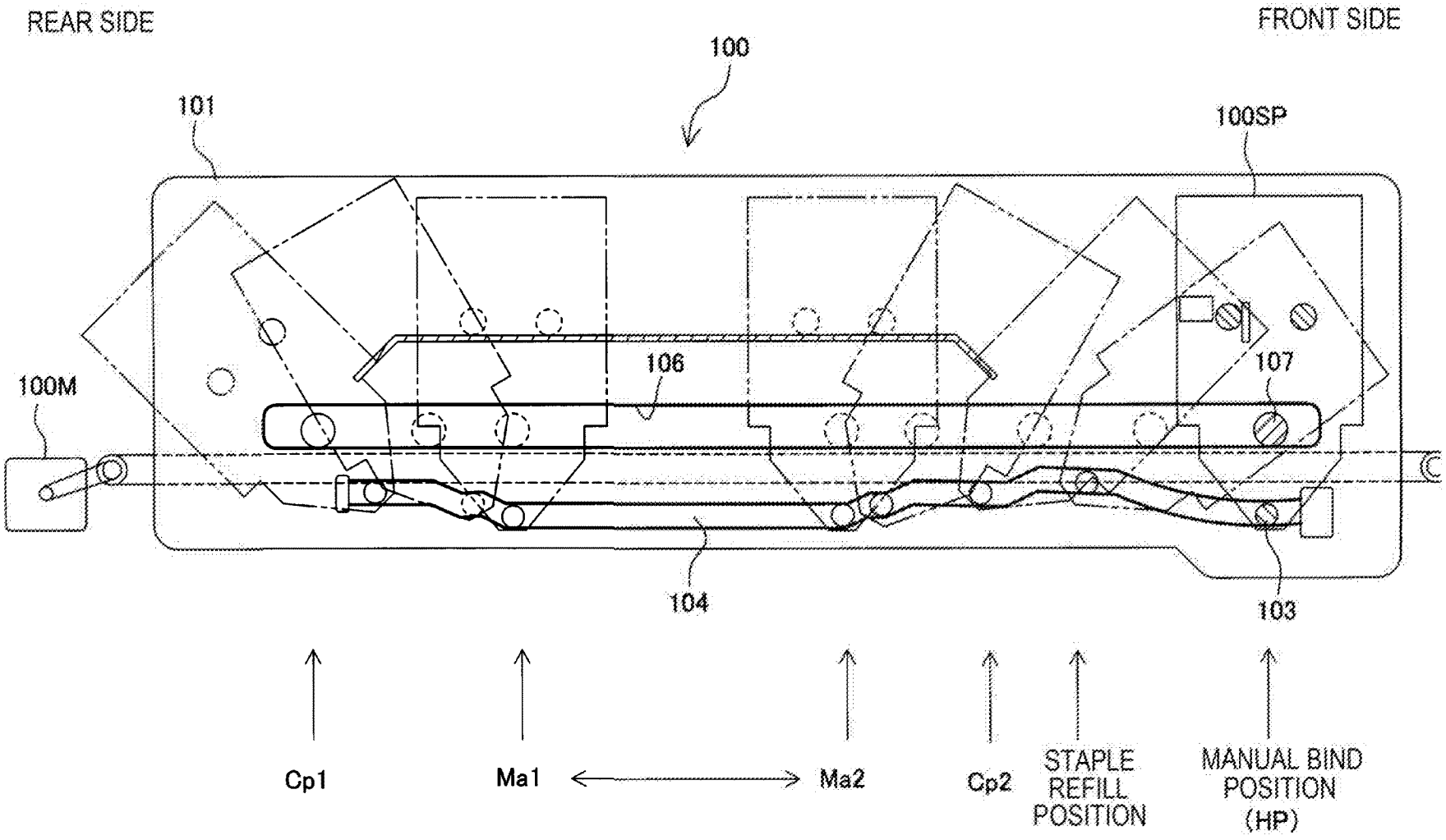
FIG. 6 is a shift position explanatory view of a bind unit positioned in an end portion of the processing tray of FIG. 4.

FIG. 6 illustrates that the stapler 100SP for performing staple binding on a bunch of sheets shifts onto a shift bench 101. In the shift bench 101, in the apparatus frame of the sheet processing apparatus B, as viewed in the figure, the upper portion is the front side, and the lower portion is the rear side. Referring to FIG. 2 also, in the shift bench 101, a shift groove 106 for guiding a groove pin 107 that protrudes from the stapler 100SP side is provided substantially linearly. A guide pin 103 on the front end side of the stapler 100SP is engaged in a posture guide 104 provided in the shift bench 101.

The stapler 100SP is coupled to a shift belt that shifts by a stapler shift motor 100M. By this means, according to the shift position, the stapler 100SP is positioned in a corner bind position Cp1 on the rear side, in a multi-bind range of Ma1 to Ma2 in a range closer to the center side than Cp1, and in a corner bind position Cp2 on the front side. Further, on the front side, the stapler is controlled to be positioned in a staple refill position with the rear of the stapler 100SP faced outside the apparatus, and in a home position HP before starting binding, which is also a manual bind position, on the front side more than the refill position.

Accordingly, as one of sheet processing sections, the apparatus in this Embodiment has the bind unit 100 where the stapler 100SP performs binding processing in an arbitrary position of a bunch of sheets placed on the processing tray 90. In addition, in the processing tray 90 are disposed alignment plates 95 as a pair in the sheet width direction to perform sheet alignment whenever a sheet is carried in. In addition, it is indisputable that the bind unit 100 includes not only the stapler SP 100SPM for binding with staples, but also binding with an adhesive and press binding for pressing sheets to bind.

Hereinafter, the transport unit 40 including the shift roller (relay roller) unit 50 particularly according to the present invention will be described with reference to FIGS. 7 to 9. Subsequently thereto, the punch unit 60 (dummy punch (transport guide) 60D) will be described.

[Shift Roller Unit 50]

Figure 7:
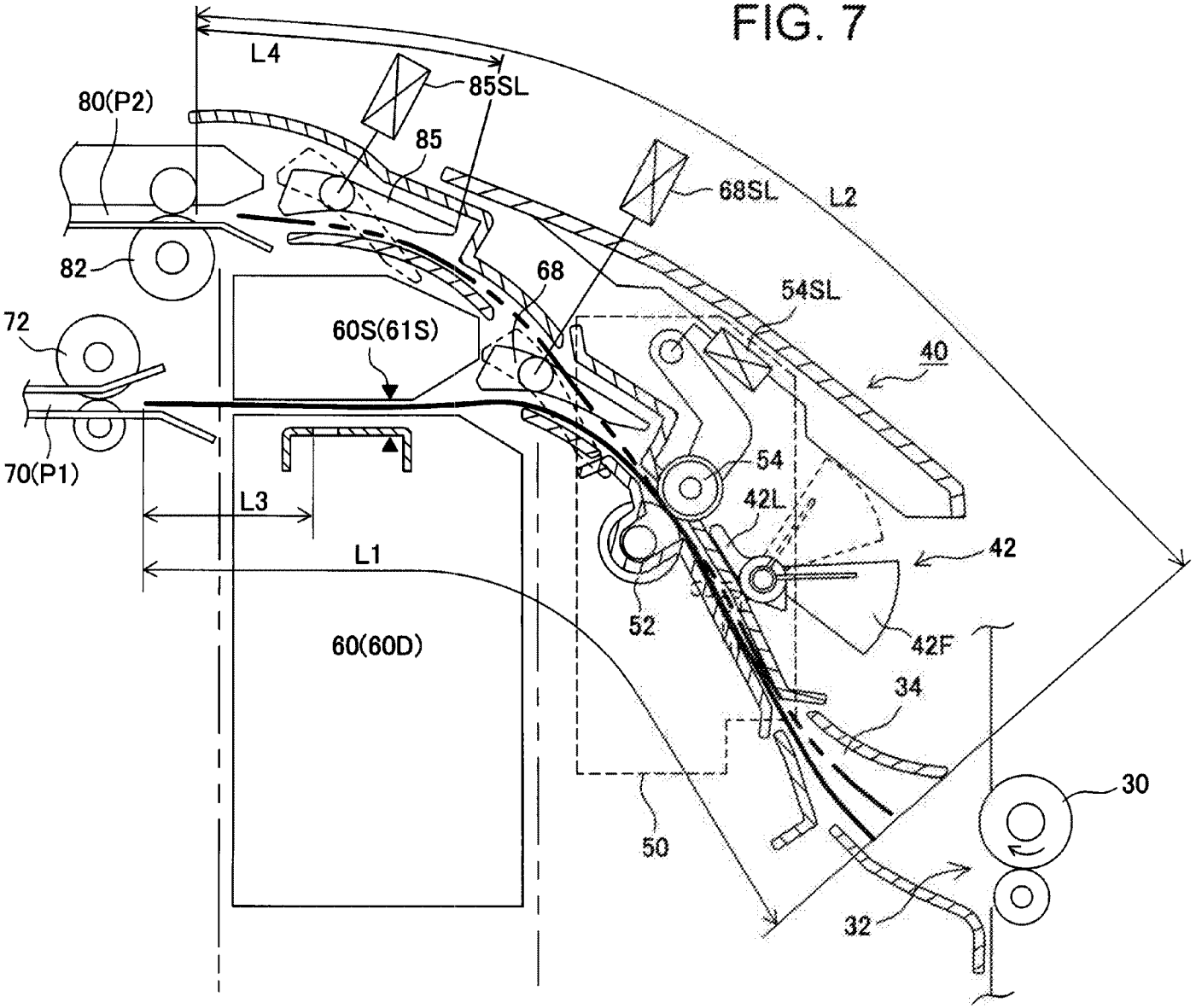
FIG. 7 is an explanatory view of a relationship between the shift roller (relay roller) unit and a sheet length.

First, FIG. 7 illustrates a state where a sheet discharged from the main-body discharge roller 30 is nipped with the shift roller 52, and is transported to the first transport path 70 to complete a shift of the sheet (solid line L1 in FIG. 7), and a state where the sheet is transported to the second transport path 80 to complete a shift of the sheet (dashed lines L2 in FIG. 7). A length from the carry-in entrance 32 to the carry-in roller 72 of the first transport path 70 enables a part of the transported sheet to be nipped only with the shift roller 52 and shift in a direction crossing the transport direction.

Specifically, since the length from the carry-in entrance 32 to the carry-in roller 72 is set at 235 mm, herein, the sheet capable of being shifted is sheets with a length in the transport direction of 216 mm or less, and for example, it is possible to shift sheets of A4 horizontal format, letter horizontal format, and B5 horizontal format. In addition, in the present invention, sheets capable of being shifted by the transport unit 40 by nipping only by the shift roller 52 are described as small sheets (simply, "small"), and sheets capable of not being shifted are described as large sheets (simply, "large").

Further, a length from the carry-in entrance 32 to a branch roller 82 of the second transport path 80 is the same length, and limits sheet lengths to shift in the direction crossing the sheet transport direction. This is because it is considered configuring the sheet processing apparatus B to be compact as small as possible, and matching with the in-body type image formation apparatus described initially.

Shift operation by the shift roller on the sheet entering the first transport path 70 or the second transport path 80 is performed after the sheet passes through the first flapper 68 positioned immediately after the shift roller 52, and in the apparatus of this Embodiment, a position to start the shift is further delayed. First, in the first transport path 70, the shift is started at the time the front end of the sheet transported by the shift roller 52 passes through the die hole 63 of the punch unit 60 described later, and is completed until the sheet arrives at the carry-in roller 72. In other words, it is configured to perform the shift inside L3 shown in the figure.

This is because of reducing that a corner of the sheet transported to the die hole 63 described later is caught by curling or the like, particularly in the case where the punch unit 60 is installed. Further, also in the case of the dummy punch (transport guide) 60D without the punch unit 60 being installed, by limiting the position to shift, additional resistance in shifting a sheet and the like are made certain, and a skew and the like are reduced. Accordingly, shift completion of a sheet with each length enabling the shift is substantially immediately before the carry-in roller 72.

Further, also in the second transport path 80, the shift by the shift roller 52 is performed, after the sheet front end passes through a front end position of the second flapper 85. This is also because of making additional resistance by the sheet substantially certain, and it is configured that the start and completion of the sheet is performed in a range of L4 shown in the figure. In other words, in the apparatus of this Embodiment, after the sheet passes through at least the first flapper 68 and is carried in the first transport path 70 or the second transport path 80, the shift by the shift roller 52 is started.

[Shift Drive Configuration of the Shift Roller Unit 50]

Figure 8:
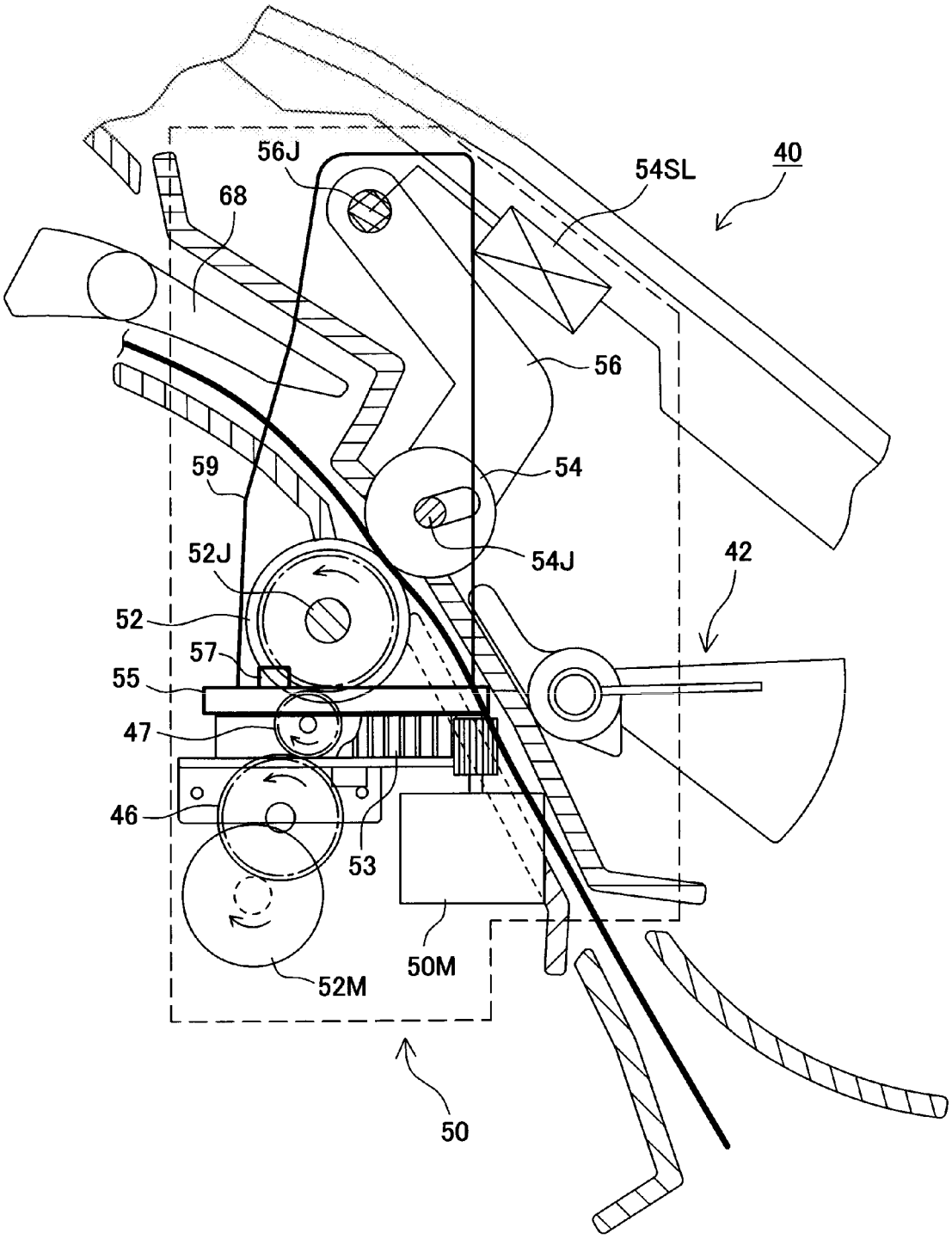
FIG. 8 is a side cross-sectional view to explain drive of the shift roller (relay roller) unit.
Figure 9:
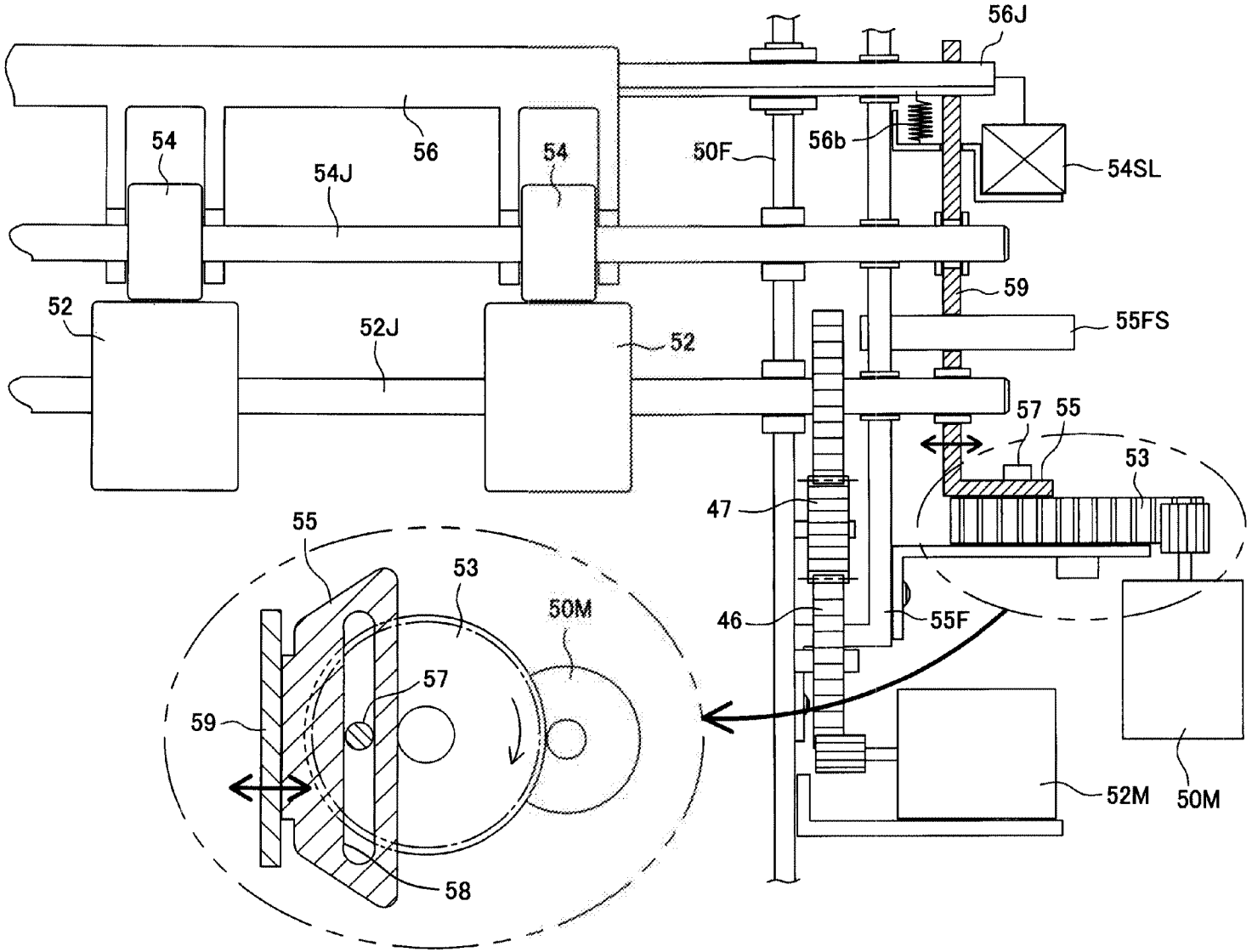
FIG. 9 is a front explanatory view to explain drive of the shift roller (relay roller) unit.

Referring to FIGS. 8 and 9, described next is a drive configuration of the shift roller (relay roller) unit. The shift roller unit 50 including the shift roller 52 is partitioned by dashed lines in FIG. 8. It is possible to attach and detach this partitioned range as a unit by pulling from the transport unit 40. FIG. 8 illustrates a state in which the shift roller 52 rotates as the relay roller for relaying transport of a sheet. Subsequently, when the sheet front end is transported to the range of L3 described previously, the shift roller 52 and shift driven roller 54 are shifted in the direction crossing the sheet transport direction. As shown in FIG. 9, this shift is performed by shifting the shift roller 52, the shift driven roller 54 and a shift lever 56 for bringing and separating the shift driven roller 54 into contact with/from the shift roller 52 from side to side as viewed in the figure, by a shift cam 55 attached to a cam attachment plate 55F in a unit frame 50F. Since a cam engagement portion 59 of the shift cam 55 fixes a shift roller shaft 52J, shift driven roller shaft 54J and shift lever shaft 56J, the shift is performed by a side-to-side shift of the shift cam 55. In addition, in the present invention, there is the case of describing the shift roller 52 and shift driven roller 54, which nip a sheet to relay and transport, and shift in the direction crossing the transport direction, simply as the shift roller 52.

This shift cam 55 has a cam slit 58, and in the cam slit 58 is engaged a cam shift pin 57 provided in a shift gear 53 that rotates by a shift motor 50M. Accordingly, by rotating the shift gear 53 by the shift motor 50M, the shift pin 57 shifts in the arrow direction from side to side shown in the figure, via the cam slit 58. In addition, not shown in the figure particularly, by detecting a position of the shift cam 55 or the shift gear 53, it is configured to detect a center position before the shift, the shift position on the front side, and the shift position on the rear side of the shift roller 52 and the like. In addition, the cam engagement portion 59 is also supported slidably by an attachment plate shaft 55FS fixed to the cam attachment plate 55F.

In addition, in switchback transport of a sheet by rotating the main-body discharge roller 30 forward and backward, the shift driven roller 54 is configured to shift to a position separate from the shift roller 52. In other words, the shift driven roller 54 is supported by the shift lever 56, and it is possible to separate the shift lever shaft 56J that is the shaft of the shift lever 56 by a driven roller solenoid 54SL. The roller is usually brought into press-contact with the shift roller 52 by a spring 56*b* so as to obtain a relatively strong nip force in relay transport or shift.

In addition, for rotation drive of the shift roller 52 as the relay roller that transports a sheet, drive of a shift transport motor 52M attached to the unit frame 50F is transferred via gear portions 46, 47. As shown in FIG. 8, the start or halt of the drive is performed using the carry-in sensor 42 provided in an entrance of the shift roller 52 of the carry-in path 34. Accordingly, when the carry-in sensor 42 detects carry-in of a sheet, the drive of the shift transport motor 52M is started, and is halted after a lapse of predetermined time since the sheet passes. As a matter of course, a signal to control the shift transport motor 52M may be obtained from the image formation apparatus A as the main body.

[Configuration of the Punch Unit]

Figure 10:
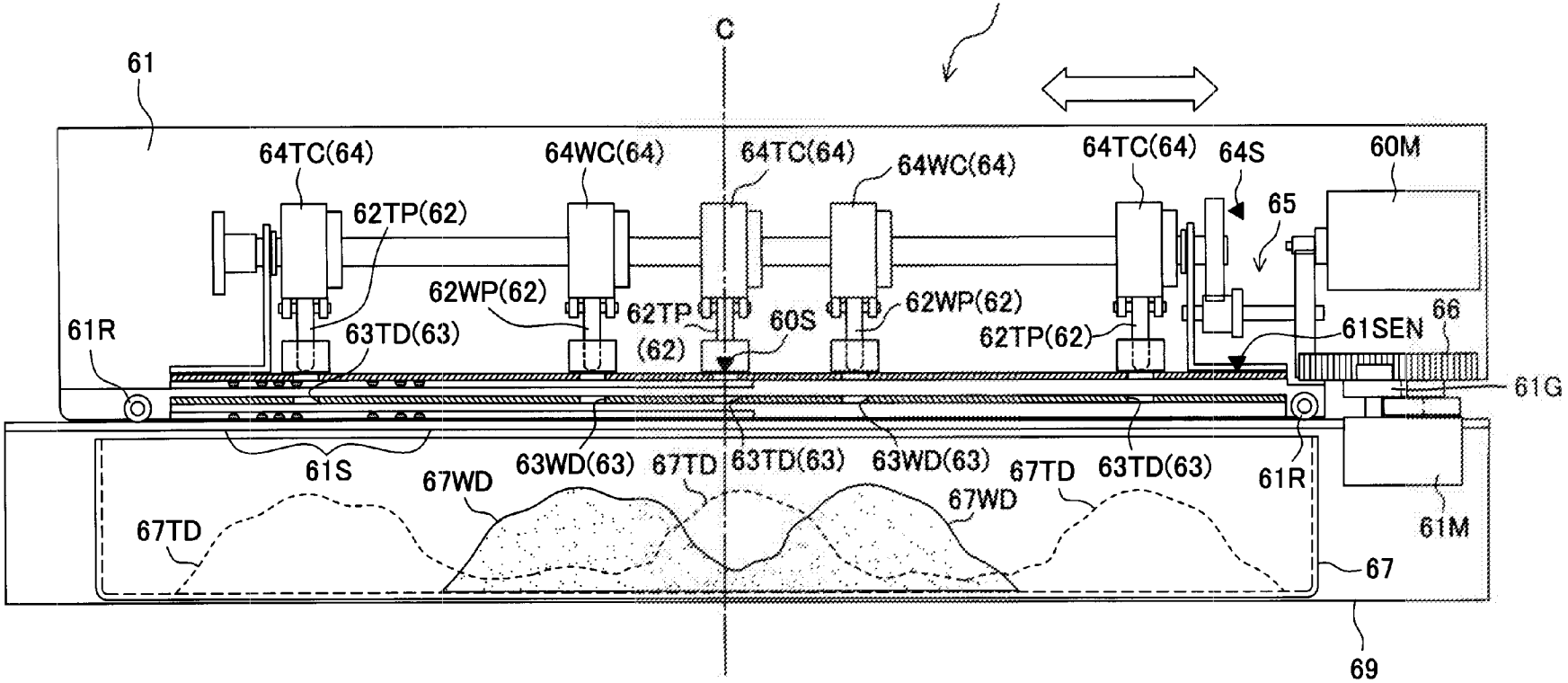
FIG. 10 is a punch unit explanatory view including a dust box as an end portion processing unit of sheets.

Hereinafter, the punch unit 60 that is another component will be described, using the front view of FIG. 10 and the cross-sectional view of FIG. 11. The punch unit 60 is comprised of a punch shift unit 61 provided with punch blades 62 and die holes 63, and a fix portion 69 provided with a dust box 67 and the like. The punch blade 62 is configured to reciprocating-shift by rotation of a punch cam 64 with respect to the die hole 63. The punch cam 64 is provided with two-hole cams 64WC to punch two punch holes on the opposite sides with the center of the sheet therebetween, and three-hole cams 64TC to punch a hole in the center of the sheet and punch on the opposite sides.

In the punch shift unit 61, in order to shift in the direction crossing the sheet transport direction, rotation of a shift motor 61M provided in the fix portion 69 including the dust box 67 engages in a shift rack 66 fixed to the punch shift unit 61 via a shift gear 61G. Accordingly, according to drive of forward/backward rotation of the shift motor 61M, the punch shift unit 61 shifts in the right-and-left direction of the arrow shown in the figure. In order to perform this shift smoothly, shift rollers 61R are provided between the punch shift unit 61 and the fix portion 69. For punch holes, as described above, two-hole punch blades 62WP are provided in two portions, three-hole punch blades 62TP are provided in three portions, and two-hole die holes 63WD and three-hole die holes 63TD correspond thereto respectively.

Figure 11:
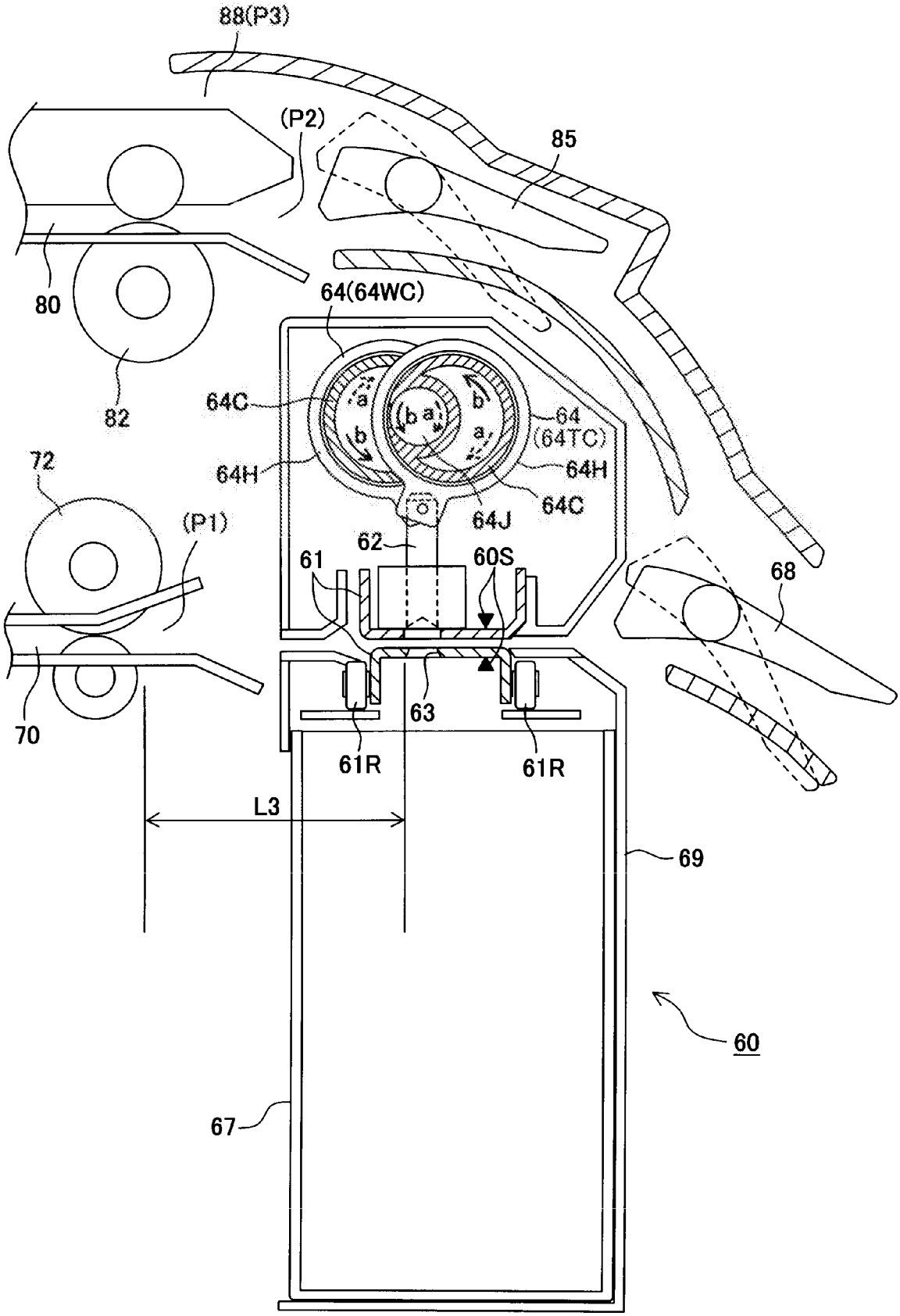
FIG. 11 is a punching drive explanatory view of a punch unit including the dust box.

As can be seen from FIG. 11, the two-hole cam 64WC and three-hole cam 64TC are provided to differ in phase. The punch cam 64 is driven by a punch motor 60M via a punch gear 65. By switching between rotation in the arrow a direction and b rotation direction of the punch motor 60M, an eccentric cam 64C rotated by a cam drive shaft 64J is rotated, and a cam holder 64H that is provided outside the cam 64C and that is coupled to the punch blade 62 is shifted. At this point, since the phases of the cams are different, it is possible to switch between the two-hole punch blade 62WP and the three-hole punch blade 62TP.

Referring to FIG. 10 again, side edge sensors 61S are provided on the side opposite to the punch motor 60M of the punch shift unit 61 with the sheet path therebetween, corresponding to sheet sizes. The side edge sensor 61S is to detect an edge portion of a sheet in a position close to the rear end of the sheet, and by slightly shifting the punch shift unit 61 from the outer side to the inner side of the edge portion, the sheet end portion is detected using a state change (falling or rising) of the sensor to determine punch positions for two holes or three holes. Further, in a position corresponding to the center (center of the three-hole punch blades 62TP), a punch sensor 60S is provided to detect the end portion of the sheet. It is determined that the position in which the rear end of the sheet passes through the punch sensor 60S is the punch position of the sheet. As a matter of course, the punch position may be a position spaced a predetermined count away from the punch sensor 60S.

Figure 12:
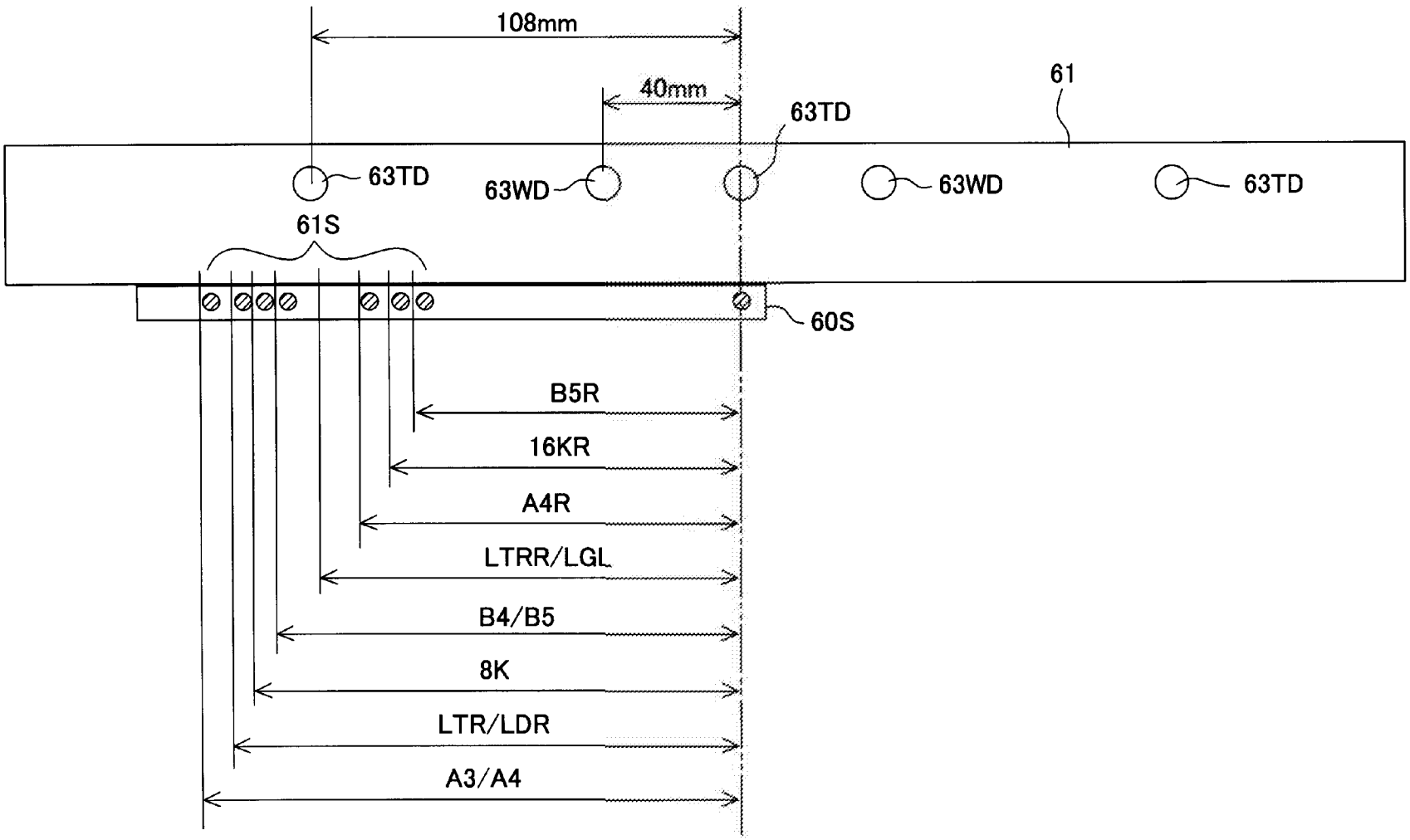
FIG. 12 is an explanatory view of sheet side edge detection sensors attached to the punch unit.

FIG. 12 illustrates that the above-mentioned side edge sensor 61S and punch sensor 60S are attached to the punch shift unit 61, and is to explain positions of the die holes 63 (two-hole die holes 63WD, three-hole die holes 63TD). As shown in the figure, the side edge sensor 61S corresponding to each size is provided in a position slightly displaced corresponding to the size of the sheet. Then, when the sheet is fed in the center reference (punch sensor 60S center), it is possible to detect the side edge of the sheet by a slight shift. Further, the figure also illustrates that the two-hole die holes 63WD are positioned in positions spaced 40 mm away from the center, and that both sides of the three-hole die holes 63TD are positioned in positions spaced 108 mm away from the center. In this case, the letter-size vertical format (LTRR) and legal size (LGL) just correspond to the three-hole die hole 63TD, and this respect will separately be described as die hole 63 avoidance operation.

[Sheet Transport in the Transport Unit]

Figure 13A:
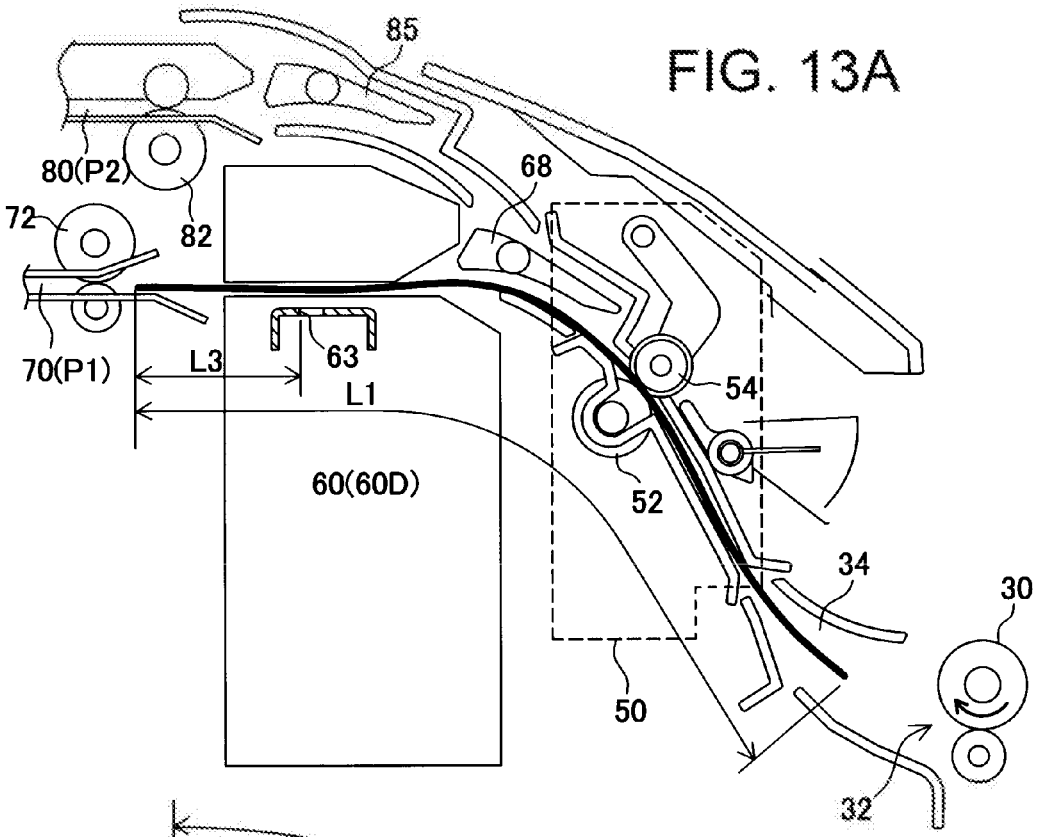
FIGS. 13A and 13B contain views to explain a state in which a shift of a sheet by the shift roller (relay roller) unit is completed, where

Hereinafter, described is sheet transport to the first transport path 70 (P1), second transport path 80 (P2) and third transport path 83 (P3) by the transport unit 40 including the shift roller unit 50. FIG. 13A illustrates a state in which a shift of a sheet with a length of L1 is completed before the carry-in roller 72 of the first transport path 70 (P1). Specifically, a length from the carry-in entrance 32 to the carry-in roller 72 is set at 235 mm, and as sheets capable of being shifted in the direction crossing the transport direction by the shift roller 52, it is possible to shift sheets with lengths of the letter size, A4-size or less with lengths of 216 mm or less. Sheets of sizes having longer lengths are once placed on the processing tray 90, and are shifted by the alignment plate 95, and this respect will be described later.

The sheet from the carry-in entrance is transported to the downstream side by the shift roller 52 inside the shift roller unit 50, and is shifted in the direction crossing the transport direction, and in FIG. 13A, the first flapper 68 is positioned so as to transport the sheet to the punch unit 60 (or dummy punch (transport guide) 60D) side. Accordingly, the sheet is transported toward the first transport path 70, and is shifted, and in this Embodiment, an arrangement is made where the shift is started after the front end of the sheet passes through the die hole 63 of the punch unit 60, and is completed until the sheet arrives at the carry-in roller 72.

In other words, in any of sheets with lengths capable of being shifted, by starting the shift after the sheet front end passes through the range of L3, the occurrence is reduced that the sheet is caught in the die hole 63. Further, the shift of any sheet is started from the same position to make additional resistance of the transport guide or the like constant in the sheet shift, and it is intended to reduce a sheet jam and the like in this position. Particularly, in the case of transporting and shifting by the shift roller 52, it is possible to prevent the sheet from being caught and the like.

As a matter of course, in the dummy punch (transport guide) 60D without the die hole 63 existing, at the time the rear end of the sheet passes through the main-body discharge roller 30, it is possible to start the shift of the sheet, but in this Embodiment, the first flapper 68 and shift roller 52 are positioned in positions for enabling the shift to be performed after the sheet passes through at least the swing front end of the first flapper 68. This is because a gap is generated between the flapper and the transport guide, and by starting the shift of the sheet after passing through the gap, getting caught in the gap is reduced.

Figure 13B:
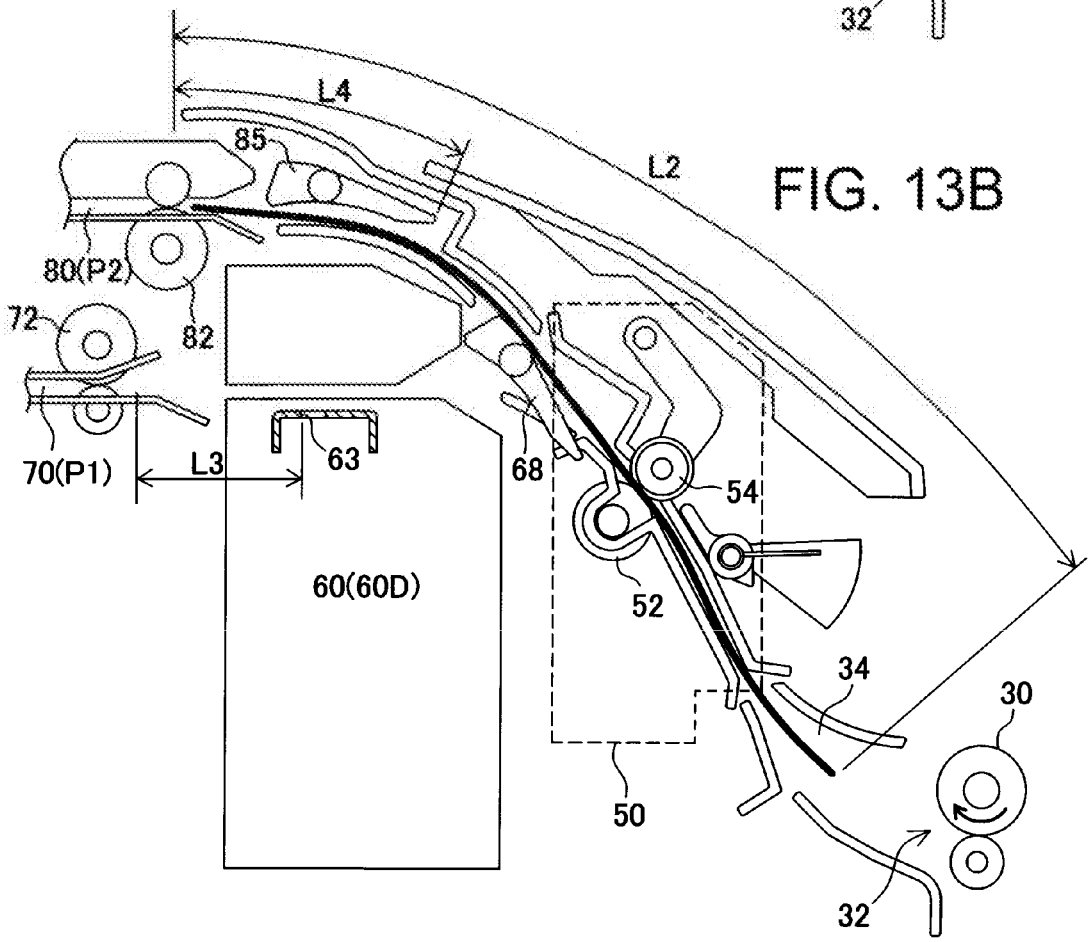

Next, FIG. 13B illustrates a state in which the shift of the sheet is completed before the branch roller 82 of the second transport path 80. In this figure, the sheet from the carry-in entrance 32 arrives at the second flapper 85 by the shift roller 52 via the first flapper 68 for opening the second transport path 80 side, while closing the first transport path 70 side.

At the time the sheet passes through the swing front end of the second flapper 85, the sheet shift is started, and is completed until the sheet arrives at the branch roller 82.

Also herein, specifically, a length from the carry-in entrance 32 to the branch roller 82 is set at 235 mm, and as sheets capable of being shifted in the direction crossing the transport direction by the shift roller 52, it is possible to shift sheets with lengths of the letter size, A4-size or less with lengths of 216 mm or less. Accordingly, it is not possible to perform the shift for sorting on sheets exceeding the length, and in this case, the sheets are passed through the first transport path 70 and are shifted by the alignment plate 95.

Further, also in the second transport path 80, in any of sheets with lengths capable of being shifted, by starting the shift after the sheet front end passes through the range of L4, the shift is performed after the sheet passes through the front ends of the first flapper 68 and second flapper 85, and it is thereby intended to reduce getting caught in the second flapper 85 and transport guide. In addition thereto, the shift of any sheet is started from the same position to make additional resistance of the transport guide or the like constant in the sheet shift, and it is intended to reduce a sheet jam and the like in this position. Particularly, in the case of transporting and shifting by the shift roller 52, it is similarly possible to prevent the sheet from being caught and the like.

As a matter of course, it is possible to perform the sheet shift when the rear end of the sheet to feed to the second transport path 80 passes through the main-body discharge roller 30, and in this Embodiment, the first flapper 68 and shift roller 52 are positioned in positions for enabling the shift to be performed after the sheet passes through at least the swing front end of the first flapper 68. This is because a gap is generated between the flapper and the transport guide, and by starting the shift of the sheet after passing through the gap, getting caught in the gap is reduced.

Figure 14:
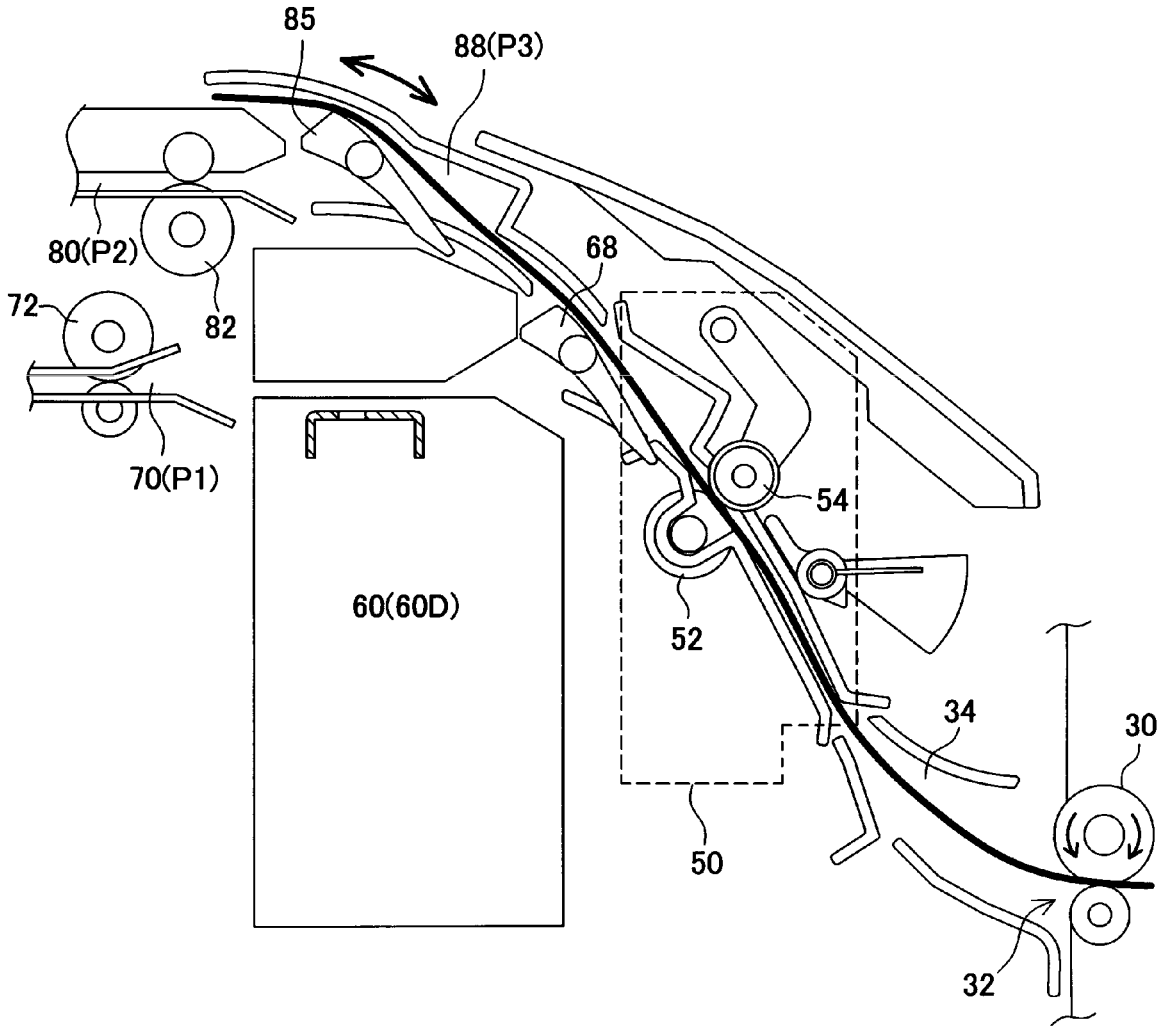
FIG. 14 is an explanatory view where the shift roller is in a separate state at the time of switchback when the sheet that is carried in is guided to an image formation section again.

In this Embodiment, FIG. 14 is an explanatory view in switching back a sheet that is carried in, when the sheet is guided again to the image formation section to form images on both sides. In this case, the sheet passes through above the first flapper 68 and second flapper 85, and is carried in the third transport path 88. In this case, the sheet shifts in the normal direction and in a switchback direction opposite thereto by the main-body discharge roller 30, and in order not to interfere with transport operation of the main-body discharge roller 30, the shift roller 52 and shift driven roller 54 in press-contact with the roller 52 are separated by the driven roller solenoid 54SL. By this means, it is possible to transport also relatively long sheets such as an A3-sheet in the normal direction and switchback direction by the main-body discharge roller 30 without resistance.

[Explanation of Sheet Shift Operation to the First Transport Path]

Hereinafter, shift operation up to shift completion of the sheet to the first transport path 70 in FIG. 13A described above will be described with reference to cross-sectional explanatory views of FIGS. 15A to 16B and FIGS. 17A to 18B that correspond to the views in a plan view.

[Front-Side Shift]

Figure 15A:
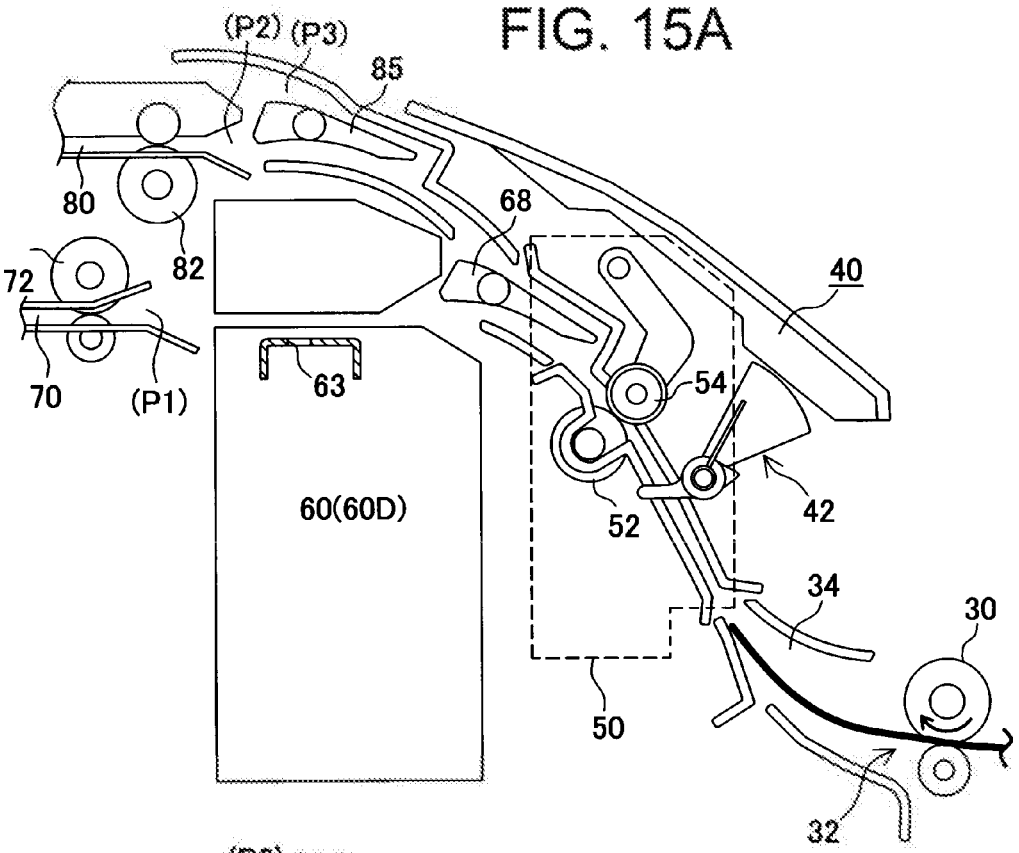
FIGS. 15A and 15B contain views illustrating a transport state of the sheet to the shift roller unit, where
Figure 17A:
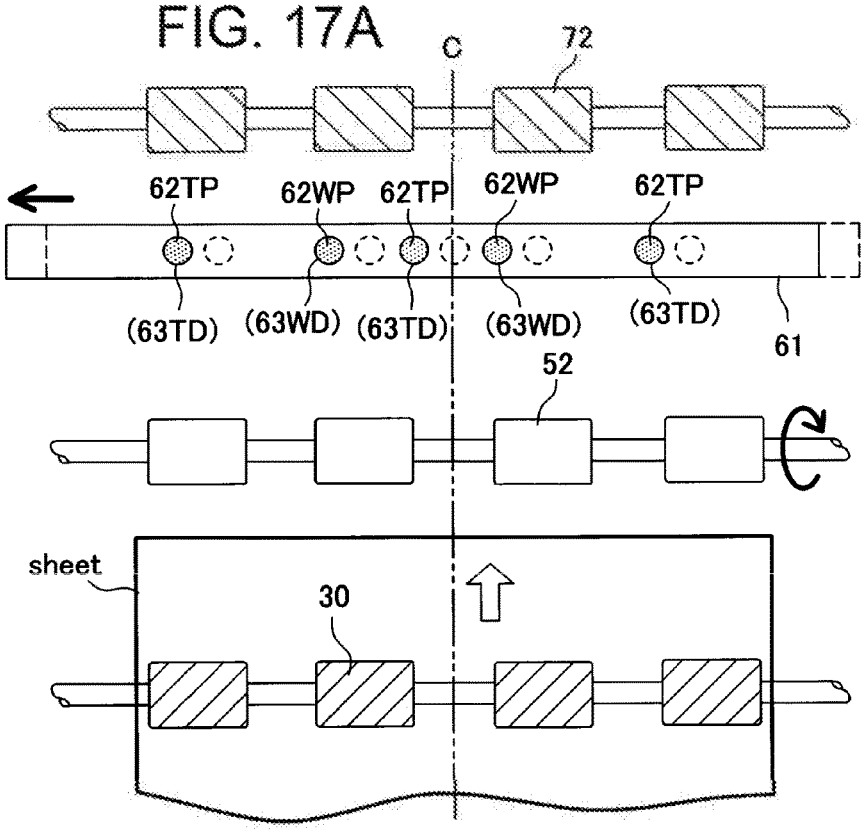
FIGS. 17A and 17B contain views that correspond to the state of the sheet of FIGS. 15A and 15B in a plan view, where FIG. 17A corresponds to FIG. 15A and is a state view where carry-in of the sheet is started from the image formation section to the shift roller unit, and FIG. 17B corresponds to FIG. 15B and is a state view where the shift of the sheet to the front side (front side of the apparatus) is completed by the shift roller unit.

FIG. 15A is a view illustrating that a sheet to guide to the first transport path 70 is discharged from the main-body discharge roller 30 and is carried in from the carry-in entrance 32. In this figure, the first flapper 68 already blocks a path on the second transport path 80 side. From this state, when the carry-in sensor 42 detects the sheet front end, as shown in FIG. 17A, while rotating the shift roller 52 in the transport direction, the shift motor 61M of the punch unit 60 is driven to shift the punch shift unit 61 beforehand to the front side in this case. A shift amount of the punch shift unit 61 in this Embodiment is slightly larger than 15 mm. The rotation start of the shift roller 52 and shift start of the punch shift unit 61 may be performed by obtaining a signal of sheet carry-in from the main-body image formation apparatus A.

In addition, in the figure, as the die hole 63 of the punch shift unit 61, the three-hole die hole 63TD and two-hole die hole 63WD are shown in the figure.

Figure 15B:
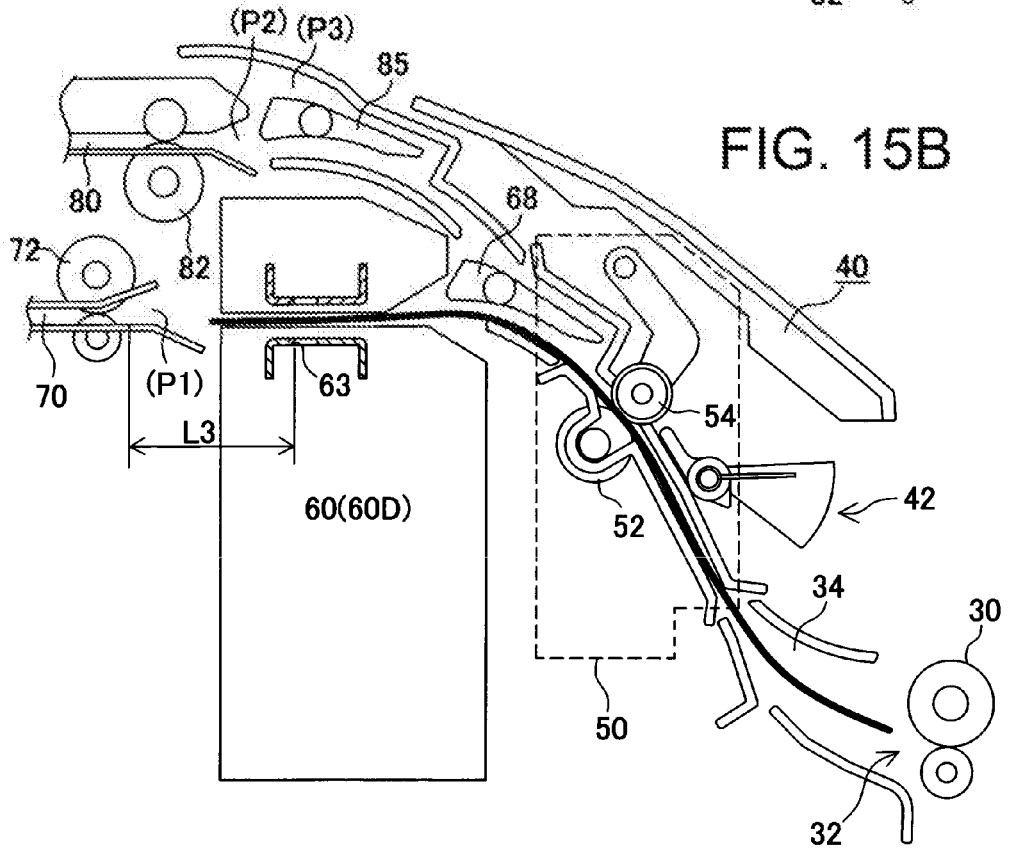
Figure 17B:
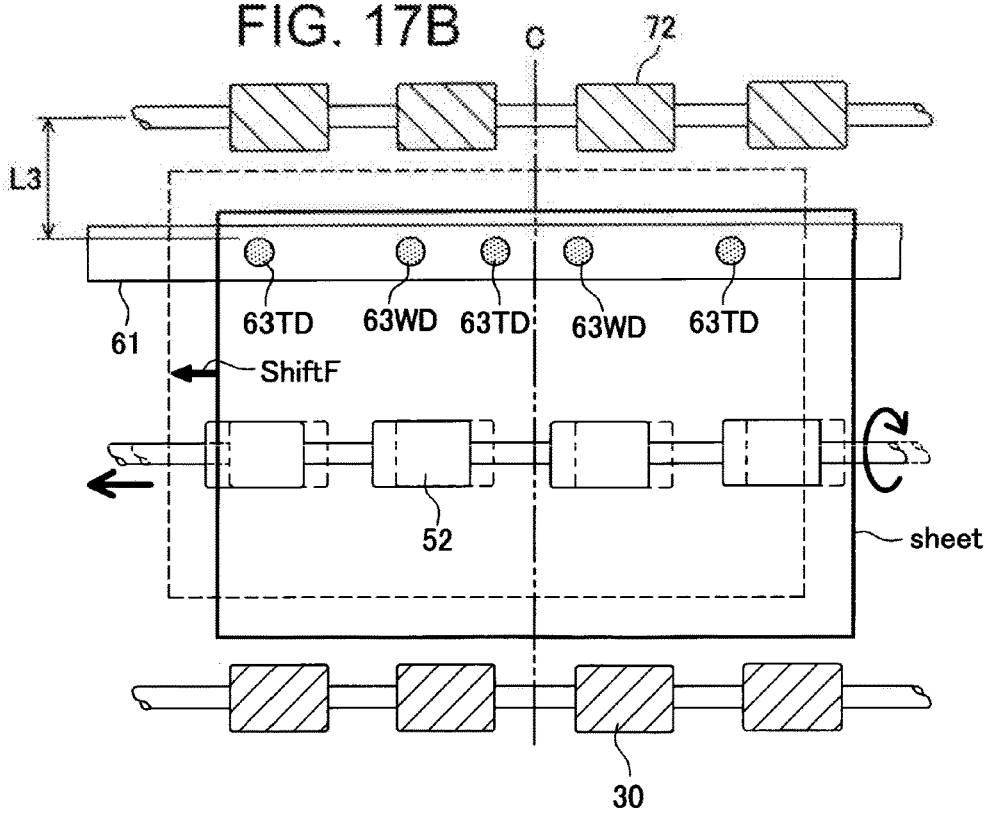

FIG. 15B illustrates a state in which the sheet front end passes through the die hole 63 of the punch shift unit 61, and is transported to the carry-in roller 72 of the first transport path 70. As described already, at the time the sheet front end passes through the die hole 63 in the position of L3 from the carry-in roller 72, the shift to the front side by the shift roller 52 and shift driven roller 54 is started (hereinafter, simply described as shift of the shift roller 52). In FIG. 17B, this state is shown as a state in which the rear end of the sheet has already passed through the main-body discharge roller 30, and the shift roller 52 performs the shift to the front side, while transporting the sheet, and in the dashed-line state, the shift to the front side is completed. In addition, a shift amount Shift F to the front side of the shift roller 52 is also set at 15 mm, and may be to the extent of 10 mm for enabling sorting to be distinguished. Further, described herein is the example where the shift roller 52 shifts to both of the front side and the rear side, and a shift to only one side of about 10 mm to 15 mm may be performed in one direction to the front side or rear side in the apparatus center.

Figure 16A:
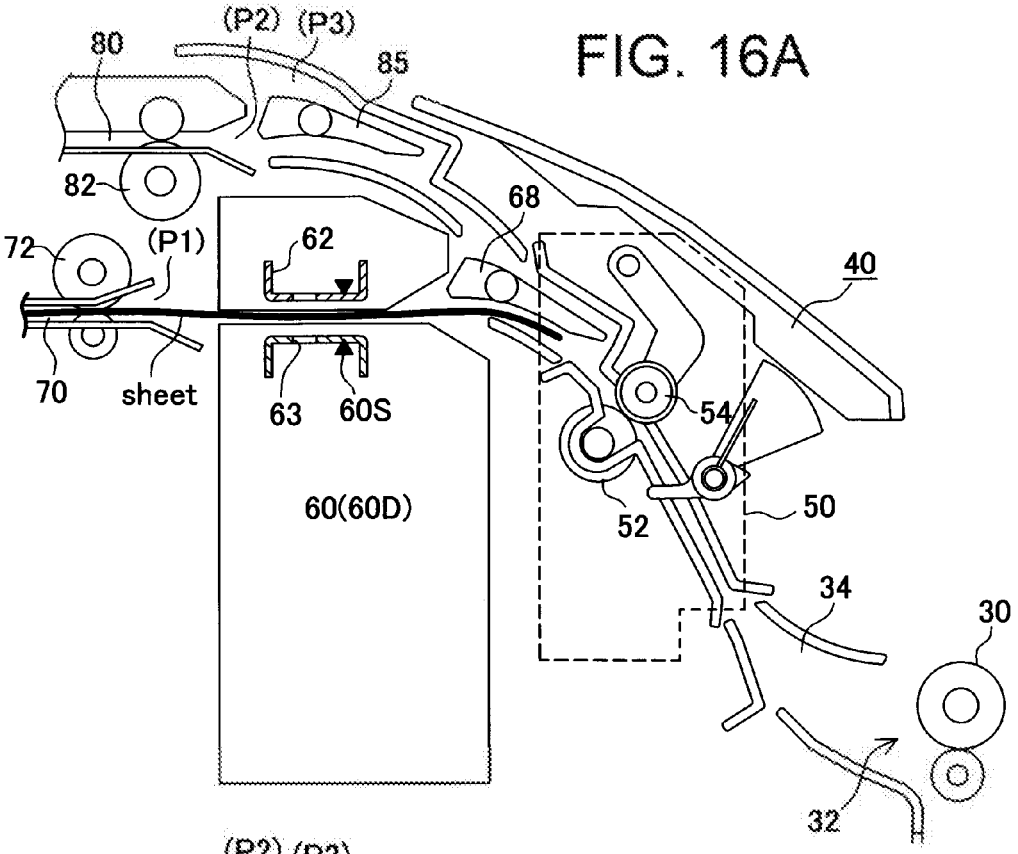
FIGS. 16A and 16B contain views to explain carrying-out of the sheet from the shift roller unit and a punching state by the punch unit, where

Next, FIG. 16A illustrates a state in which the front end of the sheet passes through the carry-in roller 72 of the first transport path 70, and the rear end of the sheet passes through the shift roller 52. This state corresponds to FIG. 18A, and the sheet passes through the punch unit 60 (when the unit 60 does not exit, dummy punch (transport guide) 60D) which has already shifted to the front side, by the shift amount Shift F to the front side. As shown in the figure, when the sheet rear end passes through the shift roller 52, the shift roller 52 is returned to the home position in the center in the arrow direction shown in FIG. 18A. The return to the home position is set by count from sheet passage of the carry-in sensor 42, and it is also possible to control using a main-body signal. Thus, the shift roller 52 returns to the home position immediately after sheet passage, and it is thereby possible to promptly support even when the next sheet is of the shift to the rear side.

Figure 16B:
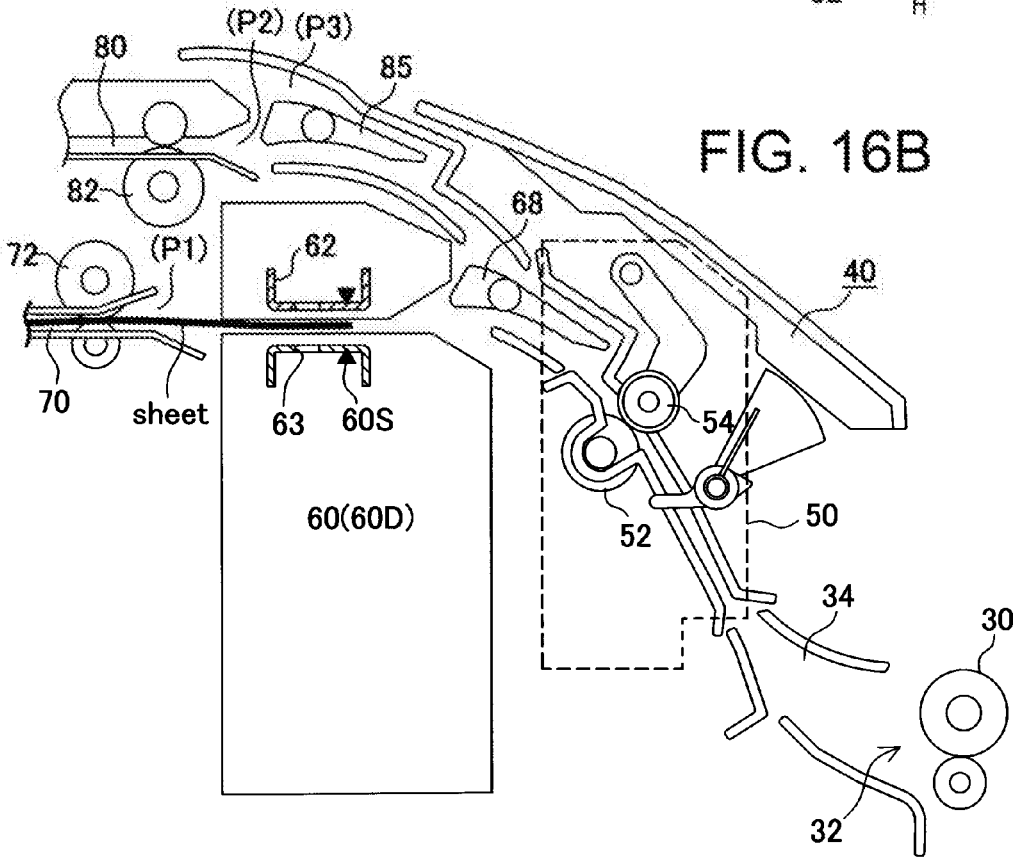

Then, as shown in FIG. 16B, when the punch sensor 60S of the punch shift unit 61 detects the sheet rear end, at this point in time, it is judged that the sheet arrives at the punch position, and the carry-in roller 72 is halted. After the halt, the rotation direction of the punch motor 60M already described is designated according to two holes or three holes, and the punch blade 62 is moved up and down by the punch cam 64 to perform punching operation between the die hole 63 and the blade. This state corresponds to FIG. 18B, and since the die hole 63 at the center of three-hole die holes 63TD is positioned in the sheet shift by the shift roller 52, punching is performed with the center of the sheet therebetween.

Figure 18A:
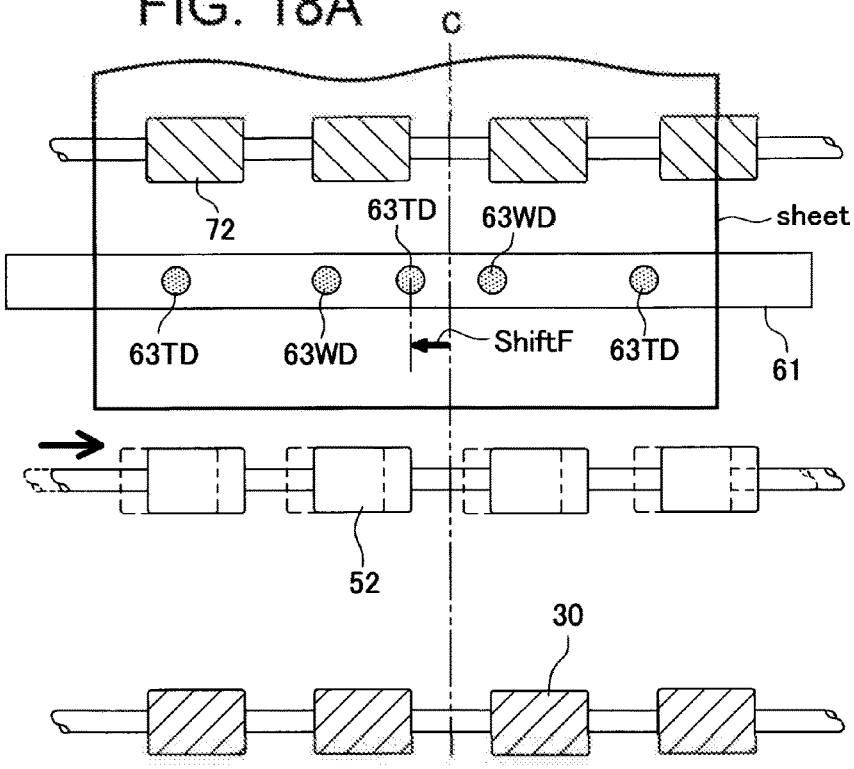
FIGS. 18A and 18B contain views that correspond to the state of the sheet of FIGS. 16A and 16B in a plan view, where FIG. 18A corresponds to FIG. 16A and is a view to explain the state in which the shifted sheet is discharged to the front side (front side of the apparatus) from the shift roller unit roller, and FIG. 18B corresponds to FIG. 16B and is an explanatory view of the state in which the carry-in roller is halted and punching processing is performed on the sheet shifted to the front side (front side of the apparatus) by the punch unit.
Figure 18B:
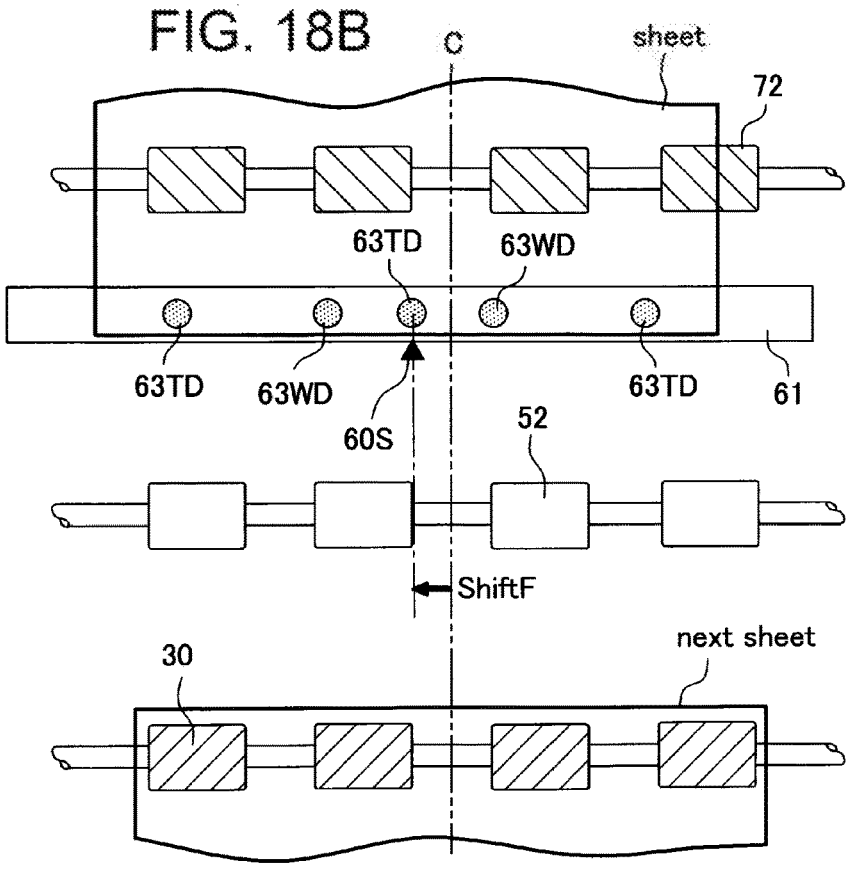

In addition, in positions in FIG. 16A, FIG. 18A that corresponds to FIG. 16A, FIG. 16B and FIG. 18B that corresponds to FIG. 16B, in order to determine punch positions in the sheet, the punch shift unit 61 performs reciprocating motion in the direction crossing the transport direction in a range corresponding to the sheet size. This motion is to detect the sheet side edge by the side edge sensor 61S shown in FIGS. 10 and 12, and an error in the sheet width direction is corrected by a state change (edge detection by rising or falling) of the side edge sensor 61S. This detection is desirably performed in a position close to the punch position, and in this Embodiment, is performed in the above-mentioned position.

[Rear-Side Shift]

Figure 19A:
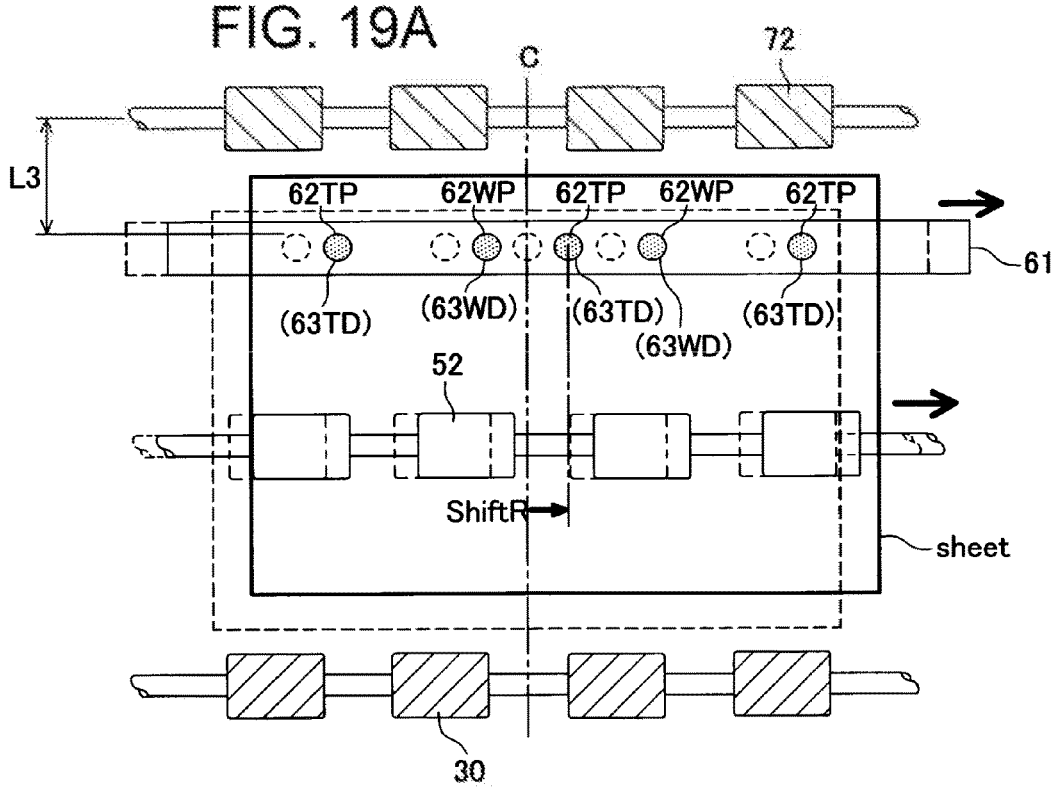
FIGS. 19A and 19B contain views that correspond to the state of the sheet of FIGS. 15A to 16B in a plan view, where FIG. 19A corresponds to FIG. 15B and is a view to explain the state in which the shifted sheet is discharged to the rear side (rear side of the apparatus) from the shift roller unit roller, and FIG. 19B corresponds to FIG. 16B and is an explanatory view of the state in which the carry-in roller is halted and punching processing is performed on the sheet shifted to the rear side (rear side of the apparatus) by the punch unit.
Figure 19B:
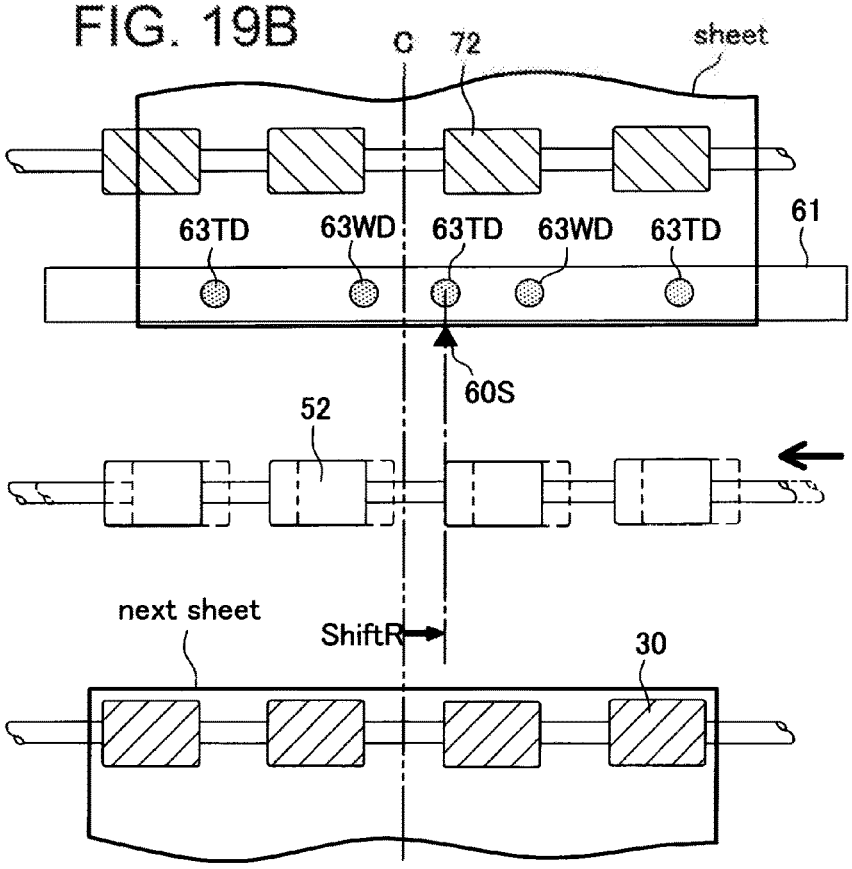

Referring to FIGS. 19A and 19B, described next is the case of shifting the sheet to the rear side by the shift roller 52. Operation of the rear-side shift is the same as operation of the front side, except that the direction crossing the transport direction is the rear side, and will be described with omission. When a sheet is carried in from the carry-in entrance 32, the shift roller 52 is rotated in the transport direction, the shift motor 61M of the punch unit 60 is driven, and the punch shift unit 61 is beforehand shifted to the rear side already. A shift amount of the punch shift unit 61 to the rear side is slightly larger than 15 mm. Then, when the sheet front end passes through the die hole 63 corresponding to the punch blade 62 of the punch shift unit 61, as shown in FIG. 19A, at this point, the shift motor 50M is driven to shift the shift roller 52 to the rear side. By this means, the sheet is shifted to the rear side corresponding to Shift R. The rear-side Shift R is also 15 mm.

From this state, when the sheet passes through the shift roller 52, the shift roller 52 is returned to the original position, and waits for carry-in of the next sheet. On the other hand, the prior sheet is transported at the substantially center of the shifted punch shift unit 61 by the carry-in roller 72. Then, as shown in FIG. 19B, when the rear end of the sheet is detected by the punch sensor 60S, the carry-in roller 72 is halted, the punch motor 60M is driven to drive the designated punch blade 62, and punching processing is performed on the sheet rear end side. In addition, it is the same as the time of the shift to the front side that the unit remains in the position subsequent to the shift until the shift direction for sorting is changed, and when the shift position is changed, the unit shifts to the shift position on the opposite side before the carry-in roller 72 of the sheet.

Then, when the sorting processing of the designated number of copies is finished, the punch shift unit 61 is returned to the original center position. In other words, the shift roller 52 returns to the center whenever the sheet passes, and the punch shift unit 61 does not change the shift position within the same number of copies until the shift position of the sheet is changed, and changes the shift direction only when the shift direction is changed. In addition, similarly, side edge detection of the sheet immediately before the punching processing is performed by slightly shifting the side edge sensor 61S.

Described above is operation of the shift to the front side and the shift to the rear side of the punch shift unit 61 and shift roller 52 in association with the shift of the sheet. As described herein, since the punch shift unit 61 is shifted in the shift roller 52 direction of the shift roller 52 before a sheet is carried in, it is possible to punch in the sheet at any time after the sheet shift, and it is possible to perform the processing at high speed. On the other hand, in this Embodiment, because of being positioned on the downstream side of the shift roller 52, the shift of the punch shift unit 61 may be performed at relatively low velocity. Accordingly, without upsizing the shift motor 61M, it is possible to perform shift operation sufficiently.

[Punch and Sheet Processing Patterns]

Herein, with respect to the punching processing and sheet shift processing of the sheet in the sheet processing apparatus B of this Embodiment, FIG. 20 illustrates punch and sheet processing patterns in the case of being provided with the punch shift unit 61, in the case of the dummy punch (transport guide) 60D without the unit, and in addition thereto, in the cases of large and small sheet transport lengths. In this table, the 1st row shows the presence or absence of the punch shift unit 61, the 2nd row shows whether the sheet length is large or small (actually, whether or not the length exceeds the transport length of 216 mm), and the 3rd and 4th rows show whether to perform the sheet shift by the shift roller 52 (○ represents executable, X represents inexecutable.)

Further, the 5th row shows whether to perform the sorting shift of the sheet by the alignment plate 95 on the processing tray 90 (Δ represents possible when performing), the 6th row shows the presence or absence of avoidance operation of the three-hole die hole 63TD in particular sheets (letter vertical format, legal-size sheet), and the 7th row shows the punching processing. Then, the 8th row shows a procedure of punching and shift of sheet processing in the sheet processing apparatus B, and the last 9th row shows a pattern indicating processing results of punching and shift corresponding to the sheet length. These details are clarified in the forgoing explanation and explanation including processing flows described later, and therefore, the explanation herein is omitted.

Referring to flow diagrams of FIGS. 21 to 27, described next is a flow of punching and sheet shift by the processing pattern described in the foregoing explanation and FIG. 20.

(Steps S10 to S19)

Figure 21:
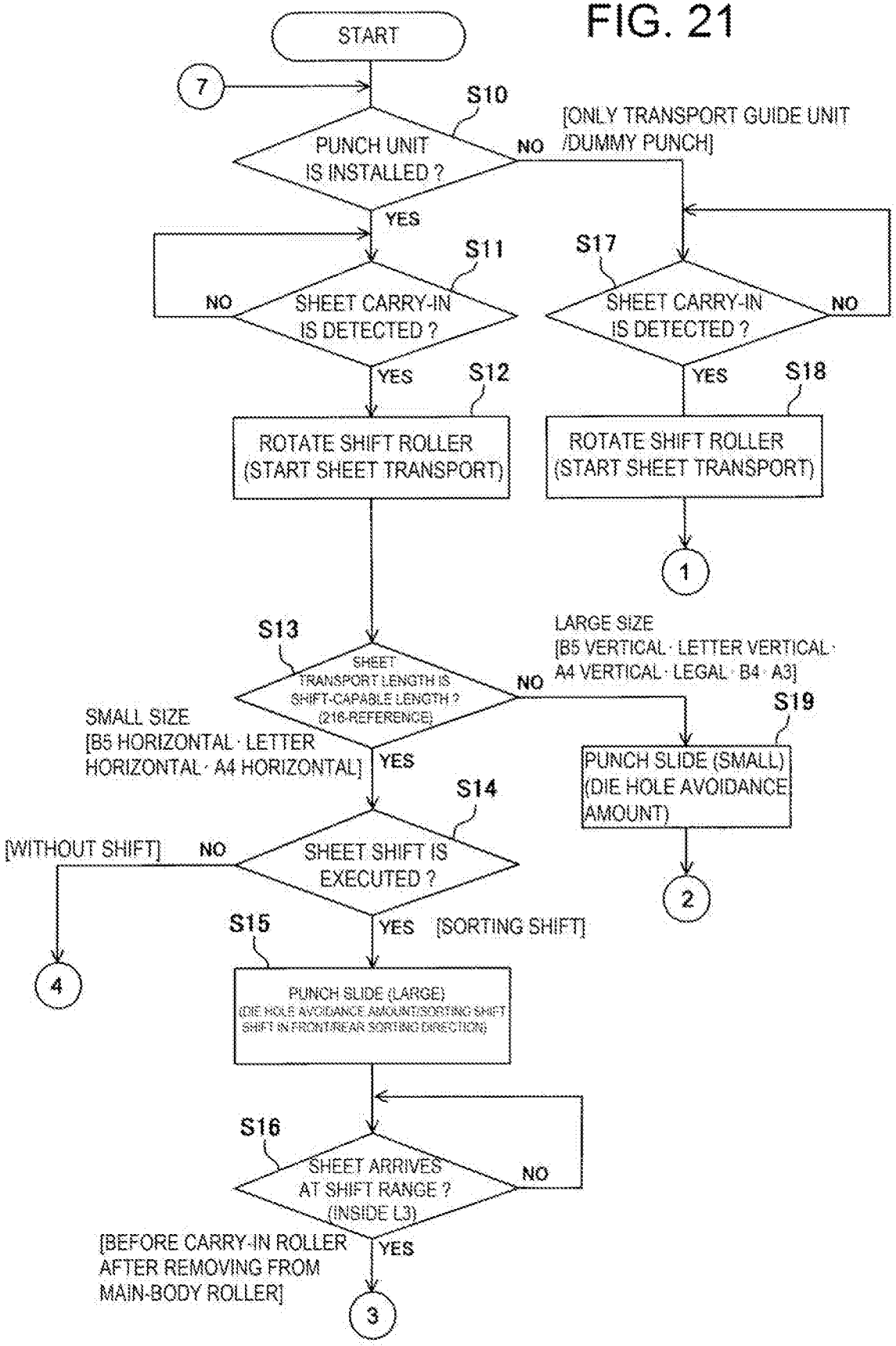
FIG. 21 is a processing flow diagram of the sheet by the table of FIG. 20.

FIG. 21 shows an operation flow in starting. Herein, it is first judged whether the sheet processing apparatus B is installed with the punch unit 60 or with the dummy punch (transport guide) 60D without the unit 60 (S10). This judgment may be performed by detecting the punch unit 60 with a sensor not shown, or performed in initial setting from an electric switch or a control panel. In the case of the presence in this step, the apparatus next waits for carry-in of a sheet (S11). Then, when the carry-in sensor 42 detects the front end of the sheet, rotation of the shift roller 52 and shift driven roller 54 is started in a nip state (S12). Herein, also in the case of the dummy punch (transport guide) 60D, the apparatus waits for sheet carry-in (S17), and by sheet detection of the carry-in sensor 42, the shift driven roller 54 is started. The next operation in this case will be described separately in FIG. 26.

Returning to FIG. 21, in parallel with the starting of rotation of the shift roller 52 described above, the apparatus acquires length information of the sheet that is carried in from the main body side by the main-body discharge roller 30. In this step, as in FIG. 20, as the small size, for example, sheets with sheet lengths of B5 horizontal format, letter horizontal format, and A4 horizontal format are set. Further, set as the large size are sheets with sheet transport lengths of B5 vertical format, letter vertical format, A4 vertical format, legal format, B4 and A3. In other words, by handling A4-size paper and letter-size paper, which is relatively used frequently, as the horizontal format, the processing is performed promptly. Next, the presence or absence of shift execution is judged to sort sheets (S14). Herein, in the case of the presence of sorting shift, the punch shift unit 61 is shifted in advance to the front side or the rear side in the direction to sort (S15). The shift of the punch shift unit 61 herein is performed to a position slightly larger than 15 mm, in consideration of a detection shift of the side edge sensor 61A, by driving the shift motor 61M.

Then, during the period, the shift roller 52 transports the sheet to the punch unit 60 side beyond the first flapper 68. Then, it is checked whether or not the sheet front end enters the range of L3 beyond the die hole 63 of the punch unit 60 (S16). This check is performed by the punch sensor 60S of the punch shift unit 61. Herein, when the apparatus is not instructed to perform the sorting shift of the sheet, transport by the shift roller 52 is continued. The next operation in this case will be described separately in FIG. 22.

On the other hand, when it is judged that the above-mentioned sheet transport length is large, in order to prevent the front end corner of the sheet from being caught in the die hole 63 (three-hole die hole 63TD), the punch shift unit 61 is shifted at least to the front side or the rear side. Herein, since targets are die holes 63 on the opposite sides of the three-hole die hole 63TD, the unit is shifted to the extent of about 6 mm. Accordingly, the punch shift unit 61 is shifted larger than 15 mm in the prior sheet sorting, while being shifted in a range to the extent of 6 mm in die hole 63 avoidance, and an excessive load of the shift motor 61M is thereby decreased. The next operation in this case will be described separately in FIG. 24.

(Steps S100 to S190)

Figure 22:
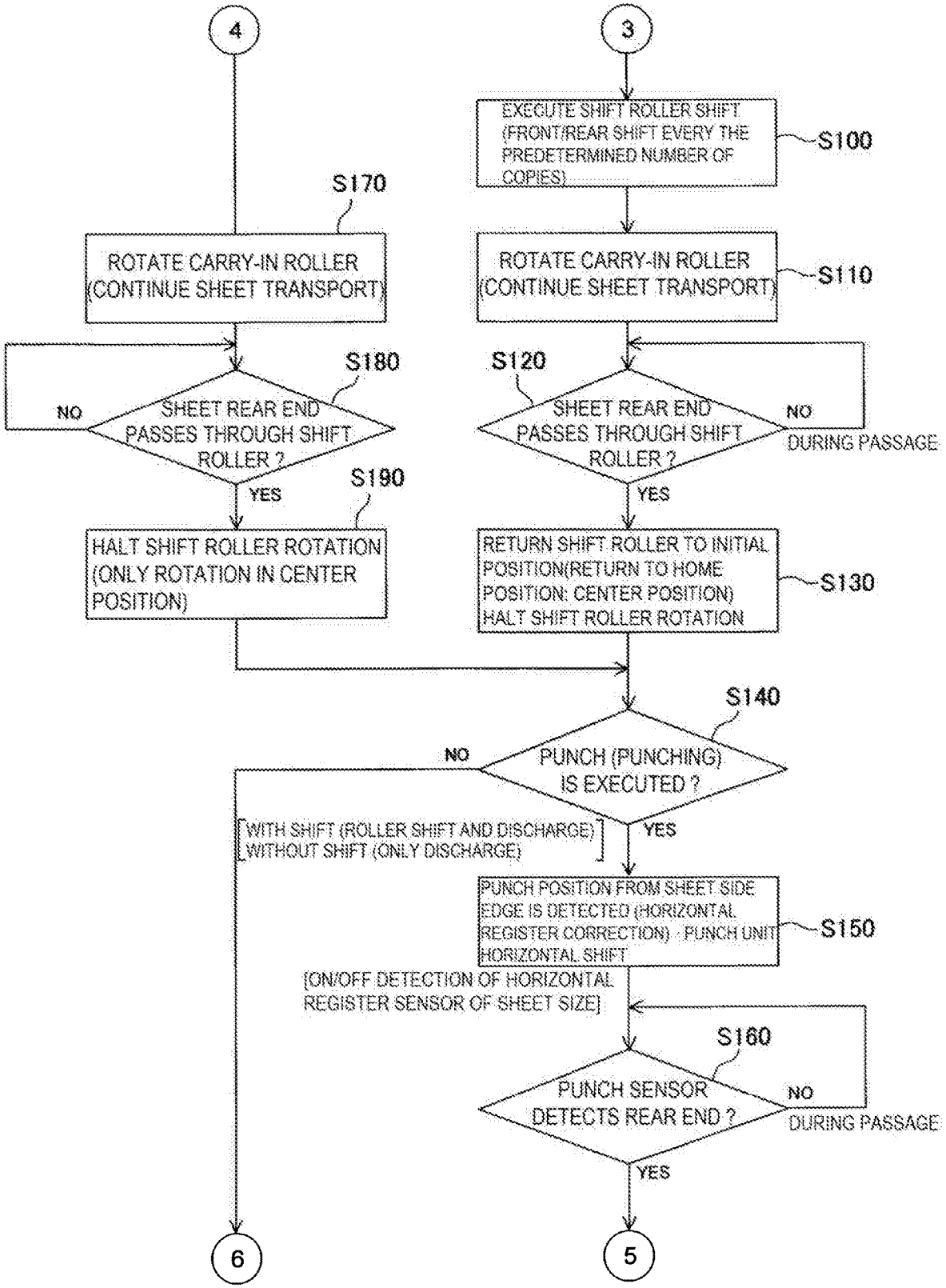
FIG. 22 is another processing flow diagram of the sheet continued from FIG. 21.

Next, S100 to S190 will be described with reference to FIG. 22. Herein, in the case of performing sorting of the small size, when the sheet front end approaches the L3 range described previously, the shift roller 52 and shift driven roller 54 are shifted to the designated front side or rear side in the direction crossing the sheet transport direction, while transporting the sheet (S100). This state corresponds to FIGS. 17B and 19A described previously. In this stage, the carry-in roller 72 of the first transport path 70 is rotated, and takes over the sheet to transport (S120). When the rear end of the sheet taken by the carry-in roller 72 passes through the shift roller 52, the roller returns to the initial position that is the home position at the center of the apparatus, is halted and waits for carry-in of the next sheet.

On the other hand, the sheet of the large size subjected to punching avoidance operation of the punch shift unit 61 (S19) is transported successively by rotation of the carry-in roller 72 (S170). Subsequently, when the sheet rear end of the large size passes through the shift roller 52 (S180), rotation of the shift roller 52 is halted, and the roller 52 waits for carry-in of the next sheet (S190).

[Execution of Punching Processing]

Next, it is checked whether to execute the punching processing of the punch unit 60 in the small size or the large size as described above. In the case of executing herein, first, in order to detect the position of the side edge of the sheet, the unit is slightly shifted to the center side of the apparatus. By this shift, a state change of the side edge sensor 61S is checked to determine punch positions in the sheet width direction (S150). The next operation in this case and in the prior case of not punching will be described in FIG. 23.

(Steps S200 to S250)

Figure 23:
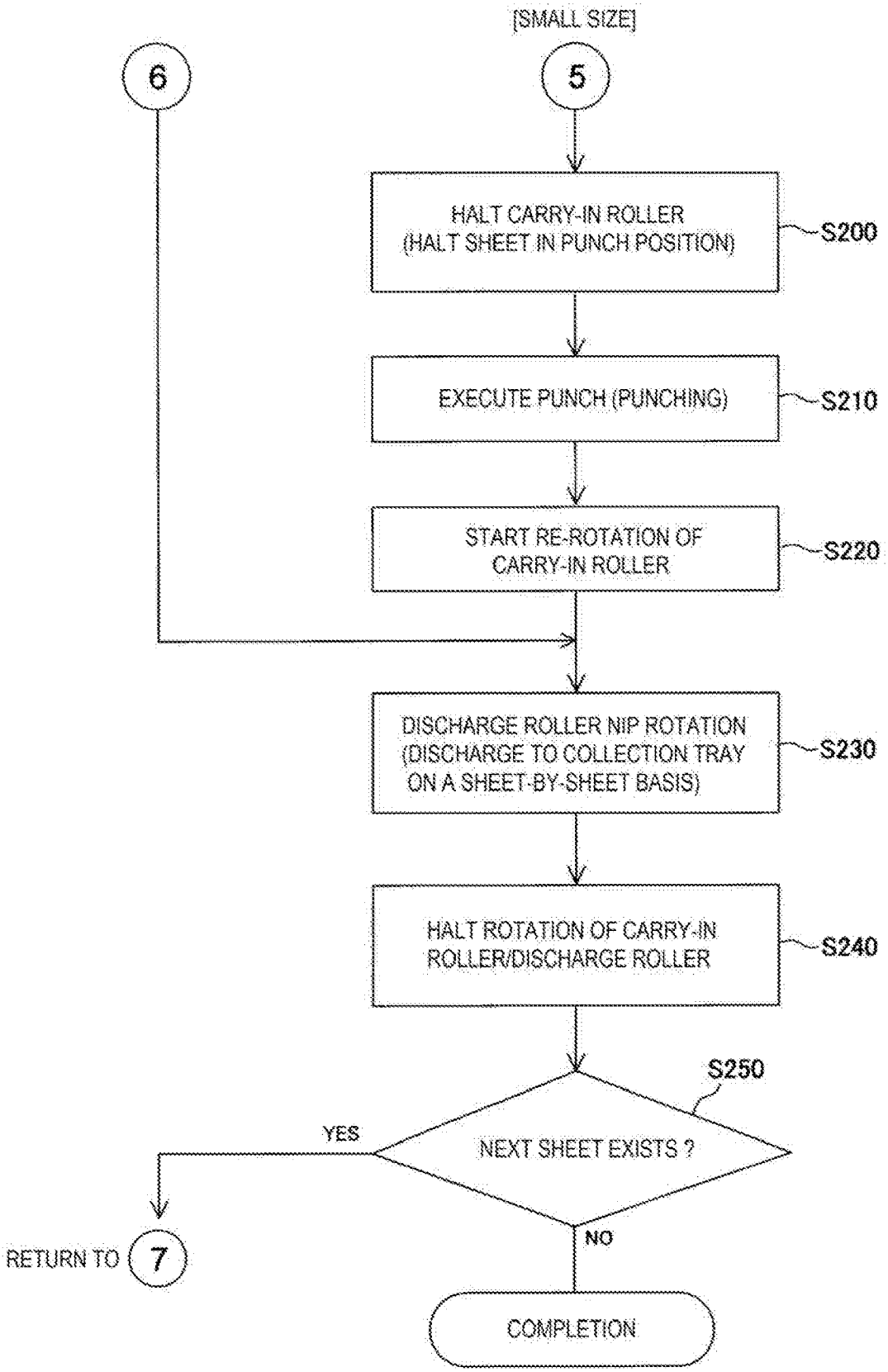
FIG. 23 is still another processing flow diagram of the sheet continued from FIG. 22.

In FIG. 23, when the punch sensor 60S detects passage of the sheet rear end, the carry-in roller 72 is halted (S200). This position is the punch position of the sheet rear end, and the rotation direction of the punch motor 60M is determined according to an instruction for two holes or three holes to punch (S210). When the punching processing is completed, rotation of the carry-in roller 72 is resumed to perform transport of the sheet. Although omitted in this flow, the sheet arrives at the carrying-out roller 74 that rotates together with the carry-in roller 72, and subsequently, by the discharge roller 78 moving down and brought into press-contact, is directly discharged to the first collection tray 110 on a sheet-by-sheet basis. When the discharge is completed, rotation of the carrying-out roller 74 and discharge roller 78 is halted (S240). In the case where the next sheet exists, the flow returns to the start, and is repeated to complete until the predetermined number of sheets is processed. By the above-mentioned operation processing, the sheet processing of the small sheet is performed in the case where the punch unit 60 exists.

[Large-Size Punch•Shift with the Punch Unit]

Figure 24:
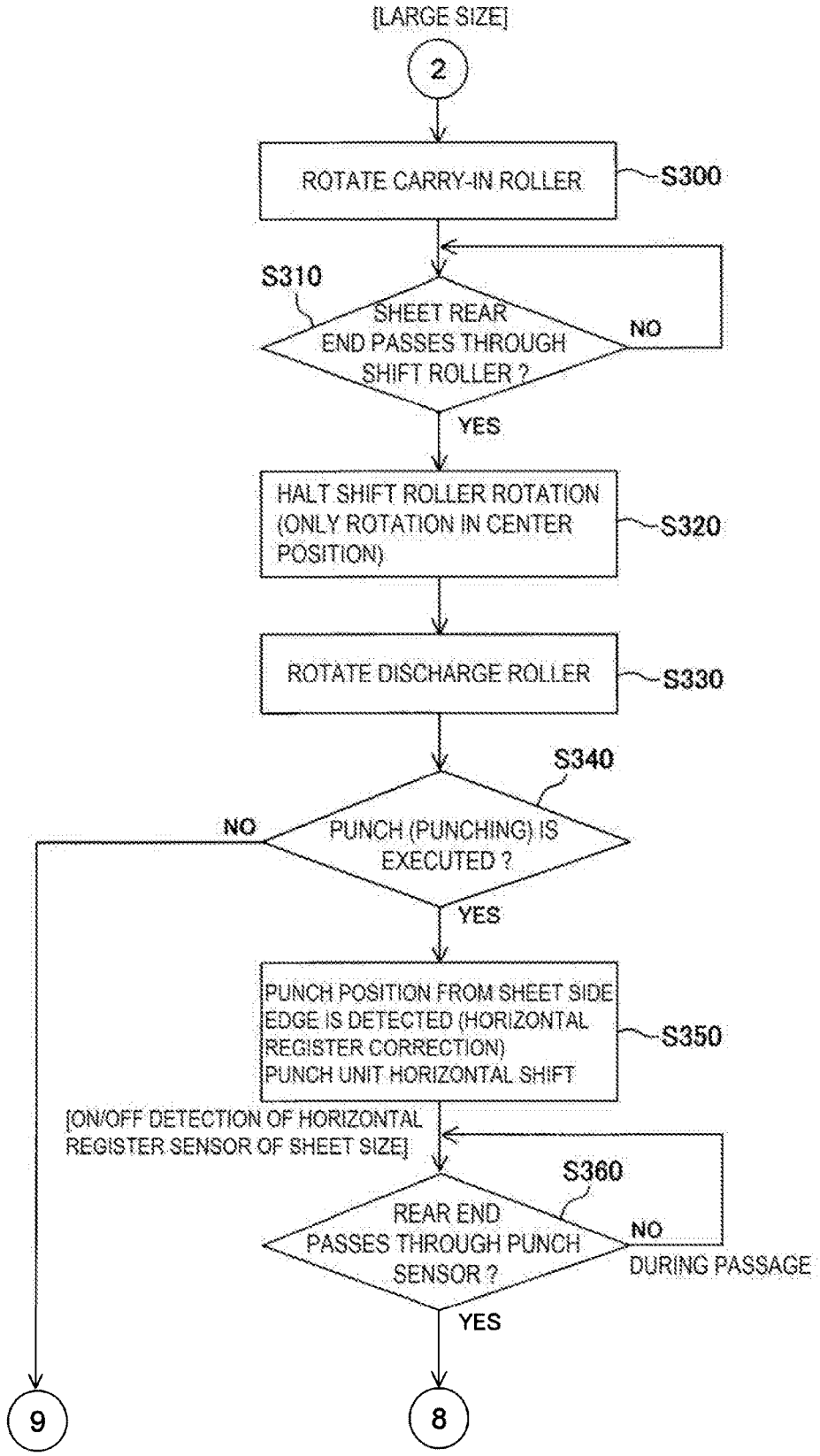
FIG. 24 is another processing flow diagram of the sheet of a large size continued from FIG. 21.
Figure 25:
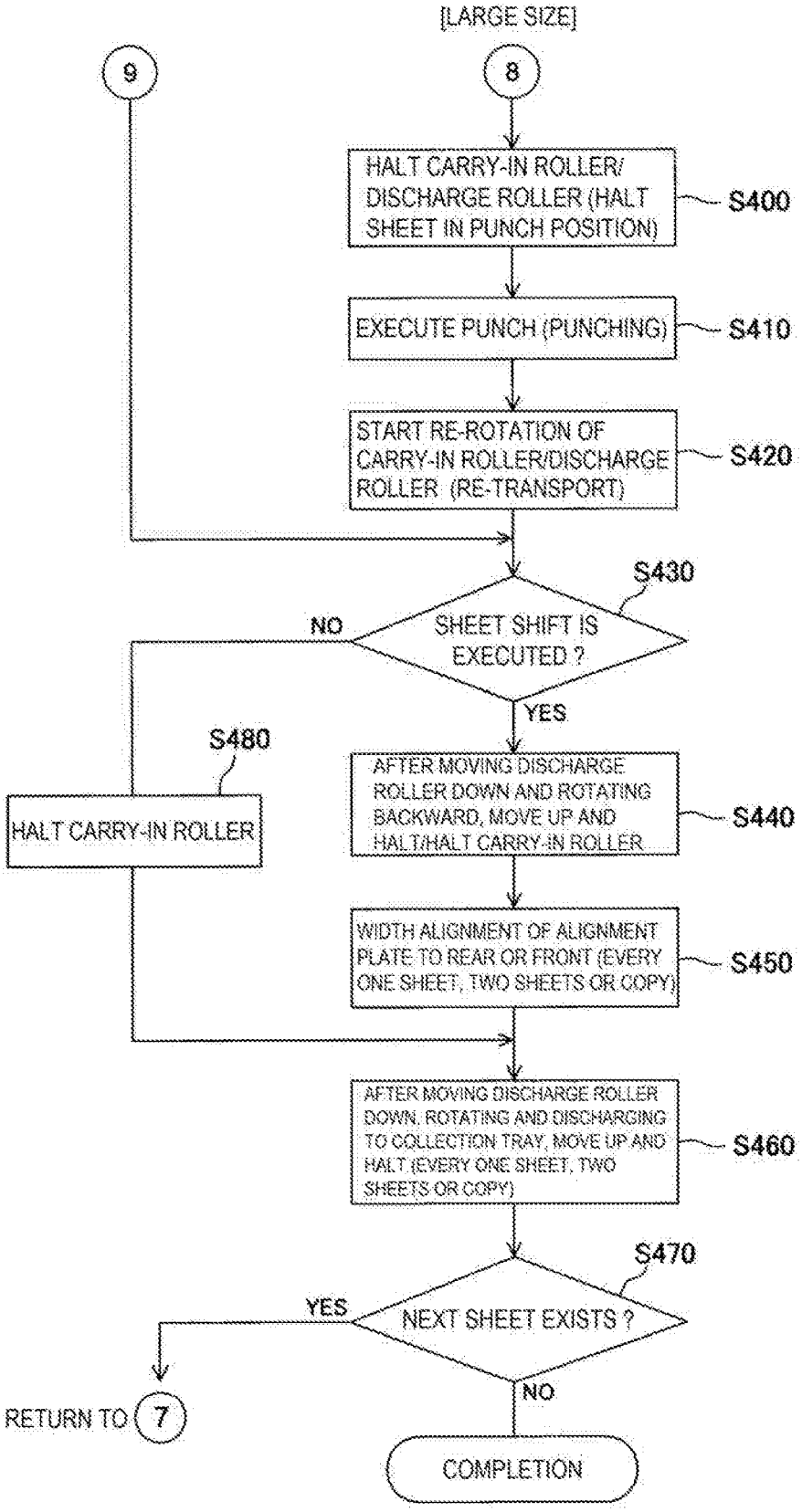
FIG. 25 is still another processing flow diagram of the sheet continued from FIG. 24.

Next, referring to FIGS. 24 and 25, with respect to the large-size punching and sorting shift with the punch unit, its flow will be described.

(From S300 to S360)

First, continued from avoidance operation of the die hole 63 (S19) in FIG. 21, rotation of the carry-in roller 72 is performed (S300). Next, it is judged whether or not the sheet rear end of the large size passes through the shift roller 52 (S310). When the sheet passes through, the shift roller 52 finishes the role as the relay roller to halt rotation, and waits for carry-in of the next sheet. Successively, the discharge roller 78 also starts rotation (S330). Herein, it is checked whether to execute the punching processing by the punch unit 60 (S340). When it is determined to execute, the punch shift unit 61 is shifted slightly to determine a punch position from the sheet side edge by the sheet side edge sensor 61S (S350). Next, the punch sensor 60S detects the sheet rear end (S360). The next operation in this case and in the prior case of not performing punching will be described in FIG. 24.

In the flow diagram of FIG. 25, the sheet processing of the large size will be described continuously. When the punch sensor 60S detects the rear end of the sheet, the rotation of the carry-in roller 72, (carrying-out roller 74) and discharge roller 78 is once halted (S400). After the halt, the punch motor 60M is driven to perform determined punching processing of two holes or three holes (S410). After the punching processing, the carry-in roller 72, (carrying-out roller 74) and discharge roller 78 are rotated again to resume transport of the sheet. Herein, it is checked whether to perform the shift of the sheet for sorting, together with the prior sheet on which the punching processing is not performed (S430).

In the case of performing the sorting shift, when the sheet is carried out to the processing tray 90, the discharge upper roller 78*a* is moved down to the discharge lower roller 78*b* to nip the sheet, and the discharge roller 78 is rotated backward to transport the sheet to the reference surface 92 side. Subsequently, the discharge upper roller 78*a* is moved up and is halted, and the carry-in roller 72 (carrying-out roller 74) is also halted (S440). At this point, the take-in roller 93 is rotated to bring the sheet into contact with the reference surface 92.

Corresponding to the contact with the reference surface 93 and to a position to shift the alignment plate 95, the sheet is shifted to a sorting position mainly with the rear-side alignment plate 95*b* in the case of sifting to the front side, or mainly with the front-side alignment plate 95*a* in the case of shifting to the rear side (S450). In this case, as the sorting shift on the processing tray 90 by the alignment plate 95, it is considered that the shift is performed every one sheet, two sheets or copy, and in terms of prompt processing, the shift is commonly performed every two sheets.

With respect to the sheet subjected to the sorting shift by the alignment plate 95 of the processing tray 90, the discharge upper roller 78*a* is moved down again to nip the sheet, and the discharge roller 78 discharges to the first collection tray 110 for each sheet or as a bunch when necessary. On the other hand, for also the sheet on which the sorting shift is not executed in the processing tray 90, when the sheet arrives at the discharge roller 78 from the carry-in roller 72, the carry-in roller 72 is halted (S460). Concurrently therewith, the discharge roller 78 nips the sheet to discharge to the first collection tray 110. In the case where the next sheet exists, the flow returns to the start, is repeated until the predetermined number of sheets is processed, and is completed. According to the operation processing as described above, the sheet processing of the large size is performed in the case with the punch unit 60. Herein, the shift of the sheet of the large size is not performed with the shift roller 52, and therefore, as described previously, the sorting processing is performed with the alignment plate 95 of the processing tray 90.

[Processing at the Time of the Dummy Punch (Transport Guide) 60D]

(From S500 to S590)

Figure 26:
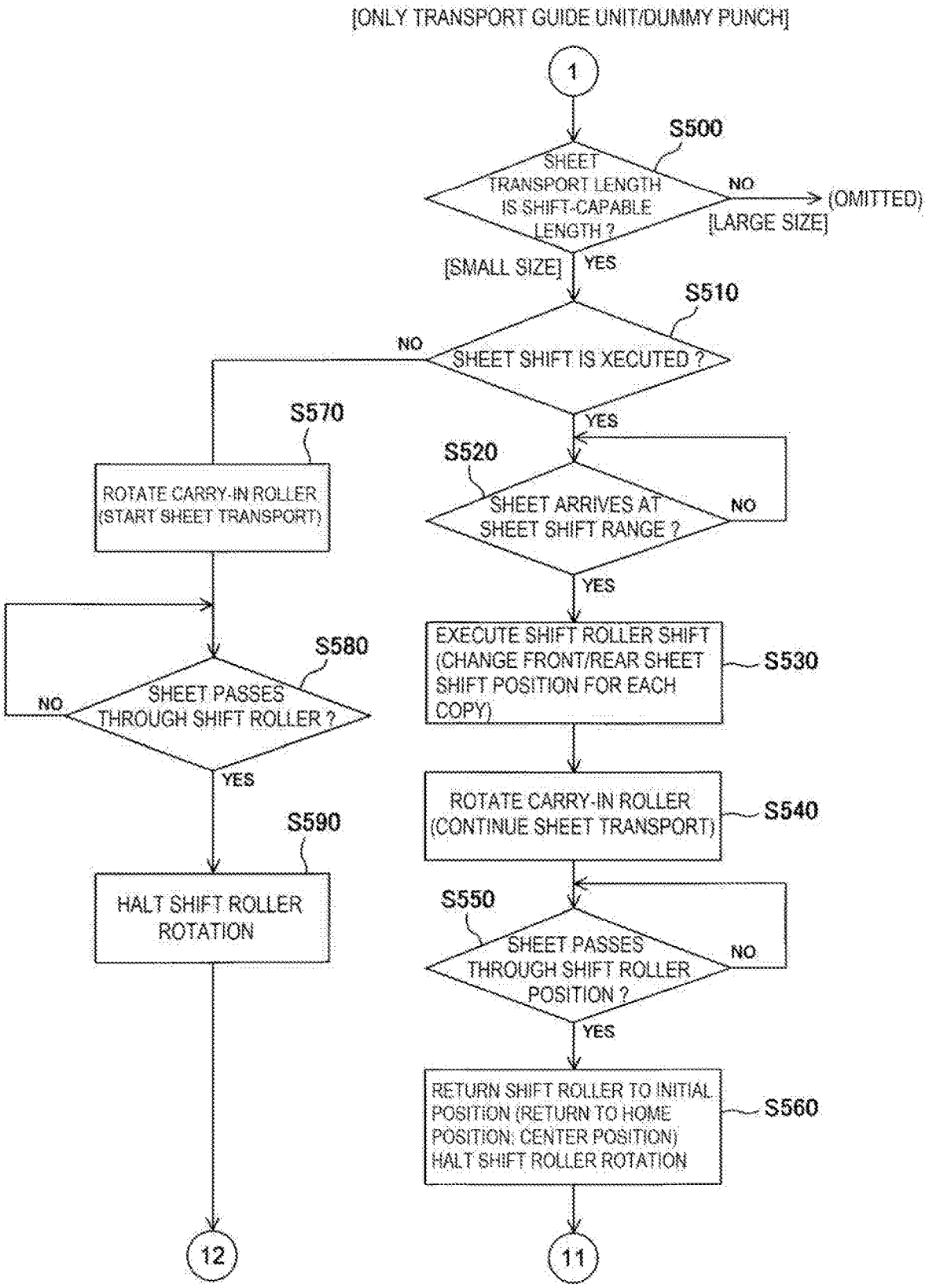
FIG. 26 is another processing flow diagram of the sheet in the case of the transport guide (without punch unit/dummy punch) continued from FIG. 21.

Hereinafter, the flow of the sheet processing will be described in the case of only the transport guide unit (60D) without the punch unit 60 being installed in FIG. 26. In addition, herein, with only the shift of the sheet without the punching processing, the processing of the large size is performed with the alignment plate 95, and by using the table of FIG. 20, the explanation herein is omitted.

When it is judged that the punch unit 60 does not exist, the length of the sheet to transport is next judged. Also herein, as in FIG. 21, the sheet is classified into the small size and large size (S500). When it is judged that the sheet is of the small size, it is next judged whether to shift using the shift roller 52 (S510). In the case of performing the shift of the shift roller 52, it is checked whether the sheet is positioned in the range of L3 in approximately the same position as the die hole 63. This check is made by the sensor in the same position as the punch sensor 60S (S520). When the sheet is positioned inside L3, the shift roller 52 is shifted, while transporting the sheet to the front-side shift or the rear-side shift (S530).

This shift is performed until the sheet front end arrives at the carry-in roller 72. Then, the carry-in roller 72 is rotated to successively transport (S540). Next, when the sheet rear end passes through the shift roller 52, the shift roller 52 is returned to the position that is the home position at the center of the apparatus, and the rotation is halted (S560).

In the case of judging that the shift of the shift roller 52 is not performed (S510), the carry-in roller 72 is rotated to perform successive-transport of the sheet (S570). Subsequently, it is checked whether or not the sheet passes through the shift roller 52 (S580). In the case where the sheet passes through, the rotation of the shift roller 52 is once halted (S590). The next operation will be described in FIG. 27, including the return of the shift roller 52 to the home position.

(From S600 to S620)

Figure 27:
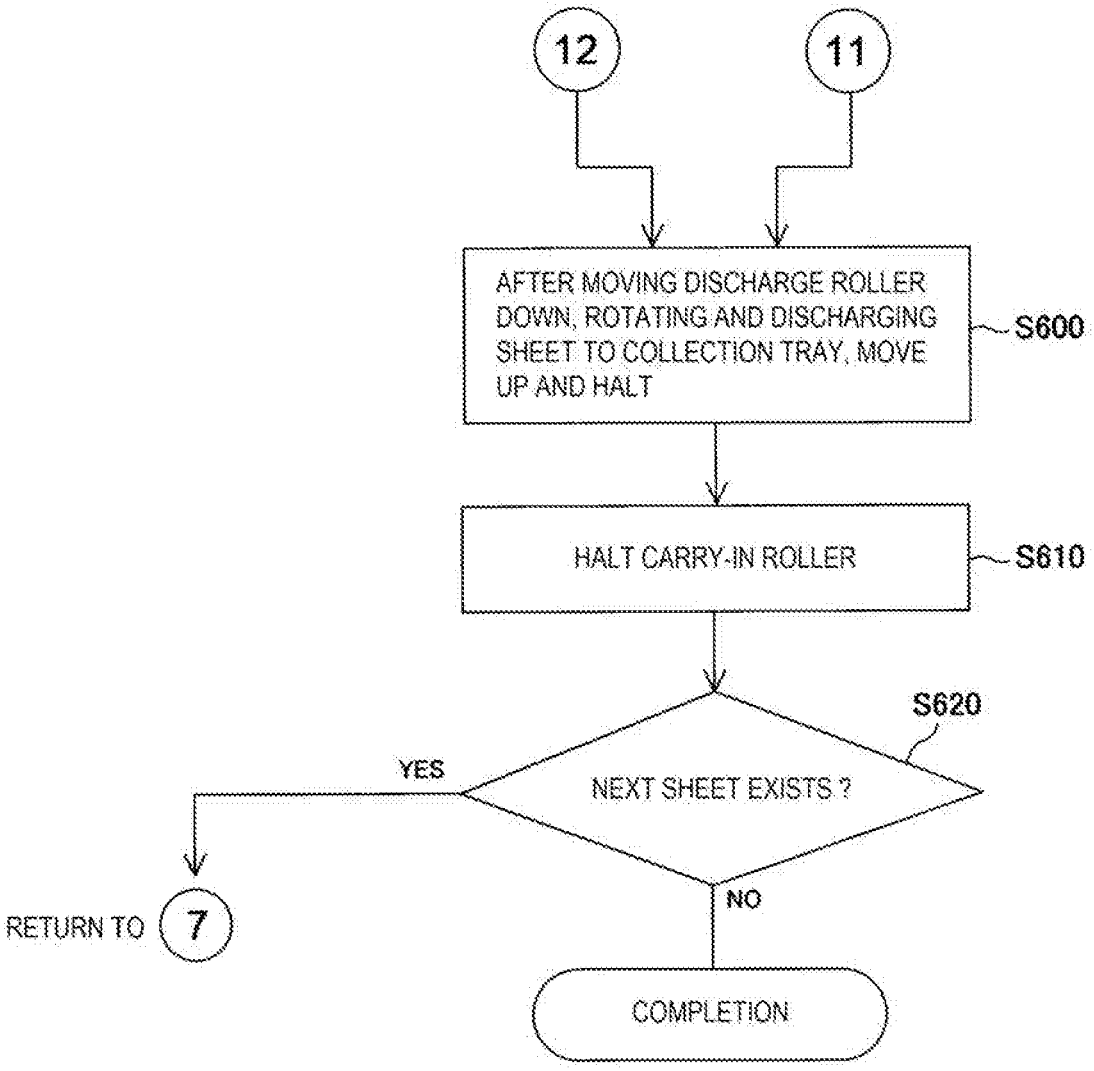
FIG. 27 is still another processing flow diagram of the sheet continued from FIG. 26.

As shown in FIG. 27, after the shift roller 52 is halted, after a lapse of predetermined time since the sheet rear end has passed through a sheet sensor 73, the discharge upper roller 78*a* is moved down to the discharge lower roller 78*b* to discharge the sheet to the first collection tray 110 as the discharge roller 78. By this means, sorted sheets, or sheets that are not sorted are sequentially collected in the first collection tray 110. Subsequently, the discharge upper roller 78*a* is moved up, and the rotation of the discharge roller 78 is halted (S600). Approximately concurrently therewith, the carry-in roller 72 (carrying-out roller 74) is also halted (S610). In the case where the next sheet exists, the flow is returned to the start, and is repeated until the predetermined number of sheets is processed to complete. By the operation processing as described above, the sheet processing of the small size is performed in the case of the transport guide unit (60D) without the punch unit 60. In addition, as in the foregoing description, the sheet of the large size is subjected to the sorting processing with the alignment plate 95 of the collection tray 90, and is collected in the first collection tray 110 as described previously.

[Load State in the First Collection Tray]

Figure 28A:
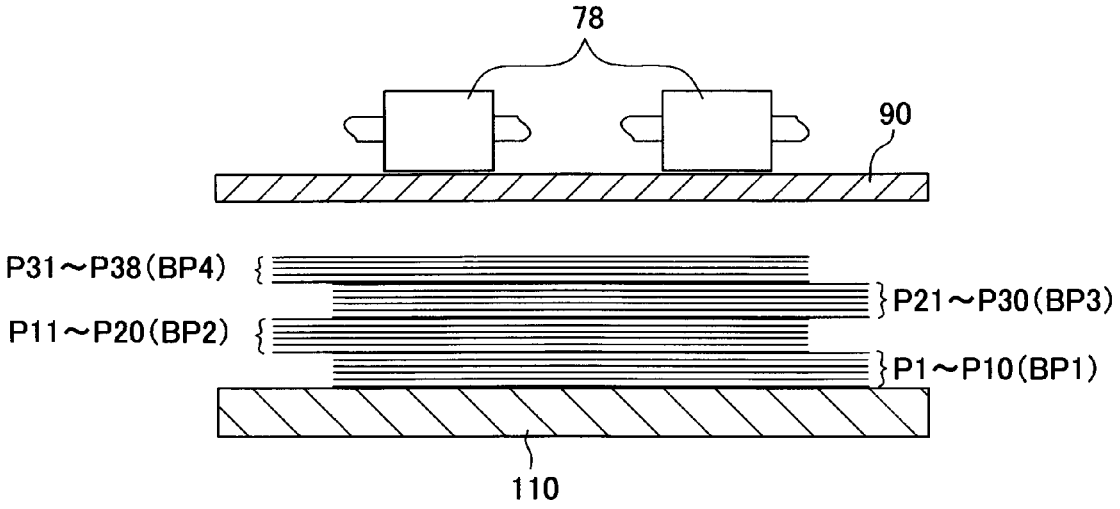
FIGS. 28A and 28B contain explanatory views of a sorting state of bunches of sheets viewed from the collection tray side, where
Figure 28B:
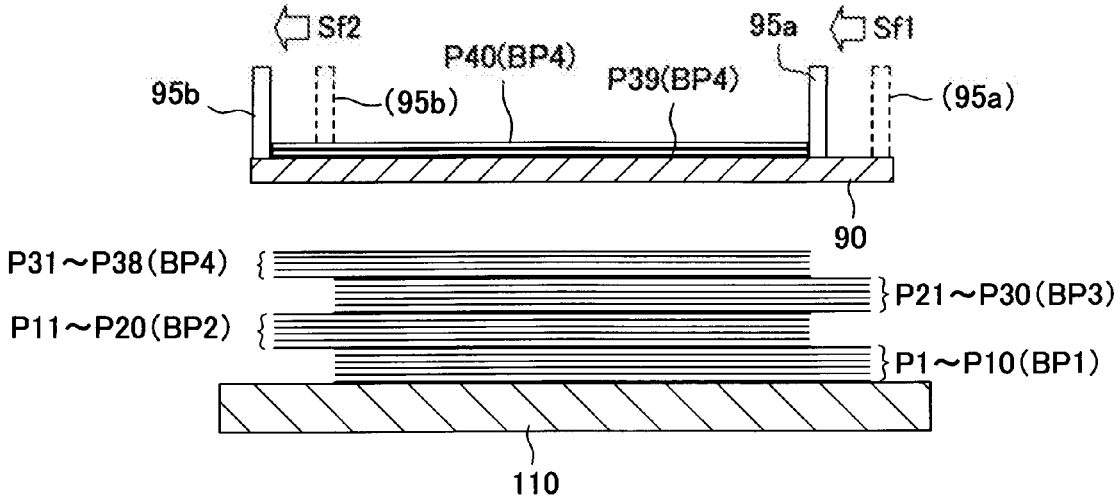

Referring to FIGS. 28A and 28B, described is a state of sheets which are sorted by the shift roller 52 or the alignment plate 95 on the processing tray 90 and collected in the first collection tray 110 according to the flow as described above. First, FIG. 28A is a collection state view of sheets obtained by sorting a sheet, which is sorted by the shift roller 52, by the discharge roller 78 and discharging. In this figure, the sheet shifted by the shift roller 52 is discharged by the discharge roller 78 and is collected, via the carry-in roller 72 and carrying-out roller 74. In the case of this figure, four parts each of 10 sheets are sorted and collected. In addition, this collection method is the same as in the case of collecting in the second collection tray 115 from the second transport path 80 by an escape roller 114.

On the other hand, FIG. 28B is a collection state view in the first collection tray 110 of sheets shifted by the alignment plate 95 of the processing tray 90. As shown in the figure, the sheet of the large size is once placed in the processing tray 90, is shifted by the front-side alignment plate 95*a* and rear-side alignment plate 95*b*, and is placed in the first collection tray 110. In the sheets in this Embodiment, the shift is performed by the alignment plate 95 every two sheets, and the last two sheets are shifted to the rear side. Thus, in this Embodiment, it is possible to sort and collect the sheet of the small size in the state of FIG. 28A, in any of the first transport path 70 and the second transport path 80. Further, it is possible to sort the sheet of the large size by the alignment plate 95 of the processing tray 90 shown in FIG. 28B to collect.

[Die Hole Avoidance Shift and Sorting Shift]

Herein, in the case of transporting a particular sheet (letter-size vertical format and legal size in this Embodiment), in the punch blades 62 and die holes 63 receiving the blades formed in the punch shift unit 61, there is the risk that the front end corner of the particular sheet is caught in the three-hole punch blade 62TP and three-hole die hole 63TD among the blades and holes, and that a jam occurs. In other words, when the three-hole die holes 63TD are positioned in positions spaced 108 mm on opposite sides away from the center of the punch shift unit 61, since the sheet widths of the letter vertical format and legal size are 216 mm, the above-mentioned getting caught occurs in transporting in accordance with the center without processing. Therefore, in this Embodiment, the next operation is performed.

Figure 29A:
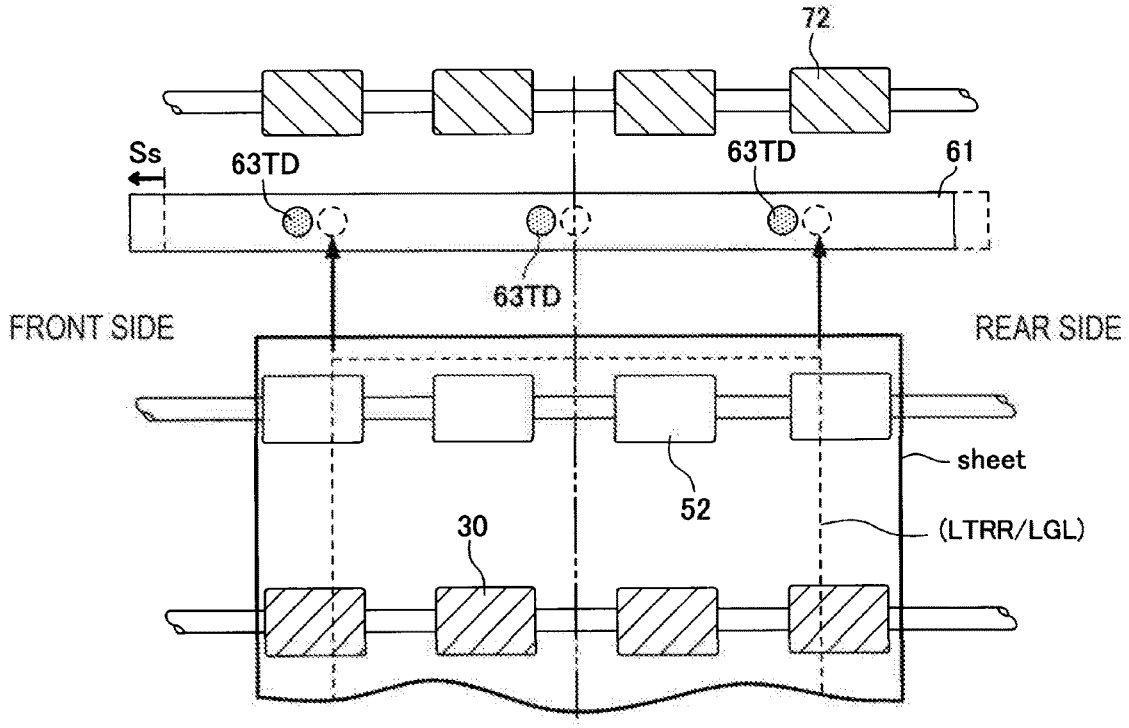
FIGS. 29A and 29B contain explanatory views to prevent a particular sheet from being caught in a die hole, where

First, in FIG. 29A, the die hole is shifted to the front side of the apparatus to perform die hole avoidance. In this case, the punch shift unit 61 is shifted (Ss) to the front side to the extent of about 6 mm. By this means, when the letter vertical format and legal size are transported to the range partitioned by dashed lines in the figure, the risk of getting caught in the three-hole die hole 63TD is eliminated.

Figure 29B:
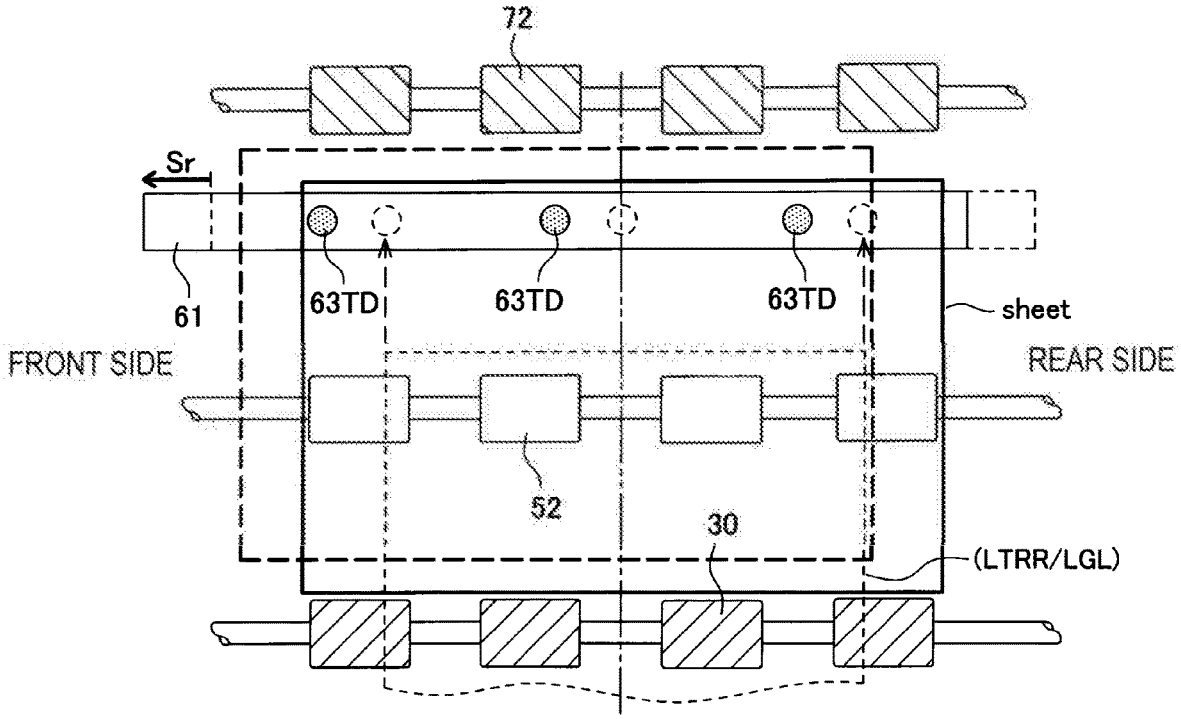

On the other hand, FIG. 29B illustrates the case of beforehand shifting the punch shift unit 61 to the same as the shift roller 52 or more in the case of performing the sorting shift on sheets by the shift of the shift roller 52. In this case, when the letter vertical format and legal size are transported to the range partitioned by dashed lines in the figure, by this sorting shift (Sr), the risk of getting caught in the three-hole die hole 63TD is eliminated. In other words, in this Embodiment, the punch shift unit 61 includes the short shift (Ss) of 6 mm for die hole avoidance, and the large shift of 15 mm for sorting, and in the case of performing sorting processing by the shift roller 52, the shift of die hole avoidance is not performed anew. As a matter of course, in carrying a sheet in the punch shift unit 61, the shift Ss may be performed, and the remaining amount from the Ss may be shifted to shift by the shift Sr for sorting as a result.

Figure 30A:
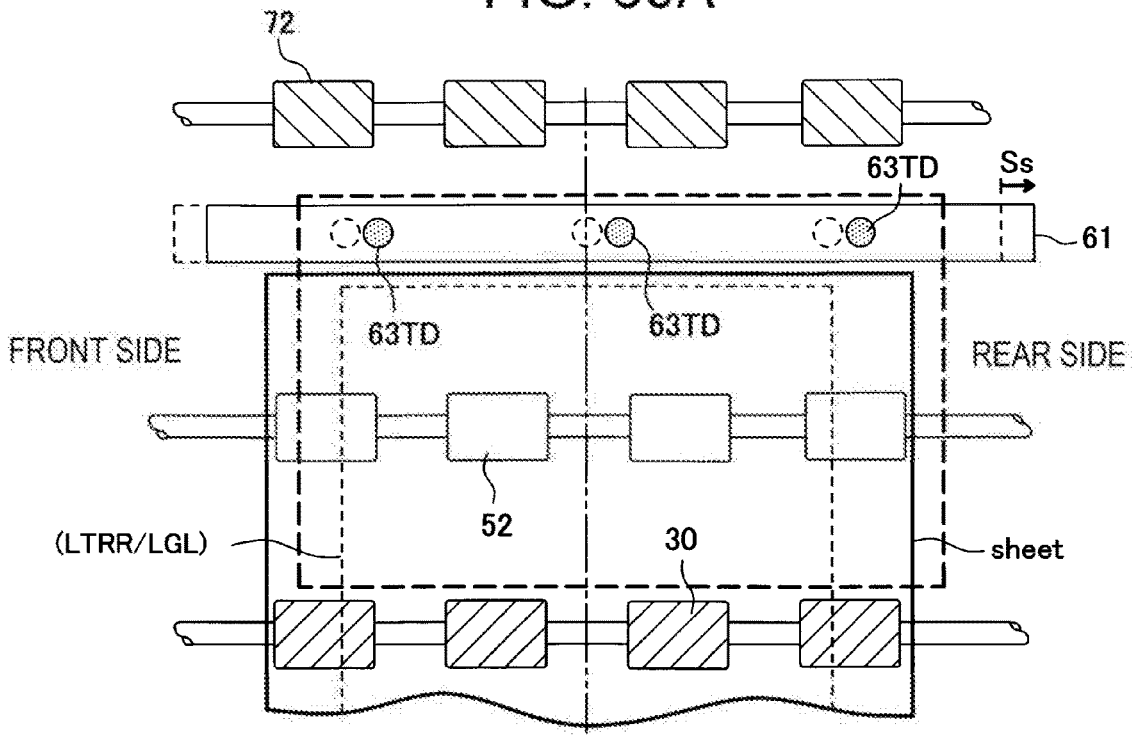
FIGS. 30A and 30B contains explanatory views to prevent a particular sheet from being caught in a die hole, where
Figure 30B:
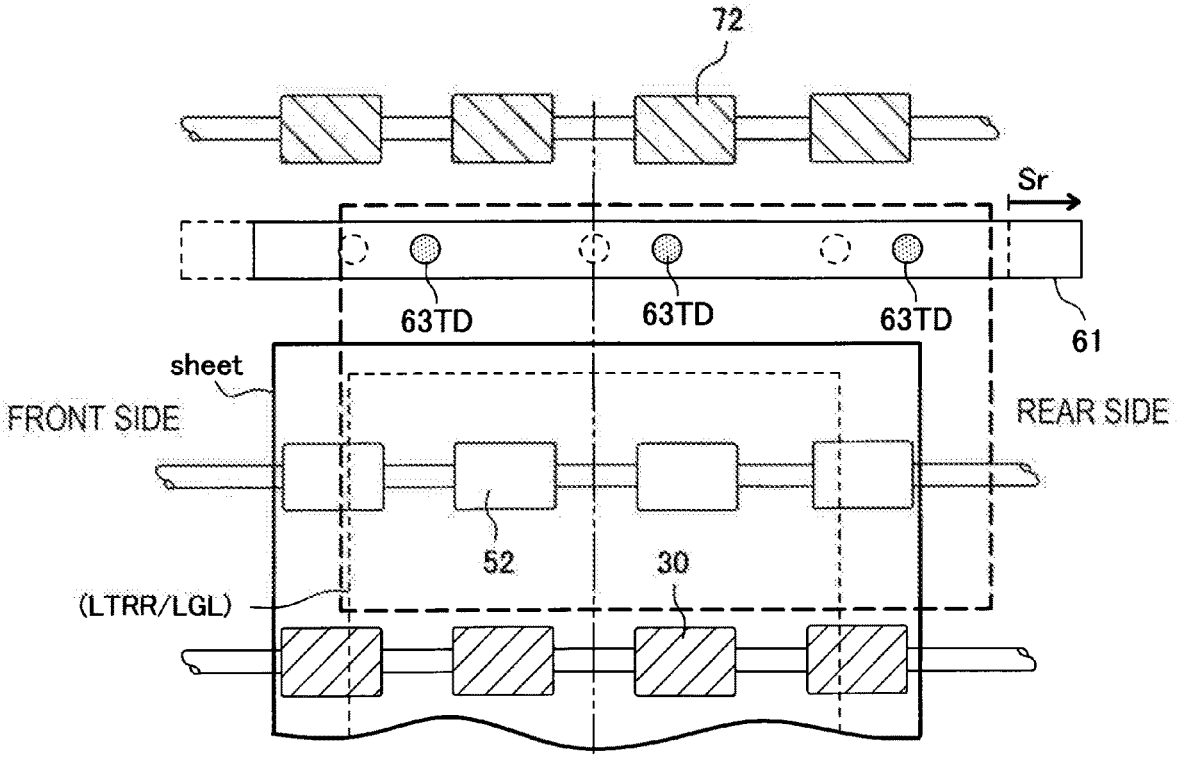

FIGS. 30A and 30B contain views where the punch shift unit 61 is shifted to rear side this time to perform the die hole avoidance or sorting shift. FIG. 30A illustrates a state where the shift (Ss) to the rear side is performed for die hole avoidance, and then, is a view where the punch blade 62 and die hole 63 punch a hole in the sheet in the center position. On the other hand, in FIG. 30B, the punch blade 62 and die hole 63 are shifted (Sr) to the rear side for sorting. In these members, as in FIGS. 29A and 29B, the punch shift unit 61 includes the short shift (Ss) of 6 mm for die hole avoidance, and the large shift of 15 mm for sorting, and in the case of performing sorting processing by the shift roller 52, the shift of die hole avoidance is not performed anew.

[Dispersion Collection of Punch Dust]

Figure 31A:
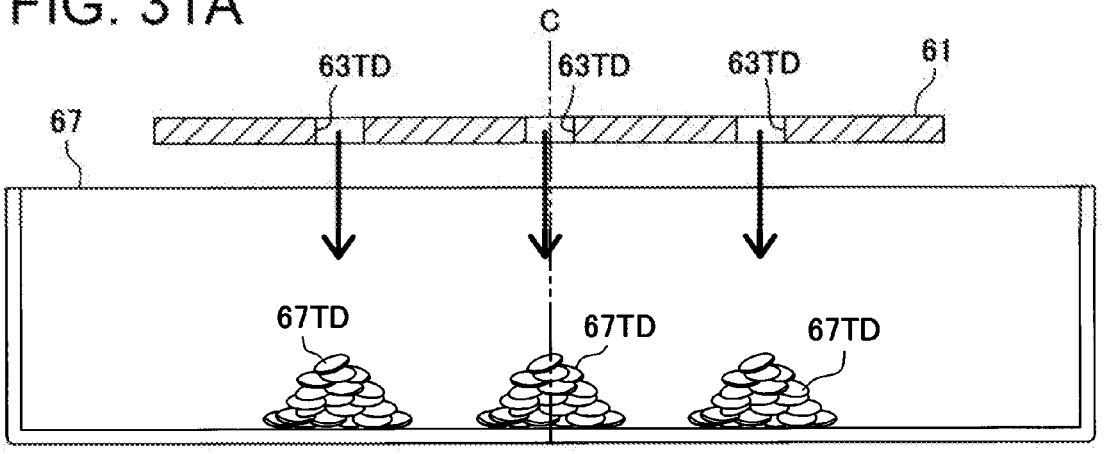
FIGS. 31A to 31C contain views to explain states of punch blades and die holes that shift and fixed dust box, where
Figure 31B:
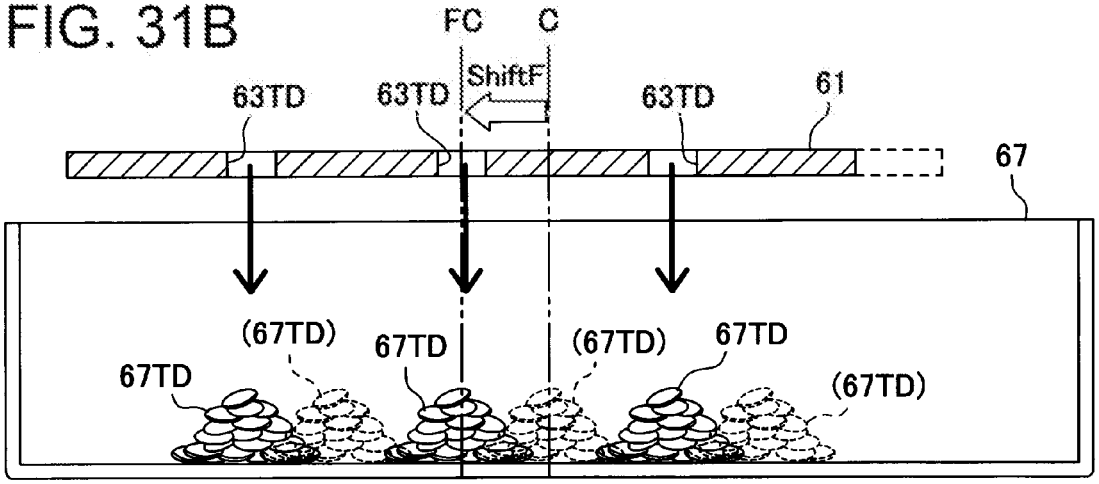
Figure 31C:
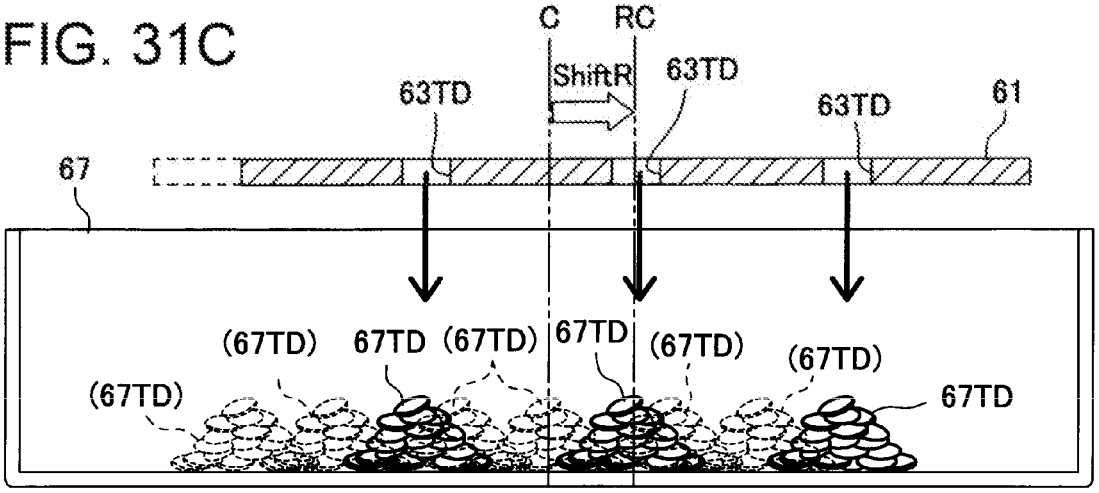

Referring to FIGS. 31A to 31C, described next is dispersion collection of punch dust generated by the sheet punching processing of the punch blade in this Embodiment. This figure illustrates a state in which punch dust from the die hole 63 by the punching processing is collected in the fixed dust box 67. For explanation, the figure shows the three-hole die holes 63TD of the punch shift unit 61 that shifts in the direction crossing the sheet transport direction, and indicates three-hole punch dust 67TD generated from the holes. In the actual apparatus, as shown in FIG. 10, there are the two-hole die holes 63WD or the higher number of die holes, and the holes are omitted for explanation.

FIG. 31A is a view where the three-hole die holes 63TD that correspond to the three-hole punch blades 62TP punch holes in the sheet in the apparatus center position. In this state, the punch dust is collected as the three-hole punch dust 67TD. When the punching processing is continued with this state kept, the punch dust is simply stacked, and the box is filled soon, although there is space to collect inside the dust box 67. In this case, a sweep member such as a lever to disperse the punch dust is operated, and when the dust is stacked, a relatively large force is required to shift.

Then, in association with the front-side shift and rear-side shift of the sheet by the shift roller 52 described in the foregoing as this Embodiment, the punch shift unit 61 is similarly shifted. Accordingly, when the dust box 67 is fixed and disposed, with respect to the punch shift unit 61 that shifts in the direction crossing the transport direction, the punch dust is dispersed as a result, it is not necessary to provide the sweep member such as a lever to disperse the punch dust, or even when the member is provided, since the punch dust is beforehand dispersed, it is possible to perform dispersion collection of dust by a relatively light force.

In other words, when the sorting processing by the shift roller 52 is performed, as shown in FIG. 31B, by the shift of the punch shift unit 61 to the front side, collection positions of the three-hole punch dust 67TD also shift, and dust is dispersed with respect to the previous dust (shown by dashed lines) and is collected (shown by solid lines). In this case, the center of the sheet and punch shift unit 61 shifts to FC shown in the figure. On the other hand, as shown in FIG. 31C, when the shift roller 52 and the punch shift unit 61 are shifted to the rear side, by the shift of the punch shift unit 61 to the rear side, collection positions of the three-hole punch dust 67TD also shift, and dust is dispersed with respect to the previous dust (shown by dashed lines) and is collected (shown by solid lines). In this case, the center of the sheet and punch shift unit 61 shifts to RC shown in the figure.

As described above, in the above-mentioned Embodiment, in sorting of sheets every the designated number of copies, since the shift roller 52 and punch shift unit 61 are shifted for each sorting, it is also possible to disperse and collect the punch dust. Further, it is possible to particularly adopt this scheme in the case of performing punching processing on many sheets without the need of sorting processing. In other words, in the case of performing only the punching processing on about 3000 sheets and collecting in the first collection tray 110, by sorting in an appropriate range e.g. 500 sheets or 1000 sheets among the entire number of sheets to discharge and collect, it is possible to disperse the dust in the description explained in FIGS. 31A to 31C, and it is possible to decrease the number of times the apparatus is halted to discard the punch dust inside the dust box 67. As the collection state of sheets, for example, it is only configured that a part of the range shown in FIG. 28A is 500 sheets or 1000 sheets, sorting is indication of the number of sheets, and convenience is rather enhanced.

[Another Embodiment of Sheet End Portion Processing]

In the foregoing explanation in this Embodiment, the punch unit 60 is shown as the end portion processing unit for processing an end portion of a sheet, and as the end portion processing unit, for example, it is possible to adopt a corner cut unit for cutting a corner of a sheet. The summary of the corner cut apparatus will be described with reference to FIGS. 32 and 33. Details are described specifically in Japanese Patent Application No. 2015-238732 (corresponding U.S. application Ser. No. 15/367,998, corresponding US Publication No. 2017/0160693 A1) according to the application of the Present Applicant.

Figure 32:
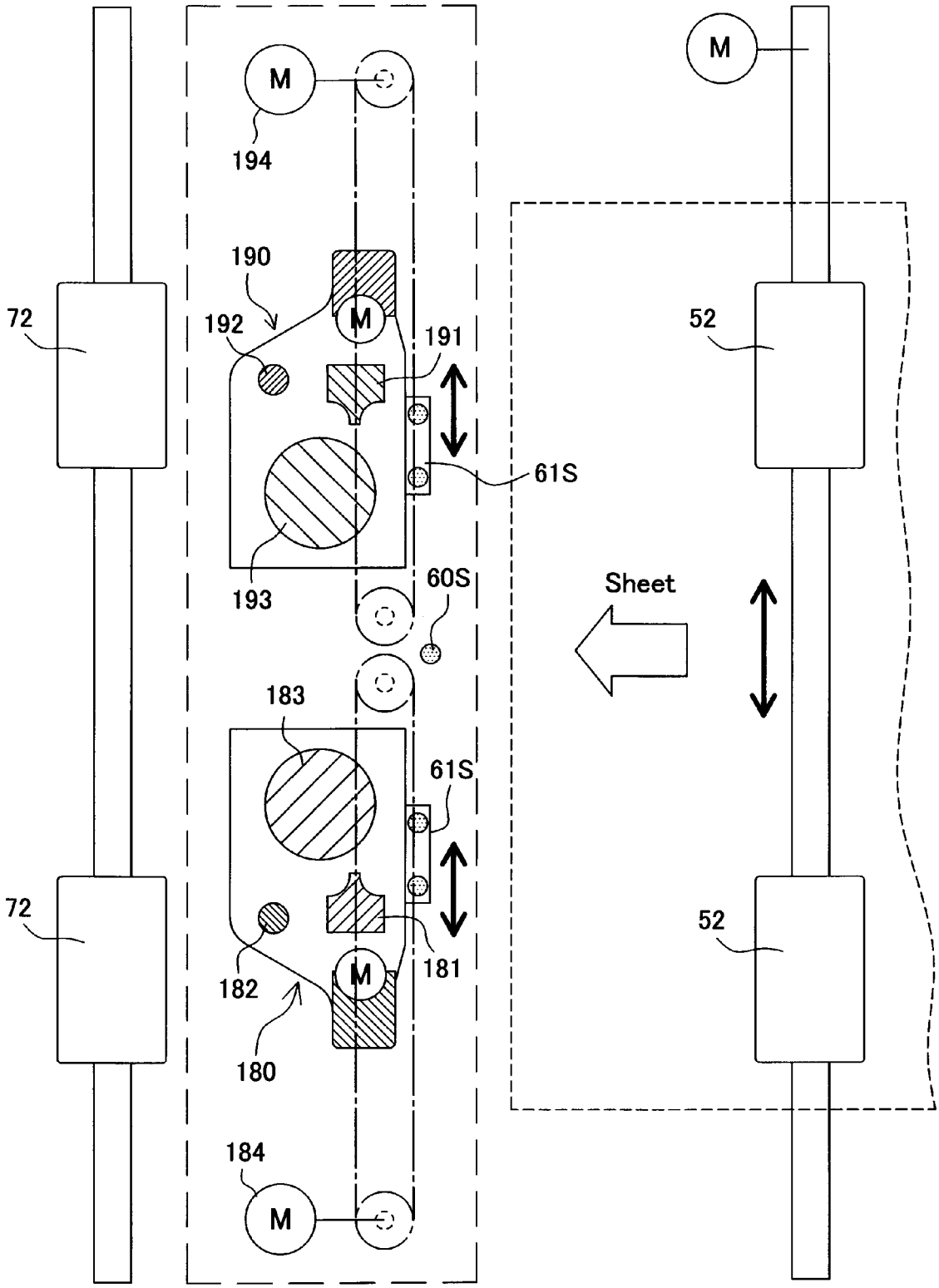
FIG. 32 shows another Embodiment of the end portion processing unit of sheets, and is a plan explanatory view of a punch•corner cut unit.
Figure 33:
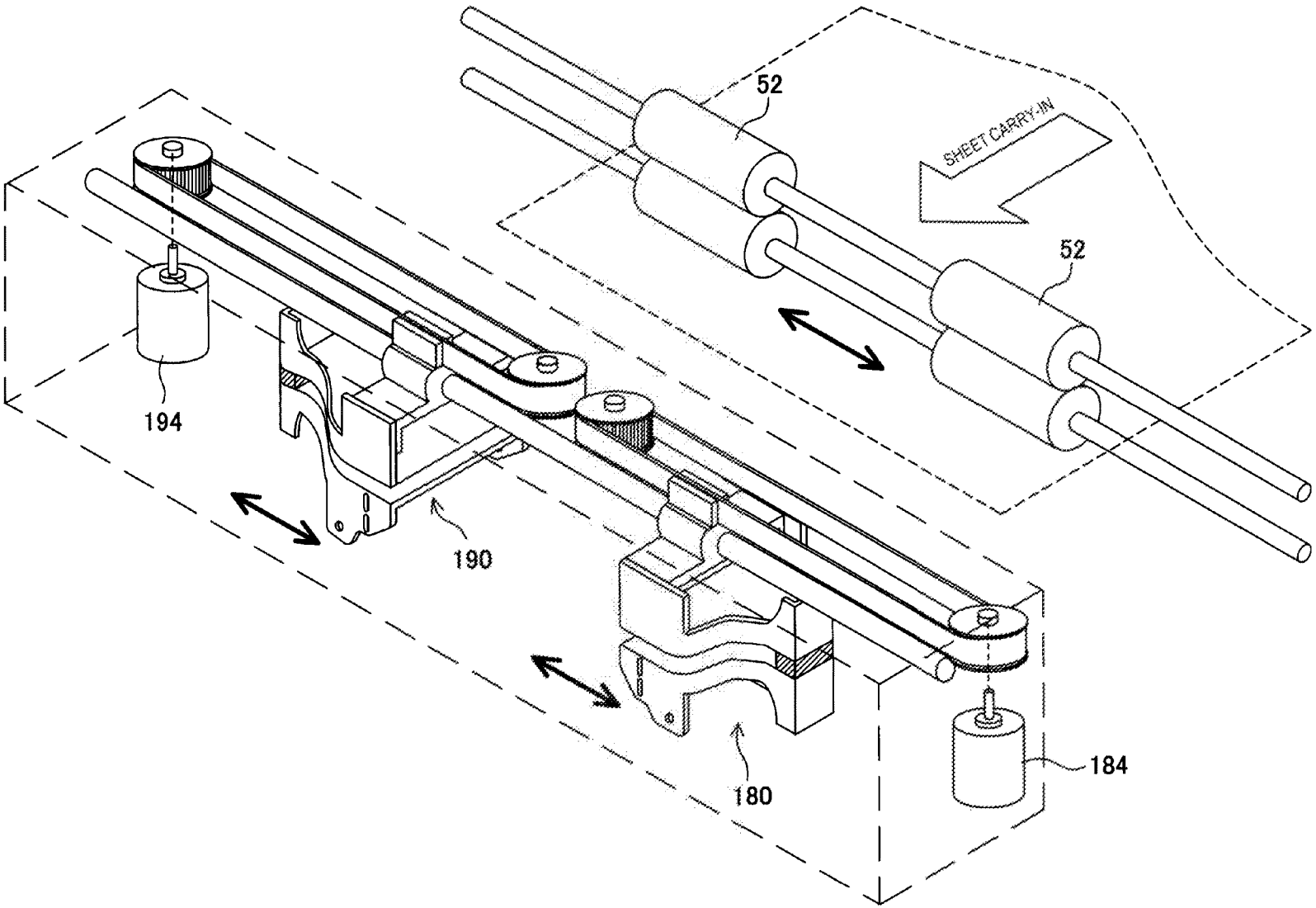
FIG. 33 is a perspective view of the punch•corner cut unit of FIG. 32.

FIGS. 32 and 33 illustrate a punch•cut corner unit provided with also a punch mechanism as the end portion processing unit of a sheet, FIG. 32 is a plan explanatory view of the unit, and FIG. 33 is a perspective view of the unit. As shown in FIGS. 31A to 31C, a punch•corner unit 180 is provided on the front side inside dash lines shown in the figure, so as to perform reciprocating motion in a half range in the direction crossing the transport direction by a corner unit motor 184. The punch•corner unit 180 is provided with a corner cut blade 181 for cutting a corner of a sheet, punch blade 182 and emboss 183 for embossing in a sheet. By this means, it is possible to perform the end portion processing in the half on the front side of the sheet.

Further, on the rear side (upper portion shown in the figure) of FIG. 32, a punch•corner unit 190 is provided, so as to perform reciprocating motion in a half range in the direction crossing the transport direction by a corner unit motor 194. The punch•corner unit 190 is provided with a corner cut blade 191 for cutting a corner of a sheet, punch blade 192 and emboss 193 for embossing in a sheet. By this means, it is possible to perform the end portion processing in the half on the rear side of the sheet. Accordingly, before the sheet is shifted in the direction crossing the transport direction by the shift roller 52, by driving the corner unit motor 184 and corner unit motor 194, it is possible to beforehand shift to shift positions. In addition, the punch sensor 60S at the center and the side edge sensor 61S provided in each unit perform the same work as described in the foregoing Embodiment. Further, the carry-in roller 72 is on the downstream side of the dashed-line box. FIG. 33 is a partial perspective view of the apparatus of FIG. 32. Thus, as the end portion processing unit for processing the end portion of the sheet, it is possible to adopt not only the punch unit 60 but also the corner cut unit for cutting the corner of the sheet and the like.

[Explanation of a Control Configuration]

Figure 34:
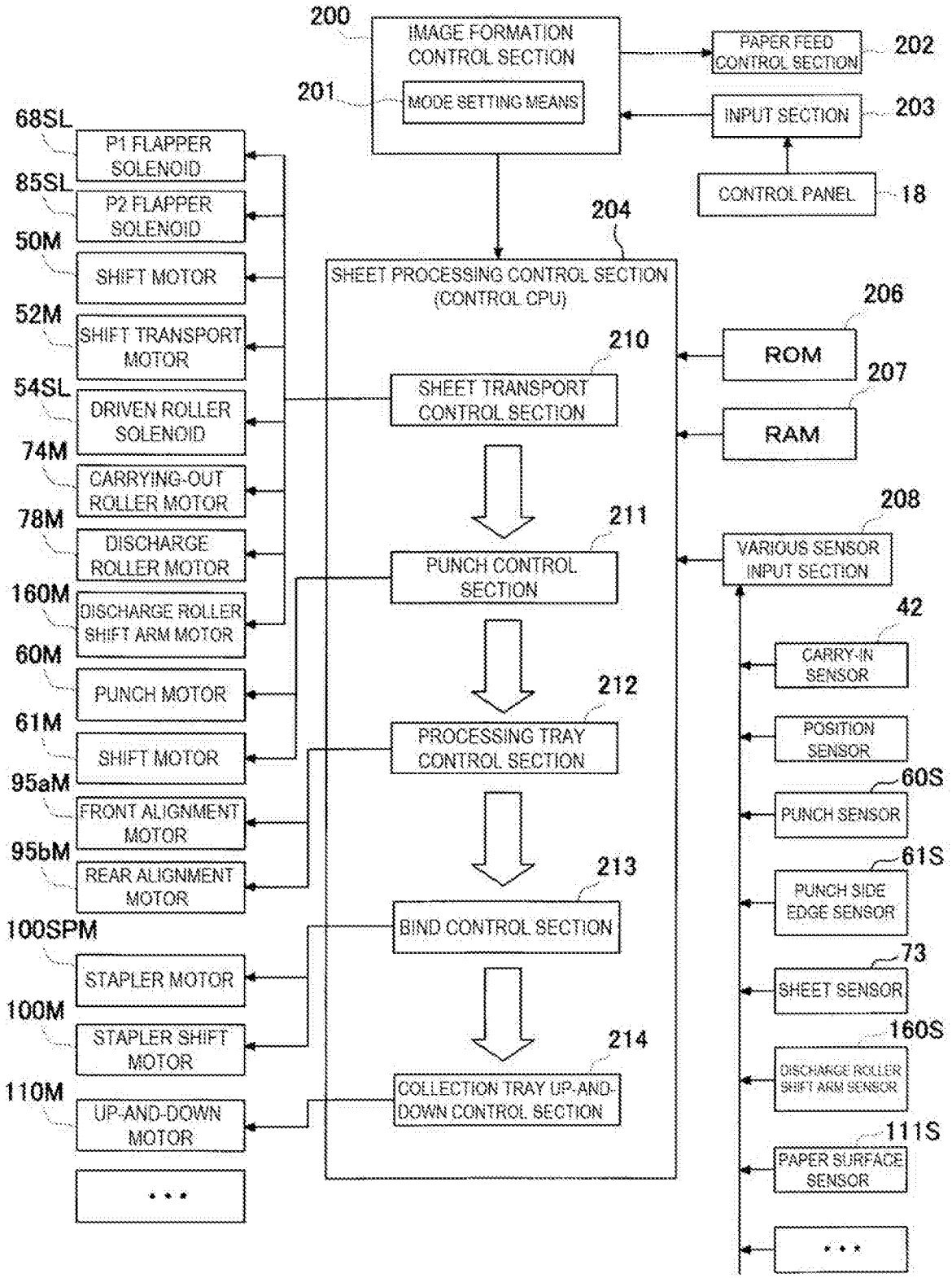
FIG. 34 is a block diagram of a control configuration in the entire configuration of FIG. 1.

According to a block diagram of FIG. 34, described is a system control configuration of the image formation apparatus A provided with the sheet processing apparatus B including the shift roller unit 50 and punch unit 60 (corner cut•punch unit) described in the forgoing. The image formation apparatus system shown in FIG. 1 is provided with an image formation control section 200 of the image formation apparatus A, and a sheet processing control section 204 (control CPU) of the sheet processing apparatus B including the transport unit 40, shift roller 50, punch unit 60, bind unit 100, first collection tray 110 and the like.

The image formation control section 200 is provided with a paper feed control section 202 and input section 203. Then, (1) "print mode", (2) "escape mode", (3) "sorting shift mode", (4) "punch mode (sheet side edge cut mode)", (5) "sheet binding mode", (6) "switchback mode" and combinations thereof described later are executed, from a control panel 18 provided in the input section 203. Particularly, as main combinations of this Embodiment, it is possible to make combinations shown in the table of FIG. 20.

The sheet processing control section 204 is the control CPU for causing the sheet processing apparatus B to operate corresponding to the designated sheet processing mode described previously. The sheet processing control section 204 is provided with ROM 206 for storing operation programs, and RAM 207 for storing control data. Further, for example, to the sheet processing control section 204 are connected the carry-in sensor 42 for detecting carry-in of a sheet to the shift roller unit 50 inside the transport unit 40, a position sensor for detecting a shift position of the shift roller 52, the punch sensor 60S for detecting a position of the sheet in the punch unit 60, the side edge sensor 61S for detecting the side edge of the sheet, the sheet sensor 73 for detecting the sheet of the first transport path 70, the discharge roller shift arm sensor 160S for detecting an up-and-down position of the discharge roller 78, the paper surface sensor 111S for detecting a height of the paper surface of the first collection tray 110, and the like according to this Embodiment.

Next, the sheet processing control section 204 is provided with a sheet transport control section 210 that controls the shift motor 50M of the transport unit 40 (including the shift roller 52), shift transport motor 52M, first flapper solenoid 68SL, second flapper solenoid 85SL, carrying-out roller motor 74M, discharge roller motor 78M, discharge roller shift arm motor 160M and the like. Further, the sheet processing control section 204 has a punch control section 211 that controls the punch motor 60M, and the shift motor 61M for shifting the punch shift unit 61. Furthermore, the section 204 also has a processing tray 90 control section 212 that controls the front-side alignment motor 95*a*M and rear-side alignment motor 95*b*M for shifting the alignment plate 95 so as to vary a placement position for alignment to bind or sorting in the processing tray 90. Still furthermore, the section 204 is provided with a bind control section 213 that controls the stapler motor 100SPM, and stapler shift motor 100M for shifting the stapler 100SP to a designated position of the bind unit 100 for performing binding in sheets placed and aligned in the processing tray 90, and a collection tray up-and-down control section 214 that controls the up-and-down motor 110M of the collection tray 110 corresponding to a load amount of sheets subjected to various sheet processing or sheets that are not subjected to the processing in the final stage.

[Sheet Processing Mode]

The sheet processing control section 204 of this Embodiment configured as described above causes the sheet processing apparatus B to execute, for example, (1) "print mode", (2) "escape mode", (3) "sorting shift mode", (4) "punch mode (sheet side edge cut mode)", (5) "sheet binding mode", (6) "switchback mode" and combinations thereof. The main processing modes will be described below.

(1) "Print-Out Mode"

The apparatus receives a sheet with an image formed from the main-body discharge roller 30 of the image formation apparatus A, transports the sheet to the shift roller 52 and first transport path 70 extending to the first collection tray 110, and stores in the first collection tray 110 on a sheet-by-sheet basis.

(2) "Escape Mode"

The apparatus receives a sheet with an image formed from the main-body discharge roller 30 of the image formation apparatus A, transports the sheet to the shift roller 52 and second transport path 80 extending to the second collection tray 115, and stores in the second collection tray 115 on a sheet-by-sheet basis. This escape mode is used in the case where an operator instructs, the case where sheet transport to the first collection tray 110 is performed, or the case where the length and thickness are irregular.

(3) "Sorting Shift Mode"

In this Embodiment, as described already, this mode is the processing for shifting the sheet of the small size for sheet sorting, by shifting the shift roller 52 to the front side and the rear side in the direction crossing the transport direction of the sheet. Further, in the sheet of the large size, a placement position is varied by the alignment plate 95 of the processing tray 90 to sort. In the apparatus in this Embodiment, when the shift mode is designated, a shift place is automatically varied corresponding to the sheet length.

(4) "Punch Mode (Sheet Side Edge Cut Mode)"

This mode is to punch two or three punch holes in the edge portion of the sheet such as a sheet to shift or a sheet not to shift capable of passing through the first transport path 70 for filing. Further, it is possible to use the corner cut mode for cutting the corner of the sheet in the shape of an arc together or replace with the corner cut mode.

(5) "Sheet Binding Mode"

This mode is to relay-transport a sheet with an image formed from the main-body discharge roller 30 to the shift roller 52, temporarily place in the processing tray 90 via the first transport path 70 including the punch unit 60, bind with the bind unit 100, and then discharge to the first collection tray 110. As this binding mode, it is possible to adopt not only the stapler 100SP for needle binding particularly, but also press binding and adhesive binding without having needles.

(6) "Switchback Mode"

In order to form images on both sides of a sheet, this mode is to use the sheet processing apparatus B as a transport guide so as to re-transport a sheet with an image formed on one side again to the image formation section by the main-body discharge roller 30. In this case, as described already in FIG. 14, the shift driven roller 54 is separated from the shift roller 52 not to interfere with switchback transport of the main-body discharge roller 30. This mode is automatically made when the main body side forms images on both sides without an operator designating, and since the mode is associated with this Embodiment, is explained as the mode particularly.

According to the Embodiment to carry out the present invention as described above, the following effects are exerted.

The sheet processing apparatus B for allocating a transported sheet to collect in the first collection tray 110 or the second collection tray 115 is provided with the carry-in path 34 that guides a sheet from the carry-in entrance 32, the relay roller (shift roller 52) provided in the carry-in path to relay and transport the sheet, the first transport path 70 that is positioned on the downstream side of the relay roller and that includes the carry-in roller 72 to transport the sheet from the carry-in path to the first collection tray, and the second transport path 80 that is branched off from the carry-in path 34 and that includes the branch roller 82 to transport the transported sheet to the second collection tray, where the relay roller shifts the sheet in the direction crossing the transport direction, and a shift by the relay roller is performed for a period during which a sheet front end enters the first transport path or the second transport path, and arrives at the carry-in roller or the branch roller.

According to the configuration, it is possible to provide a relatively compact sheet processing apparatus capable of shifting without increasing the carry-in path, by sorting and shifting a sheet in the direction crossing the transport direction after the sheet passes through the branch position for allocating to a plurality of collection trays of sheets.

Further, in the sheet processing apparatus as described, in the position branched off from the carry-in path 34, an allocating member (first flapper 68) for allocating the sheet to one of the first transport path 70 and the second transport path 80 is disposed immediately after the relay roller (shift roller 52), and the shift of the sheet by the relay roller is started, after the front end of the sheet passes through the allocating member.

According to the configuration, since the sheet shift is started after passing through the first flapper 68, it is possible to reduce failures such that the sheet is caught in a gap between the flapper and the carry-in path by the shift.

Furthermore, in the sheet processing apparatus as described above, the relay roller (shift roller 52) includes a receiving position (apparatus center position) for receiving a sheet transported from the carry-in entrance, shifts the sheet to a shift position on the front side or the rear side in the crossing direction from the receiving position after receiving the sheet, and returns to the receiving position (apparatus center position) after the shifted sheet passes through the relay roller.

According to the configuration, since the relay roller shifts the sheet to the front side and the rear side from the receiving position, the sorting shift amount is large, recognition of sorting is easy, and the roller returns to the receiving position immediately after passage of the sheet, and therefore, is easy to prepare for reception of the next sheet.

Moreover, according to the Embodiment to carry out the present invention, the sheet processing apparatus for shifting a transported sheet to sort in the collection tray (first collection tray 110) is provided with the carry-in path 34 that guides a sheet from the carry-in entrance 32, the shift roller 52 provided in the carry-in path to relay and transport the sheet, while shifting in the direction crossing the sheet transport direction, the first transport path 70 that is positioned on the downstream side of the shift roller and that includes the carry-in roller 72 to carry the sheet from the carry-in path toward the collection tray, the processing tray 90 to temporarily place the sheet from the first transport path, the shift member (alignment plate) that shifts a placement position of the sheet placed on the processing tray, and the discharge roller 78 that discharges the sheet transported from the first transport path or the sheet placed on the processing tray to the collection tray, where shifting the sheet transported by the shift roller 52 or shifting the placement position by the shift member (alignment plate 95) on the processing tray is selected corresponding to a length of the sheet transported from the carry-in entrance.

According to the configuration, by switching between performing the shift for sorting with the shift roller 52 and performing the shift on the processing tray 90 corresponding to a length of sheets to transport, it is possible to increase efficiency of sorting processing of sheets that are relatively used frequently in the compact apparatus, and to perform sorting of sheets without separating a transport roller even when the sheets are long sheets with a relatively low frequency of use.

Further, in the sheet processing apparatus as described above, in the case where a length L1 of the sheet transported from the carry-in entrance is shorter than a transport length from the carry-in entrance to the carry-in roller, the sheet is shifted by the shift roller and is discharged from the first transport path by the discharge roller 78, and in the case where the length is longer, the sheet is shifted by the shift member (alignment plate 95) on the processing tray 90 and is discharged by the discharge roller 78.

According to the configuration, since the sheet with the length relatively having general versatility is shifted by the shift roller, productivity in sorting is improved, and even in long sheets with a relatively low frequency of use, it is possible to perform sorting of the sheets by shifting in the processing tray, without separating the transport roller.

Furthermore, in the sheet processing apparatus as described above, the shift roller includes a receiving position (shift roller 52 apparatus center position) for receiving a sheet transported from the carry-in entrance, and shifts the sheet to a shift position on the front side or the rear side of the apparatus in the crossing direction from the receiving position after receiving the sheet, and the shift member of the processing tray is a pair of alignment plates that performs reciprocating motion in the direction crossing the sheet transport direction in the processing tray.

According to the configuration, since the shift roller 52 shifts from the center position to the front side and the rear side, the sorting range is increased, and the alignment plate 95 performs in the processing tray. Therefore, it is possible to perform sorting, while improving alignment characteristics of large sheets relatively easy to bend.

In addition, in the description of the effects in the Embodiment in the foregoing, for each portion of this Embodiment, a member corresponding to each component in the scope of the claims is shown in the parenthesis, or assigned the reference numeral to clarify the relationship between both the member and the component.

Further, the present invention is not limited to the above-mentioned Embodiment, various modifications thereof are capable of being made in the scope without departing from the invention, and all technical matters included in the technical ideas described in the scope of the claims are subjects of the invention. The Embodiment described previously illustrates preferred examples, a person skilled in the art is capable of achieving various types of alternative examples, corrected examples, modified examples or improved examples from the content disclosed in the present Description, and the examples are included in the technical scope described in the scope of the claims attached herewith.

This application claims priority from Japanese Patent Application No. 2016-239195 filed on Dec. 9, 2016 in Japan, and Japanese Patent Application No. 2016-239196 filed on Dec. 9, 2016, incorporated herein by reference.

What is claimed is:

1. A sheet processing apparatus, which is arranged in a space between an image reading section for reading an image and an image formation section for forming an image on a sheet, the image formation section being arranged under the image reading section and the space, the sheet processing apparatus allocating a sheet transported in a predetermined transport direction to collect in a first collection tray or a second collection tray, comprising:

a carry-in path adapted to guide a sheet from a carry-in entrance;

a relay roller provided in the carry-in path to relay and transport the sheet;

a first transport path, positioned on a downstream side of the relay roller, including a carry-in roller to transport the sheet from the carry-in path to the first collection tray; and a second transport path, branched off from the carry-in path, including a branch roller to transport the transported sheet to the second collection tray, wherein the relay roller shifts the sheet in a direction crossing the transport direction, and a shift by the relay roller is performed for a period during which a front end of the sheet enters the first transport path or the second transport path, and arrives at the carry-in roller or the branch roller.

2. The sheet processing apparatus according to claim 1, wherein in a position branched off from the carry-in path, an allocating member for allocating the sheet to one of the first transport path and the second transport path is disposed immediately after the relay roller, and the shift of the sheet by the relay roller is started, after the front end of the sheet passes through the allocating member.

3. The sheet processing apparatus according to claim 2, wherein the relay roller includes a receiving position for receiving a sheet transported from the carry-in entrance, shifts the sheet to a shift position on a front side or a rear side in a crossing direction from the receiving position after receiving the sheet, and returns to the receiving position after the sheet subjected to the shift passes through the relay roller.

4. The sheet processing apparatus according to claim 3, wherein the relay roller performs the shift of the sheet, in transporting the sheet shorter than a length from the carry-in entrance to the carry-in roller or the branch roller.

5. The sheet processing apparatus according to claim 4, wherein a position in which the shift of the sheet by the relay roller is completed is substantially the same position in sheets with different sheet lengths.

6. The sheet processing apparatus according to claim 4, wherein the carry-in path guides a sheet fed to the first transport path or the second transport path, and further guides a switchback sheet that arrives at the second transport path from the carry-in entrance and that is then fed backward to return to the carry-in entrance side, and the relay roller shifts the sheet fed to the first transport path or the second transport path.

7. The sheet processing apparatus according to claim 4, further comprising:

a processing tray adapted to temporarily place a transported sheet and discharge to the first collection tray, between the carry-in roller in the first transport path and the first collection tray; and a position shift member adapted to vary a collection position of the sheet in the processing tray before discharging to the first collection tray, wherein in a case of shifting a sheet with a length longer than a length to transport from the carry-in entrance to the carry-in roller or the branch roller, the sheet is shifted by the position shift member provided in the processing tray.

8. The sheet processing apparatus according to claim 7, wherein the shift member is a pair of alignment plates that performs reciprocating motion in the processing tray in the direction crossing the transport direction of the sheet.

9. The sheet processing apparatus according to claim 8, wherein a bind unit for binding sheets as a bunch is disposed in an end of the processing tray, on the side opposite to a discharge direction to the first collection tray.

10. A sheet processing apparatus, which is arranged in a space between an image reading section for reading an image and an image formation section for forming an image on a sheet, the image formation section being arranged under the image reading section and the space, the sheet processing apparatus collecting a sheet transported in a predetermined transport direction, comprising:

a carry-in path adapted to guide a sheet from a carry-in entrance;

a relay roller provided in the carry-in path to relay and capable of shifting the sheet in a direction crossing the transport direction;

a transport path positioned on a downstream side of the relay roller and transporting the sheet from the carry-in path in a direction downstream of the transport direction;

a collection tray collecting a sheet transported in the transport direction; and an alignment section positioned on the collection tray and aligning the sheet in a sheet width direction orthogonal to the sheet transport direction, wherein the relay roller shifts the sheet in the direction crossing the transport direction, and a shift by the relay roller is performed by arriving at the carry-in roller or the branch roller, and the alignment section is located in an area overlapping with the relay roller in a height direction orthogonal to the transport direction.

11. The sheet processing apparatus according to claim 10, wherein the transport path extends substantially in a horizontal direction.

12. The sheet processing apparatus according to claim 11, wherein the transport path is arranged substantially in the sheet transport direction.

13. A sheet processing apparatus, comprising:

a carry-in path adapted to guide a sheet from a carry-in entrance;

a relay roller provided in the carry-in path to relay and capable of shifting the sheet in a direction crossing the transport direction;

a transport path arranged substantially in a horizontal direction, positioned on a downstream side of the relay roller, and transporting the sheet from the carry-in path in a direction downstream of the transport direction;

a collection tray collecting a sheet transported in the transport direction; and an alignment section positioned on the collection tray and aligning the sheet in a sheet width direction orthogonal to the sheet transport direction, wherein the relay roller shifts the sheet in the direction crossing the transport direction, and a shift by the relay roller is performed by arriving at the carry-in roller or the branch roller, and the alignment section is located in an area overlapping with the relay roller in a height direction orthogonal to the transport direction.

* * * * *